US009622635B2

(12) United States Patent
Jones et al.

(10) Patent No.: US 9,622,635 B2
(45) **Date of Patent: *Apr. 18, 2017**

(54) AUTONOMOUS FLOOR-CLEANING ROBOT

(71) Applicant: iRobot Corporation, Bedford, MA (US)

(72) Inventors: Joseph L. Jones, Acton, MA (US); Newton E. Mack, Somerville, MA (US); David M. Nugent, Newport, RI (US); Paul E. Sandin, Brookline, NH (US)

(73) Assignee: iRobot Corporation, Bedford, MA (US)

( * ) Notice: Subject to any disclaimer, the term of this patent is extended or adjusted under 35 U.S.C. 154(b) by 298 days.

This patent is subject to a terminal disclaimer.

(21) Appl. No.: 14/283,968

(22) Filed: May 21, 2014

(65) Prior Publication Data

US 2014/0250613 A1 Sep. 11, 2014

Related U.S. Application Data

(63) Continuation of application No. 13/714,546, filed on Dec. 14, 2012, now Pat. No. 9,038,233, which is a (Continued)

(51) Int. Cl.
*A47L 11/40* (2006.01)
*A47L 5/30* (2006.01)

(Continued)

(52) U.S. Cl.
CPC ..... *A47L 11/4061* (2013.01); *A47L 5/30* (2013.01); *A47L 5/34* (2013.01); *A47L 7/02* (2013.01);

(Continued)

(58) Field of Classification Search
CPC .... A47L 9/009; A47L 11/4061; A47L 9/0411; A47L 5/30; A47L 7/02; A47L 5/34
See application file for complete search history.

(56) References Cited

U.S. PATENT DOCUMENTS 1,755,054 A 4/1930 Darst
1,780,221 A 11/1930 Buchmann (Continued)

FOREIGN PATENT DOCUMENTS

AU 2003275566 6/2004
DE 2128842 C3 12/1980

(Continued)

OTHER PUBLICATIONS

Andersen et al., "Landmark based navigation strategies," SPIE Conference on Mobile Robots XIII, SPIE vol. 3525, pp. 170-181, Jan. 8, 1999.

(Continued)

*Primary Examiner* — Robert Scruggs
(74) *Attorney, Agent, or Firm* — Fish & Richardson P.C.

(57) ABSTRACT

An autonomous floor-cleaning robot comprising a housing infrastructure including a chassis, a power subsystem; for providing the energy to power the autonomous floor-cleaning robot, a motive subsystem operative to propel the autonomous floor-cleaning robot for cleaning operations, a command and control subsystem operative to control the autonomous floor-cleaning robot to effect cleaning operations, and a self-adjusting cleaning head subsystem that includes a deck mounted in pivotal combination with the chassis, a brush assembly mounted in combination with the deck and powered by the motive subsystem to sweep up particulates during cleaning operations, a vacuum assembly disposed in combination with the deck and powered by the motive subsystem to ingest particulates during cleaning operations, and a deck adjusting subassembly mounted in (Continued)

combination with the motive subsystem for the brush assembly, the deck, and the chassis that is automatically operative in response to an increase in brush torque in said brush assembly to pivot the deck with respect to said chassis. The autonomous floor-cleaning robot also includes a side brush assembly mounted in combination with the chassis and powered by the motive subsystem to entrain particulates outside the periphery of the housing infrastructure and to direct such particulates towards the self-adjusting cleaning head subsystem.

24 Claims, 13 Drawing Sheets

Related U.S. Application Data continuation of application No. 12/201,554, filed on Aug. 29, 2008, now Pat. No. 8,474,090, which is a continuation of application No. 10/818,073, filed on Apr. 5, 2004, now Pat. No. 7,571,511, which is a continuation of application No. 10/320,729, filed on Dec. 16, 2002, now Pat. No. 6,883,201.

(60) Provisional application No. 60/345,764, filed on Jan. 3, 2002.

(51) Int. Cl.

| | |
|---|---|
| ***A47L 5/34*** | (2006.01) |
| ***A47L 7/02*** | (2006.01) |
| ***A47L 9/00*** | (2006.01) |
| ***A47L 9/04*** | (2006.01) |
| ***A47L 11/282*** | (2006.01) |

(52) U.S. Cl.

CPC ..... *A47L 9/009* (2013.01); *A47L 9/0411* (2013.01); *A47L 11/282* (2013.01); *A47L 11/4066* (2013.01); *A47L 2201/00* (2013.01); *A47L 2201/04* (2013.01); *A47L 2201/06* (2013.01)

(56) References Cited

U.S. PATENT DOCUMENTS

| | | | |
|---|---|---|---|
| 1,970,302 | A | 8/1934 | Gerhardt |
| 2,136,324 | A | 11/1938 | John |
| 2,302,111 | A | 11/1942 | Dow et al. |
| 2,353,621 | A | 7/1944 | Sav et al. |
| 2,770,825 | A | 11/1956 | Pullen |
| 2,930,055 | A | 3/1960 | Fallen et al. |
| 3,119,369 | A | 1/1964 | Harland et al. |
| 3,166,138 | A | 1/1965 | Dunn |
| 3,333,564 | A | 8/1967 | Waters |
| 3,375,375 | A | 3/1968 | Robert et al. |
| 3,381,652 | A | 5/1968 | Schaefer et al. |
| 3,457,575 | A | 7/1969 | Bienek |
| 3,550,714 | A | 12/1970 | Bellinger |
| 3,569,727 | A | 3/1971 | Aggarwal et al. |
| 3,649,981 | A | 3/1972 | Woodworth |
| 3,674,316 | A | 7/1972 | De Brey |
| 3,678,882 | A | 7/1972 | Kinsella |
| 3,690,559 | A | 9/1972 | Rudloff |
| 3,744,586 | A | 7/1973 | Leinauer |
| 3,756,667 | A | 9/1973 | Bombardier et al. |
| 3,809,004 | A | 5/1974 | Leonheart |
| 3,816,004 | A | 6/1974 | Bignardi |
| 3,845,831 | A | 11/1974 | James |
| RE28,268 | E | 12/1974 | Autrand |
| 3,851,349 | A | 12/1974 | Lowder |
| 3,853,086 | A | 12/1974 | Asplund |
| 3,863,285 | A | 2/1975 | Hukuba |
| 3,888,181 | A | 6/1975 | Kups |
| 3,937,174 | A | 2/1976 | Haaga |
| 3,952,361 | A | 4/1976 | Wilkins |
| 3,978,539 | A | 9/1976 | Yonkers |
| 3,989,311 | A | 11/1976 | Debrey |
| 3,989,931 | A | 11/1976 | Phillips |
| 4,004,313 | A | 1/1977 | Capra |
| 4,012,681 | A | 3/1977 | Finger et al. |
| 4,070,170 | A | 1/1978 | Leinfelt |
| 4,099,284 | A | 7/1978 | Shinozaki et al. |
| 4,119,900 | A | 10/1978 | Kremnitz |
| 4,175,589 | A | 11/1979 | Nakamura et al. |
| 4,175,892 | A | 11/1979 | De bray |
| 4,196,727 | A | 4/1980 | Verkaart et al. |
| 4,198,727 | A | 4/1980 | Farmer |
| 4,199,838 | A | 4/1980 | Simonsson |
| 4,209,254 | A | 6/1980 | Reymond et al. |
| D258,901 | S | 4/1981 | Keyworth |
| 4,297,578 | A | 10/1981 | Carter |
| 4,305,234 | A | 12/1981 | Pichelman |
| 4,306,329 | A | 12/1981 | Yokoi |
| 4,309,758 | A | 1/1982 | Halsall et al. |
| 4,328,545 | A | 5/1982 | Halsall et al. |
| 4,367,403 | A | 1/1983 | Miller |
| 4,369,543 | A | 1/1983 | Chen et al. |
| 4,401,909 | A | 8/1983 | Gorsek |
| 4,416,033 | A | 11/1983 | Specht |
| 4,445,245 | A | 5/1984 | Lu |
| 4,465,370 | A | 8/1984 | Yuasa et al. |
| 4,477,998 | A | 10/1984 | You |
| 4,481,692 | A | 11/1984 | Kurz |
| 4,482,960 | A | 11/1984 | Pryor |
| 4,492,058 | A | 1/1985 | Goldfarb et al. |
| 4,513,469 | A | 4/1985 | Godfrey et al. |
| D278,732 | S | 5/1985 | Ohkado |
| 4,518,437 | A | 5/1985 | Sommer |
| 4,534,637 | A | 8/1985 | Suzuki et al. |
| 4,556,313 | A | 12/1985 | Miller et al. |
| 4,575,211 | A | 3/1986 | Matsumura et al. |
| 4,580,311 | A | 4/1986 | Kurz |
| 4,601,082 | A | 7/1986 | Kurz |
| 4,618,213 | A | 10/1986 | Chen |
| 4,620,285 | A | 10/1986 | Perdue |
| 4,624,026 | A | 11/1986 | Olson et al. |
| 4,626,995 | A | 12/1986 | Lofgren et al. |
| 4,628,454 | A | 12/1986 | Ito |
| 4,638,445 | A | 1/1987 | Mattaboni |
| 4,644,156 | A | 2/1987 | Takahashi et al. |
| 4,649,504 | A | 3/1987 | Krouglicof et al. |
| 4,652,917 | A | 3/1987 | Miller |
| 4,654,492 | A | 3/1987 | Koerner et al. |
| 4,654,924 | A | 4/1987 | Getz et al. |
| 4,660,969 | A | 4/1987 | Sorimachi et al. |
| 4,662,854 | A | 5/1987 | Fang |
| 4,674,048 | A | 6/1987 | Okumura |
| 4,679,152 | A | 7/1987 | Perdue |
| 4,680,827 | A | 7/1987 | Hummel |
| 4,696,074 | A | 9/1987 | Cavalli |
| D292,223 | S | 10/1987 | Trumbull |
| 4,700,301 | A | 10/1987 | Dyke |
| 4,700,427 | A | 10/1987 | Knepper |
| 4,703,820 | A | 11/1987 | Reinaud |
| 4,709,773 | A | 12/1987 | Clement et al. |
| 4,710,020 | A | 12/1987 | Maddox et al. |
| 4,712,740 | A | 12/1987 | Duncan et al. |
| 4,716,621 | A | 1/1988 | Zoni |
| 4,728,801 | A | 3/1988 | O'Connor |
| 4,733,343 | A | 3/1988 | Yoneda et al. |
| 4,733,430 | A | 3/1988 | Westergren |
| 4,733,431 | A | 3/1988 | Martin |
| 4,735,136 | A | 4/1988 | Lee et al. |
| 4,735,138 | A | 4/1988 | Gawler et al. |
| 4,748,336 | A | 5/1988 | Fujie et al. |
| 4,748,833 | A | 6/1988 | Nagasawa |
| 4,756,049 | A | 7/1988 | Uehara |
| 4,767,213 | A | 8/1988 | Hummel |
| 4,769,700 | A | 9/1988 | Pryor |
| 4,777,416 | A | 10/1988 | George et al. |
| D298,766 | S | 11/1988 | Tanno et al. |
| 4,782,550 | A | 11/1988 | Jacobs |

(56) References Cited

U.S. PATENT DOCUMENTS 4,796,198 A 1/1989 Boultinghouse et al.
4,806,751 A 2/1989 Abe et al.
4,811,228 A 3/1989 Hyyppa
4,813,906 A 3/1989 Matsuyama et al.
4,815,157 A 3/1989 Tsuchiya
4,817,000 A 3/1989 Eberhardt
4,818,875 A 4/1989 Weiner
4,829,442 A 5/1989 Kadonoff et al.
4,829,626 A 5/1989 Harkonen et al.
4,832,098 A 5/1989 Palinkas et al.
4,851,661 A 7/1989 Everett
4,854,000 A 8/1989 Takimoto
4,854,006 A 8/1989 Nishimura et al.
4,855,915 A 8/1989 Dallaire
4,857,912 A 8/1989 Everett et al.
4,858,132 A 8/1989 Holmquist
4,867,570 A 9/1989 Sorimachi et al.
4,880,474 A 11/1989 Koharagi et al.
4,887,415 A 12/1989 Martin
4,891,762 A 1/1990 Chotiros
4,893,025 A 1/1990 Lee
4,901,394 A 2/1990 Nakamura et al.
4,905,151 A 2/1990 Weiman et al.
4,909,972 A 3/1990 Britz
4,912,643 A 3/1990 Beirne
4,918,441 A 4/1990 Bohman
4,919,224 A 4/1990 Shyu et al.
4,919,489 A 4/1990 Kopsco
4,920,060 A 4/1990 Parrent et al.
4,920,605 A 5/1990 Takashima
4,933,864 A 6/1990 Evans et al.
4,937,912 A 7/1990 Kurz
4,953,253 A 9/1990 Fukuda et al.
4,954,962 A 9/1990 Evans et al.
4,955,714 A 9/1990 Stotler et al.
4,956,891 A 9/1990 Wulff
4,961,303 A 10/1990 McCarty et al.
4,961,304 A 10/1990 Ovsborn et al.
4,962,453 A 10/1990 Pong et al.
4,967,862 A 11/1990 Pong et al.
4,971,591 A 11/1990 Raviv et al.
4,973,912 A 11/1990 Kaminski et al.
4,974,283 A 12/1990 Holsten et al.
4,977,618 A 12/1990 Allen
4,977,639 A 12/1990 Takahashi et al.
4,986,663 A 1/1991 Cecchi et al.
5,001,635 A 3/1991 Yasutomi et al.
5,002,145 A 3/1991 Wakaumi et al.
5,012,886 A 5/1991 Jonas et al.
5,018,240 A 5/1991 Holman
5,020,186 A 6/1991 Lessig et al.
5,022,812 A 6/1991 Coughlan et al.
5,023,788 A 6/1991 Kitazume et al.
5,024,529 A 6/1991 Svetkoff et al.
D318,500 S 7/1991 Malewicki et al.
5,032,775 A 7/1991 Mizuno et al.
5,033,151 A 7/1991 Kraft et al.
5,033,291 A 7/1991 Podoloff et al.
5,036,941 A 8/1991 Denzin et al.
5,040,116 A 8/1991 Evans et al.
5,045,769 A 9/1991 Everett
5,049,802 A 9/1991 Mintus et al.
5,051,906 A 9/1991 Evans et al.
5,062,819 A 11/1991 Mallory
5,070,567 A 12/1991 Holland
5,084,934 A 2/1992 Lessig et al.
5,086,535 A 2/1992 Grossmeyer et al.
5,090,321 A 2/1992 Abouav
5,093,955 A 3/1992 Blehert et al.
5,094,311 A 3/1992 Akeel
5,098,262 A 3/1992 Wecker et al.
5,105,502 A 4/1992 Takashima
5,105,550 A 4/1992 Shenoha
5,109,566 A 5/1992 Kobayashi et al.
5,111,401 A 5/1992 Everett, Jr. et al.
5,115,538 A 5/1992 Cochran et al.
5,127,128 A 7/1992 Lee
5,136,675 A 8/1992 Hodson
5,136,750 A 8/1992 Takashima et al.
5,142,985 A 9/1992 Stearns et al.
5,144,471 A 9/1992 Takanashi et al.
5,144,714 A 9/1992 Mori et al.
5,144,715 A 9/1992 Matsuyo et al.
5,152,028 A 10/1992 Hirano
5,152,202 A 10/1992 Strauss
5,154,617 A 10/1992 Suman et al.
5,155,684 A 10/1992 Burke et al.
5,163,202 A 11/1992 Kawakami et al.
5,163,320 A 11/1992 Goshima et al.
5,164,579 A 11/1992 Pryor et al.
5,165,064 A 11/1992 Mattaboni
5,170,352 A 12/1992 McTamaney et al.
5,173,881 A 12/1992 Sindle
5,182,833 A 2/1993 Yamaguchi et al.
5,187,662 A 2/1993 Kamimura et al.
5,202,742 A 4/1993 Frank et al.
5,204,814 A 4/1993 Noonan et al.
5,206,500 A 4/1993 Decker et al.
5,208,521 A 5/1993 Aoyama
5,216,777 A 6/1993 Moro et al.
5,222,786 A 6/1993 Sovis et al.
5,227,985 A 7/1993 DeMenthon
5,233,682 A 8/1993 Abe et al.
5,239,720 A 8/1993 Wood et al.
5,251,358 A 10/1993 Moro et al.
5,261,139 A 11/1993 Lewis
5,276,618 A 1/1994 Everett
5,276,939 A 1/1994 Uenishi
5,277,064 A 1/1994 Knigga et al.
5,279,672 A 1/1994 Betker et al.
5,284,452 A 2/1994 Corona
5,284,522 A 2/1994 Kobayashi et al.
5,293,955 A 3/1994 Lee
D345,707 S 4/1994 Alister
5,303,448 A 4/1994 Hennessey et al.
5,307,273 A 4/1994 Oh et al.
5,309,592 A 5/1994 Hiratsuka
5,310,379 A 5/1994 Hippely et al.
5,315,227 A 5/1994 Pierson et al.
5,319,827 A 6/1994 Yang
5,319,828 A 6/1994 Waldhauser et al.
5,321,614 A 6/1994 Ashworth
5,323,483 A 6/1994 Baeg
5,324,948 A 6/1994 Dudar et al.
5,331,713 A 7/1994 Tipton
5,341,186 A 8/1994 Kato
5,341,540 A 8/1994 Soupert et al.
5,341,549 A 8/1994 Wirtz et al.
5,345,649 A 9/1994 Whitlow
5,352,901 A 10/1994 Poorman
5,353,224 A 10/1994 Lee et al.
5,363,305 A 11/1994 Cox et al.
5,363,935 A 11/1994 Schempf et al.
5,369,347 A 11/1994 Yoo
5,369,838 A 12/1994 Wood et al.
5,386,862 A 2/1995 Glover et al.
5,399,951 A 3/1995 Lavallee et al.
5,400,244 A 3/1995 Watanabe et al.
5,404,612 A 4/1995 Ishikawa
5,410,479 A 4/1995 Coker
5,435,405 A 7/1995 Schempf et al.
5,440,216 A 8/1995 Kim
5,442,358 A 8/1995 Keeler et al.
5,444,965 A 8/1995 Colens
5,446,356 A 8/1995 Kim
5,446,445 A 8/1995 Bloomfield et al.
5,451,135 A 9/1995 Schempf et al.
5,454,129 A 10/1995 Kell
5,455,982 A 10/1995 Armstrong et al.
5,465,525 A 11/1995 Mifune et al.
5,465,619 A 11/1995 Sotack et al.
5,467,273 A 11/1995 Faibish et al.
5,471,560 A 11/1995 Allard et al.
5,491,670 A 2/1996 Weber

(56) References Cited

U.S. PATENT DOCUMENTS 5,497,529 A 3/1996 Boesi
5,498,948 A 3/1996 Bruni et al.
5,502,638 A 3/1996 Takenaka
5,505,072 A 4/1996 Oreper
5,507,067 A 4/1996 Hoekstra et al.
5,510,893 A 4/1996 Suzuki
5,511,147 A 4/1996 Abdel
5,515,572 A 5/1996 Hoekstra et al.
5,534,762 A 7/1996 Kim
5,535,476 A 7/1996 Kresse et al.
5,537,017 A 7/1996 Feiten et al.
5,537,711 A 7/1996 Tseng
5,539,953 A 7/1996 Kurz
5,542,146 A 8/1996 Hoekstra et al.
5,542,148 A 8/1996 Young
5,546,631 A 8/1996 Chambon
5,548,511 A 8/1996 Bancroft
5,551,119 A 9/1996 Wörwag
5,551,525 A 9/1996 Pack et al.
5,553,349 A 9/1996 Kilstrom et al.
5,555,587 A 9/1996 Guha
5,560,077 A 10/1996 Crotchett
5,568,589 A 10/1996 Hwang
D375,592 S 11/1996 Ljunggren
5,608,306 A 3/1997 Rybeck et al.
5,608,894 A 3/1997 Kawakami et al.
5,608,944 A 3/1997 Gordon
5,610,488 A 3/1997 Miyazawa
5,611,106 A 3/1997 Wulff
5,611,108 A 3/1997 Knowlton et al.
5,613,261 A 3/1997 Kawakami et al.
5,613,269 A 3/1997 Miwa
5,621,291 A 4/1997 Lee
5,622,236 A 4/1997 Azumi et al.
5,634,237 A 6/1997 Paranjpe
5,634,239 A 6/1997 Tuvin et al.
5,636,402 A 6/1997 Kubo et al.
5,642,299 A 6/1997 Hardin et al.
5,646,494 A 7/1997 Han
5,647,554 A 7/1997 Ikegami et al.
5,650,702 A 7/1997 Azumi
5,652,489 A 7/1997 Kawakami
5,682,313 A 10/1997 Edlund et al.
5,682,839 A 11/1997 Grimsley et al.
5,696,675 A 12/1997 Nakamura et al.
5,698,861 A 12/1997 Oh
5,709,007 A 1/1998 Chiang
5,710,506 A 1/1998 Broell et al.
5,714,119 A 2/1998 Kawagoe et al.
5,717,169 A 2/1998 Liang et al.
5,717,484 A 2/1998 Hamaguchi et al.
5,720,077 A 2/1998 Nakamura et al.
5,722,109 A 3/1998 Delmas et al.
5,732,401 A 3/1998 Conway
5,735,017 A 4/1998 Barnes et al.
5,735,959 A 4/1998 Kubo et al.
5,742,975 A 4/1998 Knowlton et al.
5,745,235 A 4/1998 Vercammen et al.
5,752,871 A 5/1998 Tsuzuki
5,756,904 A 5/1998 Oreper et al.
5,761,762 A 6/1998 Kubo
5,764,888 A 6/1998 Bolan et al.
5,767,437 A 6/1998 Rogers
5,767,960 A 6/1998 Orman
5,770,936 A 6/1998 Hirai et al.
5,777,596 A 7/1998 Herbert
5,778,486 A 7/1998 Kim
5,781,697 A 7/1998 Jeong
5,781,960 A 7/1998 Kilstrom et al.
5,784,755 A 7/1998 Karr et al.
5,786,602 A 7/1998 Pryor et al.
5,787,545 A 8/1998 Colens
5,793,900 A 8/1998 Nourbakhsh et al.
5,794,297 A 8/1998 Muta
5,802,665 A 9/1998 Knowlton et al.
5,812,267 A 9/1998 Everett et al.
5,814,808 A 9/1998 Takada et al.
5,815,880 A 10/1998 Nakanishi
5,815,884 A 10/1998 Imamura et al.
5,819,008 A 10/1998 Asama et al.
5,819,360 A 10/1998 Fujii
5,819,936 A 10/1998 Saveliev et al.
5,820,821 A 10/1998 Kawagoe et al.
5,821,730 A 10/1998 Drapkin
5,825,981 A 10/1998 Matsuda
5,828,770 A 10/1998 Leis et al.
5,831,597 A 11/1998 West et al.
5,836,045 A 11/1998 Anthony et al.
5,839,156 A 11/1998 Park et al.
5,839,532 A 11/1998 Yoshiji et al.
5,841,259 A 11/1998 Kim et al.
5,867,800 A 2/1999 Leif
5,867,861 A 2/1999 Kasen et al.
5,869,910 A 2/1999 Colens
5,894,621 A 4/1999 Kubo
5,896,611 A 4/1999 Haaga
5,903,124 A 5/1999 Kawakami
5,905,209 A 5/1999 Oreper
5,907,886 A 6/1999 Buscher
5,910,700 A 6/1999 Crotzer
5,911,260 A 6/1999 Suzuki
5,916,008 A 6/1999 Wong
5,924,167 A 7/1999 Wright et al.
5,926,909 A 7/1999 McGee
5,933,102 A 8/1999 Miller et al.
5,933,913 A 8/1999 Wright et al.
5,935,179 A 8/1999 Kleiner et al.
5,935,333 A 8/1999 Davis
5,940,346 A 8/1999 Sadowsky et al.
5,940,927 A 8/1999 Haegermarck et al.
5,940,930 A 8/1999 Oh et al.
5,942,869 A 8/1999 Katou et al.
5,943,730 A 8/1999 Boomgaarden
5,943,733 A 8/1999 Tagliaferri
5,943,933 A 8/1999 Evans et al.
5,947,225 A 9/1999 Kawakami et al.
5,950,408 A 9/1999 Schaedler
5,959,423 A 9/1999 Nakanishi et al.
5,968,281 A 10/1999 Wright et al.
5,974,348 A 10/1999 Rocks
5,974,365 A 10/1999 Mitchell
5,983,448 A 11/1999 Wright et al.
5,984,880 A 11/1999 Lander et al.
5,987,383 A 11/1999 Keller et al.
5,989,700 A 11/1999 Krivopal
5,991,951 A 11/1999 Kubo et al.
5,995,883 A 11/1999 Nishikado
5,995,884 A 11/1999 Allen et al.
5,996,167 A 12/1999 Close
5,998,953 A 12/1999 Nakamura et al.
5,998,971 A 12/1999 Corbridge
6,000,088 A 12/1999 Wright et al.
6,009,358 A 12/1999 Angott et al.
6,012,618 A 1/2000 Matsuo et al.
6,021,545 A 2/2000 Delgado et al.
6,023,813 A 2/2000 Thatcher et al.
6,023,814 A 2/2000 Imamura
6,025,687 A 2/2000 Himeda et al.
6,026,539 A 2/2000 Mouw et al.
6,030,464 A 2/2000 Azevedo
6,030,465 A 2/2000 Marcussen et al.
6,032,327 A 3/2000 Oka et al.
6,032,542 A 3/2000 Warnick et al.
6,036,572 A 3/2000 Sze
6,038,501 A 3/2000 Kawakami
6,040,669 A 3/2000 Hog
6,041,471 A 3/2000 Charky et al.
6,041,472 A 3/2000 Kasen et al.
6,046,800 A 4/2000 Ohtomo et al.
6,049,620 A 4/2000 Dickinson et al.
6,050,648 A 4/2000 Keleny
6,052,821 A 4/2000 Chouly et al.
6,055,042 A 4/2000 Sarangapani
6,055,702 A 5/2000 Imamura et al.

(56) References Cited

U.S. PATENT DOCUMENTS

| | | | |
|---|---|---|---|
| 6,061,868 | A | 5/2000 | Moritsch et al. |
| 6,065,182 | A | 5/2000 | Wright et al. |
| 6,070,290 | A | 6/2000 | Schwarze et al. |
| 6,073,432 | A | 6/2000 | Schaedler |
| 6,076,025 | A | 6/2000 | Ueno et al. |
| 6,076,026 | A | 6/2000 | Jambhekar et al. |
| 6,076,226 | A | 6/2000 | Reed |
| 6,076,227 | A | 6/2000 | Schallig et al. |
| 6,081,257 | A | 6/2000 | Zeller |
| 6,088,020 | A | 7/2000 | Mor |
| 6,094,775 | A | 8/2000 | Behmer |
| 6,099,091 | A | 8/2000 | Campbell |
| 6,101,670 | A | 8/2000 | Song |
| 6,101,671 | A | 8/2000 | Wright et al. |
| 6,108,031 | A | 8/2000 | King et al. |
| 6,108,067 | A | 8/2000 | Okamoto |
| 6,108,076 | A | 8/2000 | Hanseder |
| 6,108,269 | A | 8/2000 | Kabel |
| 6,108,597 | A | 8/2000 | Kirchner et al. |
| 6,108,859 | A | 8/2000 | Burgoon |
| 6,112,143 | A | 8/2000 | Allen et al. |
| 6,112,996 | A | 9/2000 | Matsuo |
| 6,119,057 | A | 9/2000 | Kawagoe |
| 6,122,798 | A | 9/2000 | Kobayashi et al. |
| 6,124,694 | A | 9/2000 | Bancroft et al. |
| 6,125,498 | A | 10/2000 | Roberts et al. |
| 6,131,237 | A | 10/2000 | Kasper et al. |
| 6,138,063 | A | 10/2000 | Himeda |
| 6,142,252 | A | 11/2000 | Kinto et al. |
| 6,146,041 | A | 11/2000 | Chen et al. |
| 6,146,278 | A | 11/2000 | Kobayashi |
| 6,154,279 | A | 11/2000 | Thayer |
| 6,154,694 | A | 11/2000 | Aoki et al. |
| 6,160,479 | A | 12/2000 | Ahlen et al. |
| 6,167,332 | A | 12/2000 | Kurtzberg et al. |
| 6,167,587 | B1 | 1/2001 | Kasper et al. |
| 6,192,548 | B1 | 2/2001 | Huffman |
| 6,192,549 | B1 | 2/2001 | Kasen et al. |
| 6,202,243 | B1 | 3/2001 | Beaufoy et al. |
| 6,216,307 | B1 | 4/2001 | Kaleta et al. |
| 6,220,865 | B1 | 4/2001 | Macri et al. |
| 6,226,830 | B1 | 5/2001 | Hendriks et al. |
| 6,230,362 | B1 | 5/2001 | Kasper et al. |
| 6,237,741 | B1 | 5/2001 | Guidetti |
| 6,240,342 | B1 | 5/2001 | Fiegert et al. |
| 6,243,913 | B1 | 6/2001 | Frank et al. |
| 6,255,793 | B1 | 7/2001 | Peless et al. |
| 6,259,979 | B1 | 7/2001 | Holmquist |
| 6,261,379 | B1 | 7/2001 | Conrad et al. |
| 6,263,539 | B1 | 7/2001 | Baig |
| 6,263,989 | B1 | 7/2001 | Won |
| 6,272,936 | B1 | 8/2001 | Oreper et al. |
| 6,276,478 | B1 | 8/2001 | Hopkins et al. |
| 6,278,918 | B1 | 8/2001 | Dickson et al. |
| 6,279,196 | B2 | 8/2001 | Kasen et al. |
| 6,282,526 | B1 | 8/2001 | Ganesh |
| 6,283,034 | B1 | 9/2001 | Miles |
| 6,285,778 | B1 | 9/2001 | Nakajima et al. |
| 6,285,930 | B1 | 9/2001 | Dickson et al. |
| 6,286,181 | B1 | 9/2001 | Kasper et al. |
| 6,300,737 | B1 | 10/2001 | Bergvall et al. |
| 6,321,337 | B1 | 11/2001 | Reshef et al. |
| 6,321,515 | B1 | 11/2001 | Colens |
| 6,323,570 | B1 | 11/2001 | Nishimura et al. |
| 6,324,714 | B1 | 12/2001 | Walz et al. |
| 6,327,741 | B1 | 12/2001 | Reed |
| 6,332,400 | B1 | 12/2001 | Meyer |
| 6,339,735 | B1 | 1/2002 | Peless et al. |
| 6,362,875 | B1 | 3/2002 | Burkley |
| 6,370,453 | B2 | 4/2002 | Sommer |
| 6,374,155 | B1 | 4/2002 | Wallach et al. |
| 6,374,157 | B1 | 4/2002 | Takamura |
| 6,381,802 | B2 | 5/2002 | Park |
| 6,385,515 | B1 | 5/2002 | Dickson et al. |
| 6,388,013 | B1 | 5/2002 | Saraf et al. |
| 6,389,329 | B1 | 5/2002 | Colens |
| 6,397,429 | B1 | 6/2002 | Legatt et al. |
| 6,400,048 | B1 | 6/2002 | Nishimura et al. |
| 6,401,294 | B2 | 6/2002 | Kasper |
| 6,408,226 | B1 | 6/2002 | Byrne et al. |
| 6,412,141 | B2 | 7/2002 | Kasper et al. |
| 6,415,203 | B1 | 7/2002 | Inoue et al. |
| 6,418,586 | B2 | 7/2002 | Fulghum |
| 6,421,870 | B1 | 7/2002 | Basham et al. |
| 6,427,285 | B1 | 8/2002 | Legatt et al. |
| 6,430,471 | B1 | 8/2002 | Kintou et al. |
| 6,431,296 | B1 | 8/2002 | Won |
| 6,437,227 | B1 | 8/2002 | Theimer |
| 6,437,465 | B1 | 8/2002 | Nishimura et al. |
| 6,438,456 | B1 | 8/2002 | Feddema et al. |
| 6,438,793 | B1 | 8/2002 | Miner et al. |
| 6,442,476 | B1 | 8/2002 | Poropat |
| 6,442,789 | B1 | 9/2002 | Legatt et al. |
| 6,443,509 | B1 | 9/2002 | Levin et al. |
| 6,444,003 | B1 | 9/2002 | Sutcliffe |
| 6,446,302 | B1 | 9/2002 | Kasper et al. |
| 6,454,036 | B1 | 9/2002 | Airey et al. |
| D464,091 | S | 10/2002 | Christianson |
| 6,457,206 | B1 | 10/2002 | Judson |
| 6,459,955 | B1 | 10/2002 | Bartsch et al. |
| 6,463,368 | B1 | 10/2002 | Feiten et al. |
| 6,465,982 | B1 | 10/2002 | Bergvall et al. |
| 6,473,167 | B1 | 10/2002 | Odell |
| 6,480,762 | B1 | 11/2002 | Uchikubo et al. |
| 6,481,515 | B1 * | 11/2002 | Kirkpatrick ..... A47L 11/03 15/319 |
| 6,482,252 | B1 | 11/2002 | Conrad et al. |
| 6,490,539 | B1 | 12/2002 | Dickson et al. |
| 6,491,127 | B1 | 12/2002 | Holmberg et al. |
| 6,493,612 | B1 | 12/2002 | Bisset et al. |
| 6,493,613 | B2 | 12/2002 | Peless et al. |
| 6,496,754 | B2 | 12/2002 | Song et al. |
| 6,496,755 | B2 | 12/2002 | Wallach et al. |
| 6,502,657 | B2 | 1/2003 | Kerrebrock et al. |
| 6,504,610 | B1 | 1/2003 | Bauer et al. |
| 6,507,773 | B2 | 1/2003 | Parker et al. |
| 6,519,808 | B2 | 2/2003 | Legatt et al. |
| 6,525,509 | B1 | 2/2003 | Petersson et al. |
| D471,243 | S | 3/2003 | Cioffi et al. |
| 6,530,102 | B1 | 3/2003 | Pierce et al. |
| 6,530,117 | B2 | 3/2003 | Peterson |
| 6,532,404 | B2 | 3/2003 | Colens |
| 6,535,793 | B2 | 3/2003 | Allard |
| 6,540,424 | B1 | 4/2003 | Hall et al. |
| 6,540,607 | B2 | 4/2003 | Mokris et al. |
| 6,543,210 | B2 | 4/2003 | Rostoucher et al. |
| 6,548,982 | B1 | 4/2003 | Papanikolopoulos et al. |
| 6,553,612 | B1 | 4/2003 | Dyson et al. |
| 6,556,722 | B1 | 4/2003 | Russell et al. |
| 6,556,892 | B2 | 4/2003 | Kuroki et al. |
| 6,557,104 | B2 | 4/2003 | Vu et al. |
| D474,312 | S | 5/2003 | Stephens et al. |
| 6,563,130 | B2 | 5/2003 | Dworkowski et al. |
| 6,571,415 | B2 | 6/2003 | Gerber et al. |
| 6,571,422 | B1 | 6/2003 | Gordon et al. |
| 6,572,711 | B2 | 6/2003 | Sclafani et al. |
| 6,574,536 | B1 | 6/2003 | Kawagoe et al. |
| 6,580,246 | B2 | 6/2003 | Jacobs |
| 6,581,239 | B1 | 6/2003 | Dyson et al. |
| 6,584,376 | B1 | 6/2003 | Van Kommer |
| 6,586,908 | B2 | 7/2003 | Petersson et al. |
| 6,587,573 | B1 | 7/2003 | Stam et al. |
| 6,590,222 | B1 | 7/2003 | Bisset et al. |
| 6,594,551 | B2 | 7/2003 | McKinney et al. |
| 6,594,844 | B2 | 7/2003 | Jones |
| 6,597,076 | B2 | 7/2003 | Scheible et al. |
| D478,884 | S | 8/2003 | Slipy et al. |
| 6,601,265 | B1 | 8/2003 | Burlington |
| 6,604,021 | B2 | 8/2003 | Imai et al. |
| 6,604,022 | B2 | 8/2003 | Parker et al. |
| 6,605,156 | B1 | 8/2003 | Clark et al. |
| 6,609,269 | B2 | 8/2003 | Kasper |
| 6,611,120 | B2 | 8/2003 | Song et al. |
| 6,611,734 | B2 | 8/2003 | Parker et al. |

(56) References Cited

U.S. PATENT DOCUMENTS

| | | | |
|---|---|---|---|
| 6,611,738 | B2 | 8/2003 | Ruffner |
| 6,615,108 | B1 | 9/2003 | Peless et al. |
| 6,615,434 | B1 | 9/2003 | Davis et al. |
| 6,615,885 | B1 | 9/2003 | Ohm |
| 6,622,465 | B2 | 9/2003 | Jerome et al. |
| 6,624,744 | B1 | 9/2003 | Wilson et al. |
| 6,625,843 | B2 | 9/2003 | Kim et al. |
| 6,629,028 | B2 | 9/2003 | Paromtchik et al. |
| 6,633,150 | B1 | 10/2003 | Wallach et al. |
| 6,637,546 | B1 | 10/2003 | Wang |
| 6,639,659 | B2 | 10/2003 | Granger |
| 6,658,325 | B2 | 12/2003 | Zweig |
| 6,658,354 | B2 | 12/2003 | Lin |
| 6,658,692 | B2 | 12/2003 | Lenkiewicz et al. |
| 6,658,693 | B1 | 12/2003 | Reed |
| 6,661,239 | B1 | 12/2003 | Ozick |
| 6,662,889 | B2 | 12/2003 | De Fazio et al. |
| 6,668,951 | B2 | 12/2003 | Won |
| 6,670,817 | B2 | 12/2003 | Fournier et al. |
| 6,671,592 | B1 | 12/2003 | Bisset et al. |
| 6,671,925 | B2 | 1/2004 | Field et al. |
| 6,677,938 | B1 | 1/2004 | Maynard |
| 6,687,571 | B1 | 2/2004 | Byrne et al. |
| 6,690,134 | B1 | 2/2004 | Jones et al. |
| 6,690,993 | B2 | 2/2004 | Foulke et al. |
| 6,697,147 | B2 | 2/2004 | Ko et al. |
| 6,705,332 | B2 | 3/2004 | Field et al. |
| 6,711,280 | B2 | 3/2004 | Stafsudd et al. |
| 6,732,826 | B2 | 5/2004 | Song et al. |
| 6,735,811 | B2 | 5/2004 | Field et al. |
| 6,735,812 | B2 | 5/2004 | Hekman et al. |
| 6,737,591 | B1 | 5/2004 | Lapstun et al. |
| 6,741,054 | B2 | 5/2004 | Koselka et al. |
| 6,741,364 | B2 | 5/2004 | Lange et al. |
| 6,748,297 | B2 | 6/2004 | Song et al. |
| 6,756,703 | B2 | 6/2004 | Chang |
| 6,760,647 | B2 | 7/2004 | Nourbakhsh et al. |
| 6,764,373 | B1 | 7/2004 | Osawa et al. |
| 6,769,004 | B2 | 7/2004 | Barrett |
| 6,774,596 | B1 | 8/2004 | Bisset |
| 6,779,380 | B1 | 8/2004 | Nieuwkamp |
| 6,781,338 | B2 | 8/2004 | Jones et al. |
| 6,809,490 | B2 | 10/2004 | Jones et al. |
| 6,810,305 | B2 | 10/2004 | Kirkpatrick |
| 6,810,350 | B2 | 10/2004 | Blakley |
| 6,830,120 | B1 | 12/2004 | Yashima et al. |
| 6,832,407 | B2 | 12/2004 | Salem et al. |
| 6,836,701 | B2 | 12/2004 | McKee |
| 6,841,963 | B2 | 1/2005 | Song et al. |
| 6,845,297 | B2 | 1/2005 | Allard |
| 6,848,146 | B2 | 2/2005 | Wright et al. |
| 6,854,148 | B1 | 2/2005 | Rief et al. |
| 6,856,811 | B2 | 2/2005 | Burdue et al. |
| 6,859,010 | B2 | 2/2005 | Jeon et al. |
| 6,859,682 | B2 | 2/2005 | Naka et al. |
| 6,860,206 | B1 | 3/2005 | Rudakevych et al. |
| 6,865,447 | B2 | 3/2005 | Lau et al. |
| 6,870,792 | B2 | 3/2005 | Chiappetta |
| 6,871,115 | B2 | 3/2005 | Huang et al. |
| 6,883,201 | B2 | 4/2005 | Jones et al. |
| 6,886,651 | B1 | 5/2005 | Slocum et al. |
| 6,888,333 | B2 | 5/2005 | Laby |
| 6,901,624 | B2 | 6/2005 | Mori et al. |
| 6,906,702 | B1 | 6/2005 | Tanaka et al. |
| 6,914,403 | B2 | 7/2005 | Tsurumi |
| 6,917,854 | B2 | 7/2005 | Bayer |
| 6,925,357 | B2 | 8/2005 | Wang et al. |
| 6,925,679 | B2 | 8/2005 | Wallach et al. |
| 6,929,548 | B2 | 8/2005 | Wang |
| D510,066 | S | 9/2005 | Hickey et al. |
| 6,938,298 | B2 | 9/2005 | Aasen |
| 6,940,291 | B1 | 9/2005 | Ozick |
| 6,941,199 | B1 | 9/2005 | Bottomley et al. |
| 6,956,348 | B2 | 10/2005 | Landry et al. |
| 6,957,712 | B2 | 10/2005 | Song et al. |
| 6,960,986 | B2 | 11/2005 | Asama et al. |
| 6,965,209 | B2 | 11/2005 | Jones et al. |
| 6,965,211 | B2 | 11/2005 | Tsurumi |
| 6,968,592 | B2 | 11/2005 | Takeuchi et al. |
| 6,971,140 | B2 | 12/2005 | Kim |
| 6,975,246 | B1 | 12/2005 | Trudeau |
| 6,980,229 | B1 | 12/2005 | Ebersole |
| 6,985,556 | B2 | 1/2006 | Shanmugavel et al. |
| 6,993,954 | B1 | 2/2006 | George et al. |
| 6,999,850 | B2 | 2/2006 | McDonald |
| 7,013,527 | B2 | 3/2006 | Thomas et al. |
| 7,024,278 | B2 | 4/2006 | Chiappetta et al. |
| 7,024,280 | B2 | 4/2006 | Parker et al. |
| 7,027,893 | B2 | 4/2006 | Perry et al. |
| 7,030,768 | B2 | 4/2006 | Wanie |
| 7,031,805 | B2 | 4/2006 | Lee et al. |
| 7,032,469 | B2 | 4/2006 | Bailey |
| 7,040,869 | B2 | 5/2006 | Beenker |
| 7,041,029 | B2 | 5/2006 | Fulghum et al. |
| 7,051,399 | B2 | 5/2006 | Field et al. |
| 7,053,578 | B2 | 5/2006 | Diehl et al. |
| 7,054,716 | B2 | 5/2006 | McKee et al. |
| 7,055,210 | B2 | 6/2006 | Keppler et al. |
| 7,057,120 | B2 | 6/2006 | Ma et al. |
| 7,057,643 | B2 | 6/2006 | Iida et al. |
| 7,059,012 | B2 | 6/2006 | Song et al. |
| 7,065,430 | B2 | 6/2006 | Naka et al. |
| 7,066,291 | B2 | 6/2006 | Martins et al. |
| 7,069,124 | B1 | 6/2006 | Whittaker et al. |
| 7,079,923 | B2 | 7/2006 | Abramson et al. |
| 7,085,623 | B2 | 8/2006 | Siegers |
| 7,085,624 | B2 | 8/2006 | Aldred et al. |
| 7,113,847 | B2 | 9/2006 | Chmura et al. |
| 7,133,746 | B2 | 11/2006 | Abramson et al. |
| 7,142,198 | B2 | 11/2006 | Lee |
| 7,148,458 | B2 | 12/2006 | Schell et al. |
| 7,155,308 | B2 | 12/2006 | Jones |
| 7,167,775 | B2 | 1/2007 | Abramson et al. |
| 7,171,285 | B2 | 1/2007 | Kim et al. |
| 7,173,391 | B2 | 2/2007 | Jones et al. |
| 7,174,238 | B1 | 2/2007 | Zweig |
| 7,188,000 | B2 | 3/2007 | Chiappetta et al. |
| 7,193,384 | B1 | 3/2007 | Norman et al. |
| 7,196,487 | B2 | 3/2007 | Jones et al. |
| 7,201,786 | B2 | 4/2007 | Wegelin et al. |
| 7,206,677 | B2 | 4/2007 | Hulden |
| 7,211,980 | B1 | 5/2007 | Bruemmer et al. |
| 7,225,500 | B2 | 6/2007 | Diehl et al. |
| 7,246,405 | B2 | 7/2007 | Yan |
| 7,248,951 | B2 | 7/2007 | Hulden |
| 7,275,280 | B2 | 10/2007 | Haegermarck et al. |
| 7,283,892 | B1 | 10/2007 | Boillot et al. |
| 7,288,912 | B2 | 10/2007 | Landry et al. |
| 7,318,248 | B1 | 1/2008 | Yan |
| 7,320,149 | B1 | 1/2008 | Huffman et al. |
| 7,321,807 | B2 | 1/2008 | Laski |
| 7,324,870 | B2 | 1/2008 | Lee |
| 7,328,196 | B2 | 2/2008 | Peters |
| 7,332,890 | B2 | 2/2008 | Cohen et al. |
| 7,346,428 | B1 | 3/2008 | Huffman et al. |
| 7,352,153 | B2 | 4/2008 | Yan |
| 7,359,766 | B2 | 4/2008 | Jeon et al. |
| 7,360,277 | B2 | 4/2008 | Moshenrose et al. |
| 7,363,108 | B2 | 4/2008 | Noda et al. |
| 7,388,879 | B2 | 6/2008 | Sabe et al. |
| 7,389,156 | B2 | 6/2008 | Ziegler et al. |
| 7,389,166 | B2 | 6/2008 | Harwig et al. |
| 7,408,157 | B2 | 8/2008 | Yan |
| 7,418,762 | B2 | 9/2008 | Arai et al. |
| 7,430,455 | B2 | 9/2008 | Casey et al. |
| 7,430,462 | B2 | 9/2008 | Chiu et al. |
| 7,441,298 | B2 | 10/2008 | Svendsen et al. |
| 7,444,206 | B2 | 10/2008 | Abramson et al. |
| 7,448,113 | B2 | 11/2008 | Jones et al. |
| 7,459,871 | B2 | 12/2008 | Landry et al. |
| 7,467,026 | B2 | 12/2008 | Sakagami et al. |
| 7,474,941 | B2 | 1/2009 | Kim et al. |
| 7,503,096 | B2 | 3/2009 | Lin |
| 7,515,991 | B2 | 4/2009 | Egawa et al. |

(56) References Cited

U.S. PATENT DOCUMENTS 7,539,557 B2 5/2009 Yamauchi
7,555,363 B2 6/2009 Augenbraun et al.
7,557,703 B2 7/2009 Yamada et al.
7,568,259 B2 8/2009 Yan
7,571,511 B2 8/2009 Jones et al.
7,578,020 B2 8/2009 Jaworski et al.
7,600,521 B2 10/2009 Woo
7,603,744 B2 10/2009 Reindle
7,611,583 B2 11/2009 Buckley et al.
7,617,557 B2 11/2009 Reindle
7,620,476 B2 11/2009 Morse et al.
7,636,928 B2 12/2009 Uno
7,636,982 B2 12/2009 Jones et al.
7,647,144 B2 1/2010 Haegermarck
7,650,666 B2 1/2010 Jang
7,660,650 B2 2/2010 Kawagoe et al.
7,663,333 B2 2/2010 Jones et al.
7,693,605 B2 4/2010 Park
7,706,917 B1 4/2010 Chiappetta et al.
7,720,554 B2 5/2010 DiBernardo et al.
7,761,954 B2 7/2010 Ziegler et al.
7,765,635 B2 8/2010 Park
7,784,147 B2 8/2010 Burkholder et al.
7,801,645 B2 9/2010 Taylor et al.
7,805,220 B2 9/2010 Taylor et al.
7,809,944 B2 10/2010 Kawamoto
7,832,048 B2 11/2010 Harwig et al.
7,849,555 B2 12/2010 Hahm et al.
7,853,645 B2 12/2010 Brown et al.
7,860,680 B2 12/2010 Arms et al.
7,920,941 B2 4/2011 Park et al.
7,937,800 B2 5/2011 Yan
7,957,836 B2 6/2011 Myeong et al.
8,087,117 B2 1/2012 Kapoor et al.
8,763,199 B2 * 7/2014 Jones ..... A47L 5/30 15/319
2001/0004719 A1 6/2001 Sommer
2001/0013929 A1 8/2001 Torsten
2001/0020200 A1 9/2001 Das et al.
2001/0025183 A1 9/2001 Shahidi
2001/0037163 A1 11/2001 Allard
2001/0043509 A1 11/2001 Green et al.
2001/0045883 A1 11/2001 Holdaway et al.
2001/0047231 A1 11/2001 Peless et al.
2001/0047895 A1 12/2001 De Fazio et al.
2002/0011367 A1 1/2002 Kolesnik
2002/0011813 A1 1/2002 Koselka et al.
2002/0016649 A1 2/2002 Jones
2002/0021219 A1 2/2002 Edwards
2002/0027652 A1 3/2002 Paromtchik et al.
2002/0036779 A1 3/2002 Kiyoi et al.
2002/0081937 A1 6/2002 Yamada et al.
2002/0095239 A1 7/2002 Wallach et al.
2002/0097400 A1 7/2002 Jung et al.
2002/0104963 A1 8/2002 Mancevski
2002/0108209 A1 8/2002 Peterson
2002/0112742 A1 8/2002 Bredo et al.
2002/0113973 A1 8/2002 Ge
2002/0116089 A1 8/2002 Kirkpatrick
2002/0120364 A1 8/2002 Colens
2002/0124343 A1 9/2002 Reed
2002/0153185 A1 10/2002 Song et al.
2002/0156556 A1 10/2002 Ruffner
2002/0159051 A1 10/2002 Guo
2002/0166193 A1 11/2002 Kasper
2002/0169521 A1 11/2002 Goodman et al.
2002/0173877 A1 11/2002 Zweig
2002/0189871 A1 12/2002 Won
2003/0009259 A1 1/2003 Hattori et al.
2003/0015232 A1 1/2003 Nguyen
2003/0019071 A1 1/2003 Field et al.
2003/0023356 A1 1/2003 Keable
2003/0024986 A1 2/2003 Mazz et al.
2003/0025472 A1 2/2003 Jones et al.
2003/0028286 A1 2/2003 Glenn et al.
2003/0030399 A1 2/2003 Jacobs
2003/0058262 A1 3/2003 Sato et al.
2003/0060928 A1 3/2003 Abramson et al.
2003/0067451 A1 4/2003 Tagg et al.
2003/0097875 A1 5/2003 Lentz et al.
2003/0120389 A1 6/2003 Abramson et al.
2003/0124312 A1 7/2003 Autumn
2003/0126352 A1 7/2003 Barrett
2003/0137268 A1 7/2003 Papanikolopoulos et al.
2003/0146384 A1 8/2003 Logsdon et al.
2003/0159232 A1 8/2003 Hekman et al.
2003/0168081 A1 9/2003 Lee et al.
2003/0175138 A1 9/2003 Beenker
2003/0192144 A1 10/2003 Song et al.
2003/0193657 A1 10/2003 Uomori et al.
2003/0216834 A1 11/2003 Allard
2003/0221114 A1 11/2003 Hino et al.
2003/0229421 A1 12/2003 Chmura et al.
2003/0229474 A1 12/2003 Suzuki et al.
2003/0233171 A1 12/2003 Heiligensetzer
2003/0233177 A1 12/2003 Johnson et al.
2003/0233870 A1 12/2003 Mancevski
2003/0233930 A1 12/2003 Ozick
2004/0016077 A1 1/2004 Song et al.
2004/0020000 A1 2/2004 Jones
2004/0030448 A1 2/2004 Solomon
2004/0030449 A1 2/2004 Solomon
2004/0030450 A1 2/2004 Solomon
2004/0030451 A1 2/2004 Solomon
2004/0030570 A1 2/2004 Solomon
2004/0030571 A1 2/2004 Solomon
2004/0031113 A1 2/2004 Wosewick et al.
2004/0049877 A1 3/2004 Jones et al.
2004/0055163 A1 3/2004 McCambridge et al.
2004/0068351 A1 4/2004 Solomon
2004/0068415 A1 4/2004 Solomon
2004/0068416 A1 4/2004 Solomon
2004/0074038 A1 4/2004 Im et al.
2004/0074044 A1 4/2004 Diehl et al.
2004/0076324 A1 4/2004 Burl et al.
2004/0083570 A1 5/2004 Song et al.
2004/0085037 A1 5/2004 Jones et al.
2004/0088079 A1 5/2004 Lavarec et al.
2004/0093122 A1 5/2004 Galibraith
2004/0098167 A1 5/2004 Yi et al.
2004/0111184 A1 6/2004 Chiappetta et al.
2004/0111273 A1 6/2004 Sakagami et al.
2004/0111821 A1 6/2004 Lenkiewicz et al.
2004/0113777 A1 6/2004 Matsuhira et al.
2004/0117064 A1 6/2004 McDonald
2004/0117846 A1 6/2004 Karaoguz et al.
2004/0118998 A1 6/2004 Wingett et al.
2004/0128028 A1 7/2004 Miyamoto et al.
2004/0133316 A1 7/2004 Dean
2004/0134336 A1 7/2004 Solomon
2004/0134337 A1 7/2004 Solomon
2004/0143919 A1 7/2004 Wilder
2004/0148419 A1 7/2004 Chen et al.
2004/0148731 A1 8/2004 Damman et al.
2004/0153212 A1 8/2004 Profio et al.
2004/0156541 A1 8/2004 Jeon et al.
2004/0158357 A1 8/2004 Lee et al.
2004/0181706 A1 9/2004 Chen et al.
2004/0187249 A1 9/2004 Jones et al.
2004/0187457 A1 9/2004 Colens
2004/0196451 A1 10/2004 Aoyama
2004/0200505 A1 10/2004 Taylor et al.
2004/0201361 A1 10/2004 Koh et al.
2004/0204792 A1 10/2004 Taylor et al.
2004/0204804 A1 10/2004 Lee et al.
2004/0210345 A1 10/2004 Noda et al.
2004/0210347 A1 10/2004 Sawada et al.
2004/0211444 A1 10/2004 Taylor et al.
2004/0221790 A1 11/2004 Sinclair et al.
2004/0236468 A1 11/2004 Taylor et al.
2004/0244138 A1 12/2004 Taylor et al.
2004/0255425 A1 12/2004 Arai et al.
2005/0000543 A1 1/2005 Taylor et al.
2005/0010330 A1 1/2005 Abramson et al.

(56) References Cited

U.S. PATENT DOCUMENTS

2005/0010331 A1 1/2005 Taylor et al.
2005/0015913 A1 1/2005 Kim et al.
2005/0015920 A1 1/2005 Kim et al.
2005/0021181 A1 1/2005 Kim et al.
2005/0028316 A1 2/2005 Thomas et al.
2005/0053912 A1 3/2005 Roth et al.
2005/0055796 A1 3/2005 Wright et al.
2005/0067994 A1 3/2005 Jones et al.
2005/0081782 A1 4/2005 Buckley et al.
2005/0085947 A1 4/2005 Aldred et al.
2005/0091782 A1 5/2005 Gordon et al.
2005/0091786 A1 5/2005 Wright et al.
2005/0137749 A1 6/2005 Jeon et al.
2005/0144751 A1 7/2005 Kegg et al.
2005/0150074 A1 7/2005 Diehl et al.
2005/0150519 A1 7/2005 Keppler et al.
2005/0154795 A1 7/2005 Kuz et al.
2005/0156562 A1 7/2005 Cohen et al.
2005/0162119 A1 7/2005 Landry et al.
2005/0163119 A1 7/2005 Ito et al.
2005/0165508 A1 7/2005 Kanda et al.
2005/0166354 A1 8/2005 Uehigashi
2005/0166355 A1 8/2005 Tani
2005/0172445 A1 8/2005 Diehl et al.
2005/0183229 A1 8/2005 Uehigashi
2005/0183230 A1 8/2005 Uehigashi
2005/0187678 A1 8/2005 Myeong et al.
2005/0192707 A1 9/2005 Park et al.
2005/0204717 A1 9/2005 Colens
2005/0209736 A1 9/2005 Kawagoe
2005/0211880 A1 9/2005 Schell et al.
2005/0212929 A1 9/2005 Schell et al.
2005/0213082 A1 9/2005 DiBernardo et al.
2005/0213109 A1 9/2005 Schell et al.
2005/0217042 A1 10/2005 Reindle
2005/0218852 A1 10/2005 Landry et al.
2005/0222933 A1 10/2005 Wesby
2005/0229340 A1 10/2005 Sawalski et al.
2005/0229355 A1 10/2005 Crouch et al.
2005/0235451 A1 10/2005 Yan
2005/0251292 A1 11/2005 Casey et al.
2005/0255425 A1 11/2005 Pierson
2005/0258154 A1 11/2005 Blankenship et al.
2005/0273967 A1 12/2005 Taylor et al.
2005/0288819 A1 12/2005 De Guzman
2006/0000050 A1 1/2006 Cipolla et al.
2006/0009879 A1 1/2006 Lynch et al.
2006/0010638 A1 1/2006 Shimizu et al.
2006/0020369 A1 1/2006 Taylor et al.
2006/0020370 A1 1/2006 Abramson
2006/0021168 A1 2/2006 Nishikawa
2006/0025134 A1 2/2006 Cho et al.
2006/0037170 A1 2/2006 Shimizu
2006/0042042 A1 3/2006 Mertes et al.
2006/0044546 A1 3/2006 Lewin et al.
2006/0060216 A1 3/2006 Woo
2006/0061657 A1 3/2006 Rew et al.
2006/0064828 A1 3/2006 Stein et al.
2006/0087273 A1 4/2006 Ko et al.
2006/0089765 A1 4/2006 Pack et al.
2006/0100741 A1 5/2006 Jung
2006/0107894 A1 5/2006 Buckley et al.
2006/0119839 A1 6/2006 Bertin et al.
2006/0143295 A1 6/2006 Costa-Requena et al.
2006/0146776 A1 7/2006 Kim
2006/0150361 A1 7/2006 Aldred et al.
2006/0184293 A1 8/2006 Konandreas et al.
2006/0185690 A1 8/2006 Song et al.
2006/0190133 A1 8/2006 Konandreas et al.
2006/0190134 A1 8/2006 Ziegler et al.
2006/0190146 A1 8/2006 Morse et al.
2006/0196003 A1 9/2006 Song et al.
2006/0200281 A1 9/2006 Ziegler et al.
2006/0220900 A1 10/2006 Ceskutti et al.
2006/0229774 A1 10/2006 Park et al.
2006/0259194 A1 11/2006 Chiu
2006/0259494 A1 11/2006 Watson et al.
2006/0278161 A1 12/2006 Burkholder et al.
2006/0288519 A1 12/2006 Jaworski et al.
2006/0293787 A1 12/2006 Kanda et al.
2006/0293808 A1 12/2006 Qian
2007/0006404 A1 1/2007 Cheng et al.
2007/0016328 A1 1/2007 Ziegler et al.
2007/0017061 A1 1/2007 Yan
2007/0028574 A1 2/2007 Yan
2007/0032904 A1 2/2007 Kawagoe et al.
2007/0042716 A1 2/2007 Goodall et al.
2007/0043459 A1 2/2007 Abbott et al.
2007/0061041 A1 3/2007 Zweig
2007/0061043 A1 3/2007 Ermakov et al.
2007/0114975 A1 5/2007 Cohen et al.
2007/0142964 A1 6/2007 Abramson
2007/0150096 A1 6/2007 Yeh et al.
2007/0156286 A1 7/2007 Yamauchi
2007/0157415 A1 7/2007 Lee et al.
2007/0157420 A1 7/2007 Lee et al.
2007/0179670 A1 8/2007 Chiappetta et al.
2007/0213892 A1 9/2007 Jones et al.
2007/0226949 A1 10/2007 Hahm et al.
2007/0234492 A1 10/2007 Svendsen et al.
2007/0244610 A1 10/2007 Ozick et al.
2007/0245511 A1 10/2007 Hahm et al.
2007/0250212 A1 10/2007 Halloran et al.
2007/0261193 A1 11/2007 Gordon et al.
2007/0266508 A1 11/2007 Jones et al.
2008/0000042 A1 1/2008 Jones et al.
2008/0007203 A1 1/2008 Cohen et al.
2008/0015738 A1 1/2008 Casey et al.
2008/0039974 A1 2/2008 Sandin et al.
2008/0052846 A1 3/2008 Kapoor et al.
2008/0091304 A1 4/2008 Ozick et al.
2008/0109126 A1 5/2008 Sandin et al.
2008/0134458 A1 6/2008 Ziegler et al.
2008/0140255 A1 6/2008 Ziegler et al.
2008/0155768 A1 7/2008 Ziegler et al.
2008/0184518 A1 8/2008 Taylor et al.
2008/0266748 A1 10/2008 Lee
2008/0276407 A1 11/2008 Schnittman et al.
2008/0281470 A1 11/2008 Gilbert et al.
2008/0282494 A1 11/2008 Won et al.
2008/0294288 A1 11/2008 Yamauchi
2008/0302586 A1 12/2008 Yan
2008/0307590 A1 12/2008 Jones et al.
2009/0007366 A1 1/2009 Svendsen et al.
2009/0038089 A1 2/2009 Landry et al.
2009/0048727 A1 2/2009 Hong et al.
2009/0049640 A1 2/2009 Lee et al.
2009/0055022 A1 2/2009 Casey et al.
2009/0102296 A1 4/2009 Greene et al.
2009/0279222 A1 11/2009 Keller
2009/0292393 A1 11/2009 Casey et al.
2010/0006028 A1 1/2010 Buckley et al.
2010/0011529 A1 1/2010 Won et al.
2010/0049365 A1 2/2010 Jones et al.
2010/0063628 A1 3/2010 Landry et al.
2010/0082193 A1 4/2010 Chiappetta
2010/0107355 A1 5/2010 Won et al.
2010/0257690 A1 10/2010 Jones et al.
2010/0257691 A1 10/2010 Jones et al.
2010/0263158 A1 10/2010 Jones et al.
2010/0268384 A1 10/2010 Jones et al.
2010/0293742 A1 11/2010 Chung et al.
2010/0312429 A1 12/2010 Jones et al.
2011/0131741 A1 6/2011 Jones et al.

FOREIGN PATENT DOCUMENTS

DE 3317376 C2 12/1987
DE 3536907 C2 2/1989
DE 3404202 C2 12/1992
DE 199311014 U1 10/1993
DE 4338841 A1 5/1995
DE 4414683 A1 10/1995
DE 19849978 2/2001

(56) References Cited

FOREIGN PATENT DOCUMENTS

| | | | |
|---|---|---|---|
| DE | 10242257 | | 4/2003 |
| DE | 102004038074 | | 6/2005 |
| DE | 10357636 | | 7/2005 |
| DE | 102004041021 | B3 | 8/2005 |
| DE | 102005046813 | A1 | 4/2007 |
| DK | 338988 | A | 12/1988 |
| EP | 0265542 | A1 | 5/1988 |
| EP | 0281085 | A2 | 9/1988 |
| EP | 0286328 | A1 | 10/1988 |
| EP | 0294101 | A2 | 12/1988 |
| EP | 0307381 | | 3/1989 |
| EP | 0352045 | A2 | 1/1990 |
| EP | 0358628 | | 3/1990 |
| EP | 0389459 | | 9/1990 |
| EP | 0433697 | A2 | 6/1991 |
| EP | 0437024 | A1 | 7/1991 |
| EP | 0479273 | | 4/1992 |
| EP | 0554978 | A2 | 8/1993 |
| EP | 0114926 | | 8/1994 |
| EP | 0615719 | A1 | 9/1994 |
| EP | 0792726 | A1 | 9/1997 |
| EP | 0930040 | A2 | 7/1999 |
| EP | 0845237 | B1 | 4/2000 |
| EP | 0835459 | | 9/2001 |
| EP | 0861629 | B1 | 9/2001 |
| EP | 1172719 | | 1/2002 |
| EP | 1228734 | | 8/2002 |
| EP | 1149333 | | 11/2002 |
| EP | 1331537 | | 7/2003 |
| EP | 1139847 | | 8/2003 |
| EP | 1380245 | A1 | 1/2004 |
| EP | 1380246 | A2 | 1/2004 |
| EP | 1018315 | B1 | 11/2004 |
| EP | 1553472 | A1 | 7/2005 |
| EP | 1557730 | A1 | 7/2005 |
| EP | 1331537 | | 8/2005 |
| EP | 1642522 | A2 | 4/2006 |
| EP | 1672455 | | 6/2006 |
| EP | 1836941 | A2 | 9/2007 |
| ES | 2238196 | A1 | 8/2005 |
| FR | 722755 | | 3/1932 |
| FR | 2601443 | A1 | 1/1988 |
| FR | 2828589 | A1 | 2/2003 |
| GB | 702426 | | 1/1954 |
| GB | 2128842 | A | 5/1984 |
| GB | 2213047 | | 8/1989 |
| GB | 2225221 | A | 5/1990 |
| GB | 2267360 | A | 12/1993 |
| GB | 2283838 | A | 5/1995 |
| GB | 2284957 | A | 6/1995 |
| GB | 2300082 | A | 10/1996 |
| GB | 2344747 | A | 6/2000 |
| GB | 2404330 | A | 2/2005 |
| GB | 2409966 | | 7/2005 |
| GB | 2417354 | A | 2/2006 |
| JP | 53021869 | | 2/1978 |
| JP | 53110257 | A2 | 9/1978 |
| JP | 57014726 | | 1/1982 |
| JP | 57064217 | | 4/1982 |
| JP | 59005315 | | 1/1984 |
| JP | 59033511 | U | 3/1984 |
| JP | 59094005 | | 5/1984 |
| JP | 59099308 | | 6/1984 |
| JP | 59112311 | | 6/1984 |
| JP | 59120124 | A | 7/1984 |
| JP | 59131668 | U | 9/1984 |
| JP | 59164973 | | 9/1984 |
| JP | 59184917 | A | 10/1984 |
| JP | 2283343 | A2 | 11/1984 |
| JP | 59212924 | | 12/1984 |
| JP | 59226909 | | 12/1984 |
| JP | 60089213 | A | 5/1985 |
| JP | 60211510 | A | 10/1985 |
| JP | 60259895 | | 12/1985 |
| JP | 61023221 | | 1/1986 |
| JP | 61097712 | A | 5/1986 |
| JP | 61160366 | | 7/1986 |
| JP | 62070709 | | 4/1987 |
| JP | 62074018 | A | 4/1987 |
| JP | S62-100148 | | 5/1987 |
| JP | 62120510 | A | 6/1987 |
| JP | 60293095 | | 7/1987 |
| JP | 62154008 | | 7/1987 |
| JP | 62164431 | | 7/1987 |
| JP | 62263507 | A | 11/1987 |
| JP | 62263508 | A | 11/1987 |
| JP | 62189057 | U | 12/1987 |
| JP | 62292126 | | 12/1987 |
| JP | 63079623 | A | 4/1988 |
| JP | 63158032 | | 7/1988 |
| JP | 63183032 | | 7/1988 |
| JP | 63203483 | A | 8/1988 |
| JP | 63241610 | A | 10/1988 |
| JP | H01076750 | U | 5/1989 |
| JP | 1118752 | | 8/1989 |
| JP | 2-6312 | U | 1/1990 |
| JP | 2026312 | | 7/1990 |
| JP | H02249522 | A | 10/1990 |
| JP | 3051023 | A | 3/1991 |
| JP | 3112128 | | 5/1991 |
| JP | 4019586 | | 1/1992 |
| JP | 4074285 | A | 3/1992 |
| JP | 4084921 | A | 3/1992 |
| JP | H04-092635 | | 3/1992 |
| JP | 5023269 | A | 2/1993 |
| JP | 5042076 | A | 2/1993 |
| JP | 5046246 | | 2/1993 |
| JP | 5060049 | | 3/1993 |
| JP | 5084200 | | 4/1993 |
| JP | 5091604 | A | 4/1993 |
| JP | 5095879 | A | 4/1993 |
| JP | H05-502743 | | 5/1993 |
| JP | 5150827 | A | 6/1993 |
| JP | 5150829 | A | 6/1993 |
| JP | 5054620 | U | 7/1993 |
| JP | H05-228090 | | 9/1993 |
| JP | H05224745 | | 9/1993 |
| JP | H05224745 | A | 9/1993 |
| JP | 5040519 | Y2 | 10/1993 |
| JP | 05257527 | A | 10/1993 |
| JP | 5257533 | | 10/1993 |
| JP | 05285861 | A | 11/1993 |
| JP | 5302836 | A | 11/1993 |
| JP | 5312514 | A | 11/1993 |
| JP | 05046239 | Y2 | 12/1993 |
| JP | 5341904 | A | 12/1993 |
| JP | 6003251 | U | 1/1994 |
| JP | 6026312 | | 2/1994 |
| JP | 6038912 | | 2/1994 |
| JP | H06-030859 | | 2/1994 |
| JP | 6105781 | A | 4/1994 |
| JP | 6137828 | A | 5/1994 |
| JP | 6154143 | A | 6/1994 |
| JP | H06189877 | A | 7/1994 |
| JP | 6-125861 | | 10/1994 |
| JP | 6293095 | A | 10/1994 |
| JP | 06327 598 | A | 11/1994 |
| JP | 7047046 | A | 2/1995 |
| JP | 07129239 | A | 5/1995 |
| JP | H07129242 | A | 5/1995 |
| JP | 7059702 | B | 6/1995 |
| JP | 07222705 | A2 | 8/1995 |
| JP | H07-241268 | | 9/1995 |
| JP | 7270518 | A | 10/1995 |
| JP | 7281742 | | 10/1995 |
| JP | 7281752 | | 10/1995 |
| JP | 7295636 | | 11/1995 |
| JP | 7295638 | | 11/1995 |
| JP | 7311041 | | 11/1995 |
| JP | 7-032752 | | 12/1995 |
| JP | 7313417 | A | 12/1995 |
| JP | 7319542 | | 12/1995 |
| JP | 7334242 | | 12/1995 |
| JP | 8000393 | A | 1/1996 |

(56) References Cited

FOREIGN PATENT DOCUMENTS

| | | | |
|---|---|---|---|
| JP | 8016241 | | 1/1996 |
| JP | 8016776 | A | 1/1996 |
| JP | H08000517 | A | 1/1996 |
| JP | 8063229 | | 3/1996 |
| JP | 8083125 | | 3/1996 |
| JP | 8084696 | A | 4/1996 |
| JP | 8089449 | A | 4/1996 |
| JP | 08089451 | A | 4/1996 |
| JP | 2520732 | | 5/1996 |
| JP | 8123548 | A | 5/1996 |
| JP | 8152916 | A | 6/1996 |
| JP | 8256960 | | 10/1996 |
| JP | 8263137 | A | 10/1996 |
| JP | 8286741 | | 11/1996 |
| JP | 8286744 | | 11/1996 |
| JP | 8286745 | | 11/1996 |
| JP | 8286747 | | 11/1996 |
| JP | 8322774 | | 12/1996 |
| JP | 8335112 | A | 12/1996 |
| JP | 8339297 | A | 12/1996 |
| JP | 943901 | | 2/1997 |
| JP | 9043901 | | 2/1997 |
| JP | 9044240 | A | 2/1997 |
| JP | 9047413 | | 2/1997 |
| JP | 9066855 | A | 3/1997 |
| JP | 9145309 | A | 6/1997 |
| JP | 09160644 | A | 6/1997 |
| JP | 7338573 | | 7/1997 |
| JP | 09179625 | A | 7/1997 |
| JP | 9179685 | | 7/1997 |
| JP | 09185410 | | 7/1997 |
| JP | 9192069 | A | 7/1997 |
| JP | 2555263 | Y2 | 8/1997 |
| JP | 9204223 | A | 8/1997 |
| JP | 9204224 | | 8/1997 |
| JP | 09206258 | A | 8/1997 |
| JP | 9-248261 | | 9/1997 |
| JP | 09233712 | A | 9/1997 |
| JP | 09251318 | | 9/1997 |
| JP | 9265319 | A | 10/1997 |
| JP | 9269807 | A | 10/1997 |
| JP | 9269810 | A | 10/1997 |
| JP | 9269824 | | 10/1997 |
| JP | H09-286337 | | 11/1997 |
| JP | 9319431 | A1 | 12/1997 |
| JP | 9319432 | A | 12/1997 |
| JP | 9319434 | A | 12/1997 |
| JP | 9325812 | A | 12/1997 |
| JP | 10027020 | | 1/1998 |
| JP | 10055215 | A | 2/1998 |
| JP | 10502274 | | 3/1998 |
| JP | 10105233 | | 4/1998 |
| JP | 10117973 | A | 5/1998 |
| JP | 10118963 | A | 5/1998 |
| JP | 10165738 | A | 6/1998 |
| JP | 10177414 | A | 6/1998 |
| JP | 3375843 | | 8/1998 |
| JP | 10214114 | | 8/1998 |
| JP | 10228316 | | 8/1998 |
| JP | 10240342 | | 9/1998 |
| JP | 10260727 | | 9/1998 |
| JP | 10295595 | A | 11/1998 |
| JP | 10314088 | | 12/1998 |
| JP | 11015941 | A | 1/1999 |
| JP | 11065655 | | 3/1999 |
| JP | 11065657 | | 3/1999 |
| JP | 11085269 | | 3/1999 |
| JP | 11102219 | | 4/1999 |
| JP | 11102220 | A | 4/1999 |
| JP | 9928800 | | 6/1999 |
| JP | 11162454 | A | 6/1999 |
| JP | 11174145 | A | 7/1999 |
| JP | 11175149 | A | 7/1999 |
| JP | 11178765 | A | 7/1999 |
| JP | 114008764 | A | 7/1999 |
| JP | 11212642 | A | 8/1999 |
| JP | 11213157 | A | 8/1999 |
| JP | 11508810 | | 8/1999 |
| JP | 11248806 | | 9/1999 |
| JP | 11510935 | | 9/1999 |
| JP | 11282532 | A | 10/1999 |
| JP | 11282533 | A | 10/1999 |
| JP | 11295412 | A | 10/1999 |
| JP | 9959042 | | 11/1999 |
| JP | 11346964 | | 12/1999 |
| JP | 2000047728 | | 2/2000 |
| JP | 2000056006 | A | 2/2000 |
| JP | 2000056831 | A | 2/2000 |
| JP | 2000060782 | A | 2/2000 |
| JP | 2000066722 | A | 3/2000 |
| JP | 2000075925 | A | 3/2000 |
| JP | 2000102499 | A | 4/2000 |
| JP | 10240343 | | 5/2000 |
| JP | 2000275321 | | 10/2000 |
| JP | 2000279353 | A | 10/2000 |
| JP | 2000-342497 | | 12/2000 |
| JP | 2000353014 | A | 12/2000 |
| JP | 2001022443 | A | 1/2001 |
| JP | 2001067588 | | 3/2001 |
| JP | 2001087182 | | 4/2001 |
| JP | 2001121455 | | 5/2001 |
| JP | 2001125641 | | 5/2001 |
| JP | 2001508572 | A | 6/2001 |
| JP | 2001197008 | A | 7/2001 |
| JP | 3197758 | B2 | 8/2001 |
| JP | 3201903 | B2 | 8/2001 |
| JP | 2001216482 | A | 8/2001 |
| JP | 2001258807 | | 9/2001 |
| JP | 2001265437 | A | 9/2001 |
| JP | 2001275908 | A | 10/2001 |
| JP | 2001289939 | | 10/2001 |
| JP | 2001306170 | A | 11/2001 |
| JP | 2001320781 | | 11/2001 |
| JP | 2003052596 | | 2/2002 |
| JP | 2002073170 | A | 3/2002 |
| JP | 2002078650 | A | 3/2002 |
| JP | 2002204768 | A | 7/2002 |
| JP | 2002204769 | A | 7/2002 |
| JP | 2002247510 | A | 8/2002 |
| JP | 2002532180 | A | 10/2002 |
| JP | 2002533797 | | 10/2002 |
| JP | 2002320935 | A | 11/2002 |
| JP | 2002323925 | | 11/2002 |
| JP | 2002333920 | A | 11/2002 |
| JP | 2002355206 | | 12/2002 |
| JP | 2002360471 | A | 12/2002 |
| JP | 2002360479 | | 12/2002 |
| JP | 2002360482 | A | 12/2002 |
| JP | 2002366227 | | 12/2002 |
| JP | 2002366228 | A | 12/2002 |
| JP | 2002369778 | | 12/2002 |
| JP | 2003005296 | A | 1/2003 |
| JP | 2003010076 | A | 1/2003 |
| JP | 2003010088 | A | 1/2003 |
| JP | 2003015740 | | 1/2003 |
| JP | 2003028528 | A | 1/2003 |
| JP | 2003033310 | | 2/2003 |
| JP | 2003036116 | A | 2/2003 |
| JP | 2003038401 | A | 2/2003 |
| JP | 2003038402 | A | 2/2003 |
| JP | 2003047579 | | 2/2003 |
| JP | 2003505127 | | 2/2003 |
| JP | 2003061882 | A | 3/2003 |
| JP | 2003084994 | | 3/2003 |
| JP | 2003167628 | A | 6/2003 |
| JP | 2003180586 | A | 7/2003 |
| JP | 2003180587 | A | 7/2003 |
| JP | 2003186539 | A | 7/2003 |
| JP | 2003190064 | A | 7/2003 |
| JP | 2003241836 | A | 8/2003 |
| JP | 2003262520 | A | 9/2003 |
| JP | 2003285288 | | 10/2003 |
| JP | 2003304992 | A | 10/2003 |
| JP | 2003310489 | | 11/2003 |

(56) References Cited

FOREIGN PATENT DOCUMENTS

| | | | |
|---|---|---|---|
| JP | 2003310509 | A | 11/2003 |
| JP | 2003330543 | A | 11/2003 |
| JP | 2004006134 | | 1/2004 |
| JP | 2004123040 | A | 4/2004 |
| JP | 2004148021 | A | 5/2004 |
| JP | 2004160102 | A | 6/2004 |
| JP | 2004166968 | A | 6/2004 |
| JP | 2004174228 | | 6/2004 |
| JP | 2004198330 | A | 7/2004 |
| JP | 2004219185 | | 8/2004 |
| JP | 2004351234 | A | 12/2004 |
| JP | 2005118354 | A | 5/2005 |
| JP | 2005135400 | | 5/2005 |
| JP | 2005211360 | A | 8/2005 |
| JP | 2005224265 | A | 8/2005 |
| JP | 2005230032 | A | 9/2005 |
| JP | 2005245916 | A | 9/2005 |
| JP | 2005296511 | | 10/2005 |
| JP | 2005346700 | | 12/2005 |
| JP | 2005352707 | A | 12/2005 |
| JP | 2006043071 | A | 2/2006 |
| JP | 2006079145 | | 3/2006 |
| JP | 2006079157 | | 3/2006 |
| JP | 2006155274 | A | 6/2006 |
| JP | 2006164223 | A | 6/2006 |
| JP | 2006227673 | A | 8/2006 |
| JP | 2006247467 | A | 9/2006 |
| JP | 2006260161 | A | 9/2006 |
| JP | 2006293662 | A | 10/2006 |
| JP | 2006296697 | A | 11/2006 |
| JP | 2007034866 | A | 2/2007 |
| JP | 2007213180 | A | 8/2007 |
| JP | 2009015611 | A | 1/2009 |
| JP | 4300516 | | 7/2009 |
| JP | 2010198552 | A | 9/2010 |
| JP | 2002532178 | | 10/2016 |
| JP | 3356170 | | 12/2016 |
| JP | 2001525567 | | 12/2016 |
| WO | 9526512 | A1 | 10/1995 |
| WO | 9530887 | A1 | 11/1995 |
| WO | 9617258 | A1 | 6/1996 |
| WO | 9715224 | A1 | 5/1997 |
| WO | 9740734 | A1 | 11/1997 |
| WO | 9741451 | A1 | 11/1997 |
| WO | 9853456 | A1 | 11/1998 |
| WO | 9905580 | A2 | 2/1999 |
| WO | 9916078 | A1 | 4/1999 |
| WO | 9938056 | A1 | 7/1999 |
| WO | 9938237 | A1 | 7/1999 |
| WO | 9943250 | A1 | 9/1999 |
| WO | 0036962 | | 6/2000 |
| WO | 0038026 | A1 | 6/2000 |
| WO | 0038028 | A1 | 6/2000 |
| WO | 0038029 | A1 | 6/2000 |
| WO | 0004430 | A1 | 10/2000 |
| WO | 0073867 | | 12/2000 |
| WO | 0078410 | A1 | 12/2000 |
| WO | 0106904 | A1 | 2/2001 |
| WO | 0106905 | A1 | 2/2001 |
| WO | 0180703 | A1 | 11/2001 |
| WO | 0191623 | A2 | 12/2001 |
| WO | 0207744 | | 1/2002 |
| WO | 0207745 | | 1/2002 |
| WO | 0224292 | A1 | 3/2002 |
| WO | 0239864 | A1 | 5/2002 |
| WO | 0239868 | A1 | 5/2002 |
| WO | 02058527 | A1 | 8/2002 |
| WO | 02062194 | A1 | 8/2002 |
| WO | 02067744 | A1 | 9/2002 |
| WO | 02067745 | A1 | 9/2002 |
| WO | 02067752 | A1 | 9/2002 |
| WO | 02069774 | A1 | 9/2002 |
| WO | 02069775 | A2 | 9/2002 |
| WO | 02071175 | A1 | 9/2002 |
| WO | 02074150 | A1 | 9/2002 |
| WO | 02075356 | A1 | 9/2002 |
| WO | 02075469 | A1 | 9/2002 |
| WO | 02075470 | A1 | 9/2002 |
| WO | 02081074 | A1 | 10/2002 |
| WO | 02101477 | A2 | 12/2002 |
| WO | 03015220 | A1 | 2/2003 |
| WO | 03024292 | A2 | 3/2003 |
| WO | 03026474 | | 4/2003 |
| WO | 03040546 | A1 | 5/2003 |
| WO | 03040645 | | 5/2003 |
| WO | 03040845 | A1 | 5/2003 |
| WO | 03040846 | A1 | 5/2003 |
| WO | 03062850 | A2 | 7/2003 |
| WO | 03062852 | A1 | 7/2003 |
| WO | 2004004533 | A1 | 1/2004 |
| WO | 2004004534 | A1 | 1/2004 |
| WO | 2004005956 | | 1/2004 |
| WO | 2004006034 | A2 | 1/2004 |
| WO | 2004025947 | A2 | 3/2004 |
| WO | 2004043215 | | 5/2004 |
| WO | 2004058028 | A2 | 7/2004 |
| WO | 2004059409 | A1 | 7/2004 |
| WO | 2005006935 | A1 | 1/2005 |
| WO | 2005036292 | | 4/2005 |
| WO | 2005037496 | A1 | 4/2005 |
| WO | 2005055795 | A1 | 6/2005 |
| WO | 2005055796 | A2 | 6/2005 |
| WO | 2005076545 | A1 | 8/2005 |
| WO | 2005077243 | A1 | 8/2005 |
| WO | 2005077244 | A1 | 8/2005 |
| WO | 2005081074 | A1 | 9/2005 |
| WO | 2005082223 | | 9/2005 |
| WO | 2005083541 | A1 | 9/2005 |
| WO | 2005098475 | A1 | 10/2005 |
| WO | 2005098476 | A1 | 10/2005 |
| WO | 2006046400 | A1 | 5/2006 |
| WO | 2006061133 | A1 | 6/2006 |
| WO | 2006068403 | A1 | 6/2006 |
| WO | 2006073248 | A1 | 7/2006 |
| WO | 2006089307 | A2 | 8/2006 |
| WO | 2007028049 | A2 | 3/2007 |
| WO | 2007036490 | A2 | 4/2007 |
| WO | 2007065033 | A2 | 6/2007 |
| WO | 2007137234 | A2 | 11/2007 |
| WO | 2002075350 | A1 | 1/2012 |

OTHER PUBLICATIONS

Ascii, Mar. 25, 2002, http://ascii.jp/elem/000/000/330/330024/, accessed Nov. 2011, 15 pages (with English translation).

Barker, "Navigation by the Stars—Ben Barker 4th Year Project," Nov. 2004, 20 pages.

Becker et al., "Reliable Navigation Using Landmarks," IEEE International Conference on Robotics and Automation, 0-7803-1965-6, pp. 401-406, 1995.

Benayad-Cherif et al., "Mobile Robot Navigation Sensors," SPIE vol. 1831 Mobile Robots, VII, pp. 378-387, 1992.

Betke et al. "Mobile robot localization using landmarks," Proceedings of the IEEE/RSJ/GI International Conference on Intelligent Robots and Systems '94 Advanced Robotic Systems and the Real World (IROS '94), Accessed via IEEE Xplore, 1994, 8 pages.

Bison et al., "Using a structured beacon for cooperative position estimation," *Robotics and Autonomous Systems*, 29(1):33-40, Oct. 1999.

Blaasvaer et al., "AMOR—An Autonomous Mobile Robot Navigation System," Proceedings of the IEEE International Conference on Systems, Man, and Cybernetics, pp. 2266-2271, 1994.

Borges et al., "Optimal Mobile Robot Pose Estimation Using Geometrical Maps," IEEE Transactions on Robotics and Automation, 18(1): 87-94, Feb. 2002.

Braunstingl et al., "Fuzzy Logic Wall Following of a Mobile Robot Based on the Concept of General Perception," ICAR '95, 7th International Conference on Advanced Robotics, Sant Feliu De Guixols, Spain, pp. 367-376, Sep. 1995.

Bulusu et al., "Self Configuring Localization systems: Design and Experimental Evaluation,"*ACM Transactions on Embedded Computing Systems*, 3(1):24-60, 2003.

(56) References Cited

OTHER PUBLICATIONS

Caccia et al., "Bottom-Following for Remotely Operated Vehicles,"5th IFAC Conference, Alaborg, Denmark, pp. 245-250, Aug. 2000.
U.S. Appl. No. 60/605,066 as provided to WIPO in PCT/US2005/030422, corresponding to U.S. Appl. No. 11/574,290, U.S.publication 2008/0184518, filed Aug. 27, 2004.
U.S. Appl. No. 60/605,181 as provided to WIPO in PCT/US2005/030422, corresponding to U.S. Appl. No. 11/574,290, U.S.publication 2008/0184518, filed Aug. 27, 2004.
Chae et al., "StarLITE: A new artificial landmark for the navigation of mobile robots," http://www.irc.atr.jp/jk-nrs2005/pdf/Starlite.pdf, 4 pages, 2005.
Chamberlin et al., "Team 1: Robot Locator Beacon System," NASA Goddard SFC, Design Proposal, 15 pages, Feb. 2006.
Champy, "Physical management of IT assets in Data Centers using RFID technologies," RFID 2005 University, Oct. 12-14, 2005, 19 pages.
Chin, "Joystick Control for Tiny OS Robot," http://www.eecs.berkeley.edu/Programs/ugrad/superb/papers2002/chiri.pdf. 12 pages, Aug. 2002.
Christensen et al. "Theoretical Methods for Planning and Control in Mobile Robotics," 1997 First International Conference on Knowledge-Based Intelligent Electronic Systems, Adelaide, Australia, pp. 81-86, May 1997.
CleanMate 365, Intelligent Automatic Vacuum Cleaner, Model No. QQ-1, User Manual www.metapo.com/support/user_manual.pdf, Dec. 2005, 11 pages.
Clerentin et al., "A localization method based on two omnidirectional perception systems cooperation," *Proc of IEEE International Conference on Robotics & Automation*, San Francisco, CA vol. 2, pp. 1219-1224, Apr. 2000.
Corke, "High Performance Visual serving for robots end-point control," SPIE vol. 2056, Intelligent Robots and Computer Vision, 1993, 10 pages.
Cozman et al., "Robot Localization using a Computer Vision Sextant," IEEE International Midwest Conference on Robotics and Automation, pp. 106-111, 1995.
D'Orazio et al., "Model based Vision System for mobile robot position estimation", *SPIE*, vol. 2058 Mobile Robots VIII, pp. 38-49, 1992.
De Bakker et al., "Smart PSD-array for sheet of light range imaging", Proc. of *SPIE*, vol. 3965, pp. 1-12, May 2000.
Denning Roboscrub image (1989), 1 page.
Desaulniers et al., "An Efficient Algorithm to find a shortest path for a car-like Robot," *IEEE Transactions on robotics and Automation*, 11(6):819-828, Dec. 1995.
Dorfmüller-Ulhaas, "Optical Tracking From User Motion to 3D Interaction," http://www.cg.tuwien.ac.at/research/publications/2002/Dorfmueller-Ulhaas-thesis, 182 pages, 2002.
Dorsch et al., "Laser Triangulation: Fundamental uncertainty in distance measurement," *Applied Optics*, 33(7):1306-1314, Mar. 1994.
Doty et al., "Sweep Strategies for a Sensory-Driven, Behavior-Based Vacuum Cleaning Agent," AAAI 1993 Fall Symposium Series, Instantiating Real-World Agents, pp. 1-6, Oct. 22-24, 1993.
Dudek et al., "Localizing a Robot with Minimum Travel" *Proceedings of the sixth annual ACM-SIAM symposium on Discrete Algorithms*, 27(2):583-604, Apr. 1998.
Dulimarta et al., "Mobile Robot Localization in Indoor Environment", *Pattern Recognition*, 30(1):99-111, 1997.
Dyson's Robot Vacuum Cleaner—the DC06, May 2004, Retrieved from the Internet: URL<http://www.gizmag.com/go/1282/>. Accessed Nov. 2011, 3 pages.
EBay, "Roomba Timer -> Timed Cleaning—Floorvac Robotic Vacuum," Retrieved from the Internet: URL Cgi.ebay.com/ws/eBayISAPI.dll?viewitem&category=43526&item=4375198387 &rd=1, 5 pages, Apr. 2005.
Electrolux Trilobite, "Time to enjoy life," Retrieved from the Internet: URL<http://www.robocon.co.kr/trilobite/Presentation_Trilobite_Kor_030104.ppt, 26 pages, accessed Dec. 2011.
Electrolux Trilobite, Jan. 12, 2001, http://www.electroluxui.com:8080/2002%5C822%5C833102EN.pdf, accessed Jul. 2, 2012, 10 pages.
Electrolux, "Designed for the well-lived home," Retrieved from the Internet: URL<http://www.electroluxusa.com/node57.as[?currentURL=nodel42.asp%3F >. Accessed Mar. 2005, 2 pages.
Eren et al., "Accuracy in position estimation of mobile robots based on coded infrared signal transmission," Proceedings: Integrating Intelligent Instrumentation and Control, Instrumentation and Measurement Technology Conference, 1995, IMTC/95. pp. 548-551, 1995.
Eren et al., "Operation of Mobile Robots in a Structured Infrared Environment," Proceedings 'Sensing, Processing, Networking', IEEE Instrumentation and Measurement Technology Conference, 1997 (IMTC/97), Ottawa, Canada vol. 1, pp. 20-25, May 1997.
Euroflex Intelligente Monstre, (English excerpt only), 2006, 15 pages.
Euroflex, Jan. 2006, Retrieved from the Internet: URL<http://www.euroflex.tv/novita_dett.php?id=15, accessed Nov. 2011, 1 page.
EVac Robotic Vacuum S1727 Instruction Manual, Sharper Image Corp, Copyright 2004, 16 pages.
Everyday Robots, "Everyday Robots: Reviews, Discussion and News for Consumers," Aug. 2004, Retrieved from the Internet: URL<www.everydayrobots.com/index.php?option=content &task=view&id=9> (Sep. 2012), 4 pages.
Evolution Robotics, "NorthStar—Low-cost Indoor Localiztion—How it Works," E Evolution Robotics , 2 pages, 2005.
Facchinetti Claudio et al., "Self-Positioning Robot Navigation Using Ceiling Images Sequences," ACCV '95, 5 pages, Dec. 1995.
Facchinetti Claudio et al., "Using and Learning Vision-Based Self-Positioning for Autonomous Robot Navigation," ICARCV '94, vol. 3, pp. 1694-1698, 1994.
Facts on Trilobite, webpage, Retrieved from the Internet: URL<http://trilobiteelectroluxse/presskit_en/ model11335asp?print=yes&pressID=>. 2 pages, accessed Dec. 2003.
Fairfield et al., "Mobile Robot Localization with Sparse Landmarks," SPIE vol. 4573, pp. 148-155, 2002.
Favre-Bulle, "Efficient tracking of 3D—Robot Position by Dynamic Triangulation," IEEE Instrumentation and Measurement Technology Conference IMTC 98 Session on Instrumentation and Measurement in Robotics, vol. 1, pp. 446-449, May 1998.
Fayman, "Exploiting Process Integration and Composition in the context of Active Vision," IEEE Transactions on Systems, Man, and Cybernetics—Part C: Application and reviews, vol. 29, No. 1, pp. 73-86, Feb. 1999.
Floorbot GE Plastics—Image, available at http://www.fuseid.com/, 1989-1990, Accessed Sep. 2012, 1 page.
Floorbotics, VR8 Floor Cleaning Robot, Product Description for Manufacturing, URL: <http://www.consensus.sem.au/SoftwareAwards/CSAarchive/CSA2004/CSAart04/FloorBot/F>. Mar. 2004, 11 pages.
Franz et al., "Biomimetric robot navigation", Robotics and Autonomous Systems, vol. 30 pp. 133-153, 2000.
Friendly Robotics, "Friendly Robotics—Friendly Vac, Robotic Vacuum Cleaner," Retrieved from the Internet: URL< www.friendlyrobotics.com/vac.htm > 5 pages, Apr. 2005.
Friendly Robotics, Retrieved from the Internet: URL<http://www.robotsandrelax.com/PDFs/RV400Manual.pdf>. 18 pages, accessed Dec. 2011.
Fuentes et al., "Mobile Robotics 1994," University of Rochester. Computer Science Department, TR 588, 44 pages, Dec. 1994.
Fukuda et al., "Navigation System based on Ceiling Landmark Recognition for Autonomous mobile robot," 1995 IEEE/RSJ International Conference on Intelligent Robots and Systems 95. 'Human Robot Interaction and Cooperative Robots', Pittsburgh, PA, pp. 1466/1471, Aug. 1995.

(56) References Cited

OTHER PUBLICATIONS

Gat, "Robust Low-Computation Sensor-driven Control for Task-Directed Navigation," Proc of IEEE International Conference on Robotics and Automation, Sacramento, CA pp. 2484-2489, Apr. 1991.
Gionis, "A hand-held optical surface scanner for environmental Modeling and Virtual Reality," Virtual Reality World, 16 pages, 1996.
Goncalves et al., "A Visual Front-End for Simultaneous Localization and Mapping", Proceedings of the 2005 IEEE International Conference on Robotics and Automation, Barcelona, Spain, pp. 44-49, Apr. 2005.
Gregg et al., "Autonomous Lawn Care Applications," 2006 Florida Conference on Recent Advances in Robotics, Miami, Florida, May 25-26, 2006, Florida International University, 5 pages.
Grumet, "Robots Clean House," Popular Mechanics, Nov. 2003, 3 pages.
Hamamatsu "SI PIN Diode S5980, S5981 S5870—Multi-element photodiodes for surface mounting," Hamatsu Photonics, 2 pages, Apr. 2004.
Hammacher Schlemmer , "Electrolux Trilobite Robotic Vacuum," Retrieved from the Internet: URL< www.hammacher.com/publish/71579.asp?promo=xsells>. 3 pages, Mar. 2005.
Haralick et al. "Pose Estimation from Corresponding Point Data", *IEEE Transactions on Systems, Man, and Cybernetics*, 19(6):1426-1446, Nov. 1989.
Hausler, "About the Scaling Behaviour of Optical Range Sensors," Fringe '97, Proceedings of the 3rd International Workshop on Automatic Processing of Fringe Patterns, Bremen, Germany, pp. 147-155, Sep. 1997.
Hitachi, http://www.hitachi.co.jp/New/cnews/hi_030529_hi_030529.pdf, 8 pages, May 29, 2003.
Hitachi: News release: "The home cleaning robot of the autonomous movement type (experimental machine)," Retrieved from the Internet: URL< www.i4u.com./japanreleases/hitachirobot.htm>. 5 pages, Mar. 2005.
Hoag et al., "Navigation and Guidance in interstellar space," ACTA Astronautica, vol. 2, pp. 513-533 , Feb. 1975.
Home Robot—UBOT; Microbotusa.com, retrieved from the WWW at www.microrobotusa.com, accessed Dec. 2, 2008, 2 pages.
Huntsberger et al., "CAMPOUT: A Control Architecture for Tightly Coupled Coordination of Multirobot Systems for Planetary Surface Exploration," *IEEE Transactions on Systems, Man, and Cybernetics—Part A: Systems and Humans*, 33(5):550-559, Sep. 2003.
Iirobotics.com, "Samsung Unveils Its Multifunction Robot Vacuum," Retrieved from the Internet: URL<.www.iirobotics.com/webpages/hotstuff.php?ubre=111>. 3 pages, Mar. 2005.
InMach "Intelligent Machines," Retrieved from the Internet: URL<www.inmach.de/inside.html>. 1 page , Nov. 2008.
Innovation First, "2004 EDU Robot Controller Reference Guide," Retrieved from the Internet: URL<http://www.ifirobotics.com>. 13 pages, Mar. 2004.
IT media, Retrieved from the Internet: URL<http://www.itmedia.co.jp/news/0111/16/robofesta_m.html>. Accessed Nov. 1, 2011, 4 pages.
It's eye, Retrieved from the Internet: URL< www.hitachi.co.jp/rd/pdf/topics/hitac2003_10.pdf>. 2 pages, 2003.
Jarosiewicz et al., "Final Report—Lucid," University of Florida, Departmetn of Electrical and Computer Engineering, EEL 5666—Intelligent Machine Design Laboratory, 50 pages, Aug. 1999.
Jensfelt et al., "Active Global Localization for a mobile robot using multiple hypothesis tracking," *IEEE Transactions on Robots and Automation*, 17(5): 748-760, Oct. 2001.
Jeong et al., "An intelligent map-building system for indoor mobile robot using low cost photo sensors,"*SPIE*, vol. 6042, 6 pages, 2005.
Kahney, "Robot Vacs are in the House," Retrieved from the Internet: URL<www.wired.com/news/technology/o,1282,59237,00.html>. 6 pages, Jun. 2003.
Karcher "Karcher RoboCleaner RC 3000," Retrieved from the Internet: URL<www.robocleaner.de/english/screen3.html>. 4 pages, Dec. 2003.
Karcher RC 3000 Cleaning Robot-user manual Manufacturer: Alfred-Karcher GmbH & Co, Cleaning Systems, Alfred Karcher-Str 28-40, PO Box 160, D-71349 Winnenden, Germany, Dec. 2002, 8 pages.
Karcher RC3000 RoboCleaner,—IMAGE, Accessed at <http://www.karcher.de/versions/int/assets/video/2_4_robo_en.swf>. Accessed Sep. 2009, 1 page.
Karcher USA, RC3000 Robotic Cleaner, website: http://www.karcher-usa.com/showproducts.php?op=view prod&paraml=143&param2=&param3=, 3 pages, accessed Mar. 2005.
Karcher, "Product Manual Download Karch", available at www.karcher.com, 16 pages, 2004.
Karlsson et al, "Core Technologies for service Robotics," IEEE/RSJ International Conference on Intelligent Robots and Systems (IROS 2004), vol. 3, pp. 2979-2984, Sep. 2004.
Karlsson et al., The vSLAM Algorithm for Robust Localization and Mapping, Proceedings of the 2005 IEEE International Conference on Robotics and Automation, Barcelona, Spain, pp. 24-29, Apr. 2005.
King and Weiman, "HelpmateTM Autonomous Mobile Robots Navigation Systems," SPIE vol. 1388 Mobile Robots, pp. 190-198, 1990.
Kleinberg, The Localization Problem for Mobile Robots, Laboratory for Computer Science, Massachusetts Institute of Technology, 1994 IEEE, pp. 521-531, 1994.
Knights, et al., "Localization and Identification of Visual Landmarks," *Journal of Computing Sciences in Colleges*, 16(4):312-313, May 2001.
Kolodko et al., "Experimental System for Real-Time Motion Estimation," Proceedings of the 2003 IEEE/ASME International Conference on Advanced Intelligent Mechatronics (AIM 2003), pp. 981-986, 2003.
Komoriya et al., "Planning of Landmark Measurement for the Navigation of a Mobile Robot," Proceedings of the 1992 IEEE/RSJ International Cofnerence on Intelligent Robots and Systems, Raleigh, NC pp. 1476-1481, Jul. 1992.
KOOLVAC Robotic Vacuum Cleaner Owner's Manual, Koolatron, 2004, 13 pages.
Krotkov et al., "Digital Sextant," Downloaded from the internet at: http://www.cs.cmu.edu/~epk/ , 1 page, 1995.
Krupa et al., "Autonomous 3-D Positioning of Surgical Instruments in Robotized Laparoscopic Surgery Using Visual Servoin," *IEEE Transactions on Robotics and Automation*, 19(5):842-853, Oct. 2003.
Kuhl et al., "Self Localization in Environments using Visual Angles," VRCAI '04 Proceedings of the 2004 ACM SIGGRAPH international conference on Virtual Reality continuum and its applications in industry, pp. 472-475, 2004.
Kurs et al, Wireless Power transfer via Strongly Coupled Magnetic Resonances, Downloaded from www.sciencemag.org, Aug. 2007, 5 pages.
Kurth, "Range-Only Robot Localization and SLAM with Radio", http://www.ri.cmu.edu/pub_files/pub4/kurth_derek_2004_1/kurth_derek_2004_1.pdf. 60 pages, May, 2004, accessed Jul. 27, 2012.
Kwon et al., "Table Recognition through Range-based Candidate Generation and Vision based Candidate Evaluation," ICAR 2007, The 13th International Conference on Advanced Robotics Aug. 21-24, 2007, Jeju, Korea, pp. 918-923, 2007.
Lambrinos et al., "A mobile robot employing insect strategies for navigation," Retrieved from the Internat: URL<http://www8.cs.umu.se/kurser/TDBD17/VT04/dl/Assignment%20Papers/lambrinos-RAS-2000.pdf>. 38 pages, Feb. 1999.
Lang et al., "Visual Measurement of Orientation Using Ceiling Features", 1994 IEEE, pp. 552-555, 1994.
Lapin, "Adaptive position estimation for an automated guided vehicle," *SPIE*, vol. 1831 Mobile Robots VII, pp. 82-94, 1992.
LaValle et al., "Robot Motion Planning in a Changing, Partially Predictable Environment," 1994 IEEE International Symposium on Intelligent Control, Columbus, OH, pp. 261-266, Aug. 1994.

(56) References Cited

OTHER PUBLICATIONS

Lee et al., "Development of Indoor Navigation system for Humanoid Robot Using Multi-sensors Integration", ION NTM, San Diego, CA pp. 798-805, Jan. 2007.
Lee et al., "Localization of a Mobile Robot Using the Image of a Moving Object," *IEEE Transaction on Industrial Electronics*, 50(3):612-619, Jun. 2003.
Leonard et al., "Mobile Robot Localization by tracking Geometric Beacons," *IEEE Transaction on Robotics and Automation*, 7(3):376-382, Jun. 1991.
Li et al. "Robust Statistical Methods for Securing Wireless Localization in Sensor Networks," Information Processing in Sensor Networks, 2005, Fourth International Symposium on, pp. 91-98, Apr. 2005.
Li et al., "Making a Local Map of Indoor Environments by Swiveling a Camera and a Sonar," Proceedings of the 1999 IEEE/RSJ International Conference on Intelligent Robots and Systems, pp. 954-959, 1999.
Lin et al., "Mobile Robot Navigation Using Artificial Landmarks," *Journal of robotics System*, 14(2): 93-106, 1997.
Linde, Dissertation—"On Aspects of Indoor Localization," Available at: https://eldorado.tu-dortmund.de/handle/2003/22854, University of Dortmund, 138 pages, Aug. 2006.
Lumelsky et al., "An Algorithm for Maze Searching with Azimuth Input", 1994 IEEE International Conference on Robotics and Automation, San Diego, CA vol. 1, pp. 111-116, 1994.
Luo et al., "Real-time Area-Covering Operations with Obstacle Avoidance for Cleaning Robots," IEEE, pp. 2359-2364, 2002.
Ma, Thesis—"Documentation on Northstar," California Institute of Technology, 14 pages, May 2006.
Madsen et al., "Optimal landmark selection for triangulation of robot position," Journal of Robotics and Autonomous Systems, vol. 13 pp. 277-292, 1998.
Malik et al., "Virtual Prototyping for Conceptual Design of a Tracked Mobile Robot," Electrical and Computer Engineering, Canadian Conference on, IEEE, PI. pp. 2349-2352, May 2006.
Martishevcky, "The Accuracy of point light target coordinate determination by dissectoral tracking system", SPIE vol. 2591, pp. 25-30, Oct. 23, 2005.
Maschinemarkt Würzburg 105, No. 27, pp. 3, 30, Jul. 5, 1999 (with English translation).
Matsumura Camera Online Shop: Retrieved from the Internet: URL<http://www.rakuten.co.jp/matsucame/587179/711512/>. Accessed Nov. 2011, 15 pages (with English translation).
Matsutek Enterprises Co. Ltd, "Automatic Rechargeable Vacuum Cleaner," http://matsutek.manufacturer.globalsources.com/si/6008801427181/pdtl/Home-vacuum/10 . . . , Apr. 2007, 3 pages.
McGillem et al., "Infra-red Lacation System for Navigation and Autonomous Vehicles," 1988 IEEE International Conference on Robotics and Automation, vol. 2, pp. 1236-1238, Apr. 1988.
McGillem,et al. "A Beacon Navigation Method for Autonomous Vehicles," *IEEE Transactions on Vehicular Technology*, 38(3):132-139, Aug. 1989.
McLurkin "Stupid Robot Tricks: A Behavior-based Distributed Algorithm Library for Programming Swarms of Robots," Paper submitted for requirements of BSEE at MIT, May 2004, 127 pages.
McLurkin, "The Ants: A community of Microrobots," Paper submitted for requirements of BSEE at MIT, May 1995, 60 pages.
Michelson, "Autonomous navigation," McGraw-Hill-Access Science, Encyclopedia of Science and Technology Online, 2007, 4 pages.
Miro et al., "Towards Vision Based Navigation in Large Indoor Environments," Proceedings of the IEEE/RSJ International Conference on Intelligent Robots and Systems, Beijing, China, pp. 2096-2102, Oct. 2006.
MobileMag, "Samsung Unveils High-tech Robot Vacuum Cleaner," Retrieved from the Internet: URL<http://www.mobilemag.com/content/100/102/C2261/>. 4 pages, Mar. 2005.
Monteiro et al., "Visual Servoing for Fast Mobile Robot: Adaptive Estimation of Kinematic Parameters," Proceedings of the IECON '93., International Conference on Industrial Electronics, Maui, HI, pp. 1588-1593, Nov. 1993.
Moore et al., "A simple Map-bases Localization strategy using range measurements," *SPIE*, vol. 5804 pp. 612-620, 2005.
Morland,"Autonomous Lawnmower Control", Downloaded from the internet at: http://cns.bu.edu/~cjmorlan/robotics/lawnmower/report.pdf, 10 pages, Jul. 2002.
Munich et al., "ERSP: A Software Platform and Architecture for the Service Robotics Industry," Intelligent Robots and Systems, 2005. (IROS 2005), pp. 460-467, Aug. 2005.
Munich et al., "SIFT-ing Through Features with ViPR", IEEE Robotics & Automation Magazine, pp. 72-77, Sep. 2006.
Nam et al., "Real-Time Dynamic Visual Tracking Using PSD Sensors and extended Trapezoidal Motion Planning", Applied Intelligence 10, pp. 53-70, 1999.
Nitu et al., "Optomechatronic System for Position Detection of a Mobile Mini-Robot," *IEEE Ttransactions on Industrial Electronics*, 52(4):969-973, Aug. 2005.
On Robo, "Robot Reviews Samsung Robot Vacuum (VC-RP30W)," Retrieved from the Internet: URL <www.onrobo.com/reviews/AT_Home/vacuum_cleaners/on00vcrb30rosam/index.htm>. 2 pages, 2005.
OnRobo "Samsung Unveils Its Multifunction Robot Vacuum," Retrieved from the Internet: URL <www.onrobo.com/enews/0210/samsung_vacuum.shtml>. 3 pages, Mar. 2005.
Pages et al., "A camera-projector system for robot positioning by visual serving," Proceedings of the 2006 Conference on Computer Vision and Pattern Recognition Workshop (CVPRW06), 8 pages, Jun. 2006.
Pages et al., "Optimizing Plane-to-Plane Positioning Tasks by Image-Based Visual Servoing and Structured Light," *IEEE Transactions on Robotics*, 22(5):1000-1010, Oct. 2006.
Pages et al., "Robust decoupled visual servoing based on structured light," 2005 IEEE/RSJ, Int. Conf. on Intelligent Robots and Systems, pp. 2676-2681, 2005.
Park et al., "A Neural Network Based Real-Time Robot Tracking Controller Using Position Sensitive Detectors," IEEE World Congress on Computational Intelligence., 1994 IEEE International Conference on Neutral Networks, Orlando, Florida pp. 2754-2758, Jun./Jul. 1994.
Park et al., "Dynamic Visual Servo Control of Robot Manipulators using Neutral Networks," *The Korean Institute Telematics and Electronics*, 29-B(10):771-779, Oct. 1992.
Paromtchik "Toward Optical Guidance of Mobile Robots," Proceedings of the Fourth World Multiconference on Systemics, Cybermetics and Informatics, Orlando, FL, USA, Jul. 23, 2000, vol. IX, pp. 44-49, available at http://emotion.inrialpes.fr/~paromt/infos/papers/paromtchik:asama:sci:2000.ps.gz, accessed Jul. 3, 2012, 6 pages.
Paromtchik et al., "Optical Guidance System for Multiple mobile Robots," Proceedings 2001 ICRA. IEEE International Conference on Robotics and Automation, vol. 3, pp. 2935-2940, May 2001.
Penna et al., "Models for Map Building and Navigation", IEEE Transactions on Systems. Man. And Cybernetics., 23(5):1276-1301, Sep./Oct. 1993.
Pirjanian et al. "Representation and Execution of Plan Sequences for Multi-Agent Systems," Proceedings of the 2001 IEEE/RSJ International Conference on Intelligent Robots and Systems, Maui, Hawaii, pp. 2117-2123, Oct. 2001.
Pirjanian et al., "A decision-theoretic approach to fuzzy behavior coordination", 1999 IEEE International Symposium on Computational Intelligence in Robotics and Automation, 1999. CIRA '99., Monterey, CA, pp. 101-106, Nov. 1999.
Pirjanian et al., "Distributed Control for a Modular, Reconfigurable Cliff Robot," Proceedings of the 2002 IEEE International Conference on Robotics & Automation, Washington, D.C. pp. 4083-4088, May 2002.
Pirjanian et al., "Improving Task Reliability by Fusion of Redundant Homogeneous Modules Using Voting Schemes," Proceedings of the 1997 IEEE International Conference on Robotics and Automation, Albuquerque, NM, pp. 425-430, Apr. 1997.

(56) References Cited

OTHER PUBLICATIONS

Pirjanian et al., "Multi-Robot Target Acquisition using Multiple Objective Behavior Coordination," Proceedings of the 2000 IEEE International Conference on Robotics & Automation, San Francisco, CA, pp. 2696-2702, Apr. 2000.
Pirjanian, "Challenges for Standards for consumer Robotics," IEEE Workshop on Advanced Robotics and its Social impacts, pp. 260-264, Jun. 2005.
Pirjanian, "Reliable Reaction," Proceedings of the 1996 IEEE/SICE/RSJ International Conference on Multisensor Fusion and Integration for Intelligent Systems, pp. 158-165, 1996.
Prassler et al., "A Short History of Cleaning Robots," Autonomous Robots 9, 211-226, 2000, 16 pages.
Put Your Roomba . . . On, Automatic webpages: http://www.acomputeredge.com/roomba, 5 pages, accessed Apr. 2005.
Remazeilles et al., "Image based robot navigation in 3D environments," Proc. of *SPIE*, vol. 6052, pp. 1-14, Dec. 2005.
Rives et al., "Visual servoing based on ellipse features," *SPIE*, vol. 2056 Intelligent Robots and Computer Vision pp. 356-367, 1993.
Roboking—not just a vacuum cleaner, a robot!, Jan. 21, 2004, infocom.uz/2004/01/21/robokingne-prosto-pyilesos-a-robot/, accessed Oct. 10, 2011, 5 pages.
RoboMaid Sweeps Your Floors So You Won't Have To, the Official Site, website: Retrieved from the Internet: URL<http://therobomaid.com/>. 2 pages, accessed Mar. 2005.
Robot Buying Guide, "LG announces the first robotic vacuum cleaner for Korea," Retrieved from the Internet: URL<http://robotbg.com/news/2003/04/22/lg_announces_the_first_robotic_vacu>. 1 page, Apr. 2003.
Robotics World, "A Clean Sweep," 5 pages, Jan. 2001.
Ronnback, "On Methods for Assistive Mobile Robots," Retrieved from the Internet: URL<http://www.openthesis.org/documents/methods-assistive-mobile-robots-595019.html>. 218 pages, Jan. 2006.
Roth-Tabak et al., "Environment Model for mobile Robots Indoor Navigation," *SPIE*, vol. 1388 Mobile Robots, pp. 453-463, 1990.
Sahin et al., "Development of a Visual Object Localization Module for Mobile Robots," 1999 Third European Workshop on Advanced Mobile Robots, (Eurobot '99), pp. 65-72, 1999.
Salomon et al., "Low-Cost Optical Indoor Localization system for Mobile Objects without Image Processing," IEEE Conference on Emerging Technologies and Factory Automation, 2006. (ETFA '06), pp. 629-632, Sep. 2006.
Sato, "Range Imaging Based on Moving Pattern Light and Spatio-Temporal Matched Filter," Proceedings International Conference on Image Processing, vol. 1., Lausanne, Switzerland, pp. 33-36, Sep. 1996.
Schenker et al., "Lightweight rovers for Mars science exploration and sample return," Intelligent Robots and Computer Vision XVI, *SPIE* Proc. 3208, pp. 24-36, 1997.
Schofield, "Neither Master nor slave—A Practical Study in the Development and Employment of Cleaning Robots, Emerging Technologies and Factory Automation," 1999 Proceedings ETFA '99 1999 7th IEEE International Conference on Barcelona, Spain, pp. 1427-1434, Oct. 1999.
Shimoga et al., "Touch and Force Reflection for Telepresence Surgery," Engineering in Medicine and Biology Society, 1994. Engineering Advances: New Opportunities for Biomedical Engineers. Proceedings of the 16th Annual International Conference of the IEEE, Baltimore, MD, pp. 1049-1050, 1994.
Sim et al, "Learning Visual Landmarks for Pose Estimation," IEEE International Conference on Robotics and Automation, vol. 3, Detroit, MI, pp. 1972-1978, May 1999.
Sobh et al., "Case Studies in Web-Controlled Devices and Remote Manipulation," Automation Congress, 2002 Proceedings of the 5th Biannual World, pp. 435-440, Dec. 2002.
Special Reports, "Vacuum Cleaner Robot Operated in Conjunction with 3G Celluar Phone," 59(9): 3 pages, Retrieved from the Internet: URL<http://www.toshiba.co.jp/tech/review/2004/09/59_0>. 2004.
Stella et al., "Self-Location for Indoor Navigation of Autonomous Vehicles," Part of the SPIE conference on Enhanced and Synthetic Vision SPIE vol. 3364, pp. 298-302, 1998.
Summet, "Tracking Locations of Moving Hand-held Displays Using Projected Light," Pervasive 2005, LNCS 3468, pp. 37-46, 2005.
Svedman et al., "Structure from Stereo Vision using Unsynchronized Cameras for Simultaneous Localization and Mapping," 2005 IEEE/RSJ International Conference on Intelligent Robots and Systems, pp. 2993-2998, 2005.
SVET Computers—New Technologies—Robot Vacuum Cleaner, Oct. 1999, available at http://www.sk.rs/1999/10/sknt01.html, 1 page, accessed Nov. 1, 2011.
Taipei Times, "Robotic vacuum by Matsuhita about to undergo testing," Retrieved from the Internet: URL<http://www.taipeitimes.com/News/worldbiz/archives/2002/03/26/0000129338>. accessed Mar. 2002, 2 pages.
Takio et al., "Real-Time Position and Pose Tracking Method of Moving Object Using Visual Servo System," 47th IEEE International Symposium on Circuits and Systems, pp. 167-170, 2004.
Tech-on!, Retrieved from the Internet: URL<http://techon.nikkeibp.co.jp/members/01db/200203/1006501/>. 4 pages, accessed Nov. 2011.
Teller, "Pervasive pose awareness for people, Objects and Robots," http://www.ai.mit.edu/lab/dangerous-ideas/Spring2003/teller-pose.pdf, 6 pages, Apr. 2003.
Terada et al., "An Acquisition of the Relation between Vision and Action using Self-Organizing Map and Reinforcement Learning," 1998 Second International Conference on Knowledge-Based Intelligent Electronic Systems, Adelaide, Australia, pp. 429-434, Apr. 1998.
The Sharper Image, eVac Robotic Vacuum—Product Details, www.sharperiamge.com/us/en/templates/products/pipmorework1printable.jhtml, 1 page, Accessed Mar. 2005.
TheRobotStore.com, "Friendly Robotics Robotic Vacuum RV400—The Robot Store," www.therobotstore.com/s.nl/sc.9/category.-109/it.A/id.43/.f, 1 page, Apr. 2005.
Thrun, Sebastian, "Learning Occupancy Grid Maps With Forward Sensor Models," Autonomous Robots 15, 28 pages, Sep. 1, 2003.
TotalVac.com, RC3000 RoboCleaner website, 2004, Accessed at http://ww.totalvac.com/robot_vacuum.htm (Mar. 2005), 3 pages.
Trebi-Ollennu et al., "Mars Rover Pair Cooperatively Transporting a Long Payload," Proceedings of the 2002 IEEE International Conference on Robotics & Automation, Washington, D.C. pp. 3136-3141, May 2002.
Tribelhorn et al., "Evaluating the Roomba: A low-cost, ubiquitous platform for robotics research and education," *IEEE*, pp. 1393-1399, 2007.
Tse et al., "Design of a Navigation System for a Household Mobile Robot Using Neural Networks," Department of Manufacturing Engg. & Engg. Management, City University of Hong Kong, pp. 2151-2156, 1998.
UAMA (Asia) Industrial Co., Ltd., "RobotFamily," 2005, 1 page.
UBOT, cleaning robot capable of wiping with a wet duster, Retrieved from the Internet: URL<http://us.aving.net/news/view.php?articleId=23031>. 4 pages, accessed Nov. 2011.
Watanabe et al., "Position Estimation of Mobile Robots With Internal and External Sensors Using Uncertainty Evolution Technique," 1990 IEEE International Conference on Robotics and Automation, Cincinnati, OH, pp. 2011-2016, May 1990.
Watts, "Robot, boldly goes where no man can," The Times—pp. 20, Jan. 1985.
Wijk et al., "Triangulation-Based Fusion of Sonar Data with Application in Robot Pose Tracking," *IEEE Transactions on Robotics and Automation*, 16(6):740-752, Dec. 2000.
Wolf et al., "Robust Vision-Based Localization by Combining an Image-Retrieval System with Monte Carol Localization,", *IEEE Transactions on Robotics*, 21(2):208-216, Apr. 2005.
Wolf et al., "Robust Vision-based Localization for Mobile Robots Using an Image Retrieval System Based on Invariant Features," Proceedings of the 2002 IEEE International Conference on Robotics & Automation, Washington, D.C., pp. 359-365, May 2002.

(56) References Cited

OTHER PUBLICATIONS

Wong, "EIED Online>> Robot Business", ED Online ID# 13114, 17 pages, Jul. 2006.
Yamamoto et al., "Optical Sensing for Robot Perception and Localization," 2005 IEEE Workshop on Advanced Robotics and its Social Impacts, pp. 14-17, 2005.
Yata et al., "Wall Following Using Angle Information Measured by a Single Ultrasonic Transducer," Proceedings of the 1998 IEEE, International Conference on Robotics & Automation, Leuven, Belgium, pp. 1590-1596, May 1998.
Yujin Robotics,"An intelligent cleaning robot," Retrieved from the Internet: URL<http://us.aving.net/news/view.php?articleId=7257>. 8 pages, accessed Nov. 2011.
Yun et al., "Image-Based Absolute Positioning System for Mobile Robot Navigation," IAPR International Workshops SSPR, Hong Kong, pp. 261-269, Aug. 2006.
Yun et al., "Robust Positioning a Mobile Robot with Active Beacon Sensors," *Lecture Notes in Computer Science*, 2006, vol. 4251, pp. 890-897, 2006.
Yuta et al., "Implementation of an Active Optical Range sensor Using Laser Slit for In-Door Intelligent Mobile Robot," IEE/RSJ International Workshop on Intelligent Robots and Systems (IROS 91) vol. 1, Osaka, Japan, pp. 415-420, Nov. 3-5, 1991.
Zha et al., "Mobile Robot Localization Using Incomplete Maps for Change Detection in a Dynamic Environment," Advanced Intelligent Mechatronics '97. Final Program and Abstracts., IEEE/ASME International Conference, pp. 110, Jun. 1997.
Zhang et al., "A Novel Mobile Robot Localization Based on Vision," *SPIE* vol. 6279, 6 pages, Jan. 2007.
Zoombot Remote Controlled Vaccuum-RV-500 NEW Roomba 2, website: http://cgi.ebay.com/ws/eBayISAPI.dll?ViewItem&category=43526&item=4373497618&rd=1, accessed Apr. 20, 2005, 7 pages.
Abstract and Machine generated translation of JP 2002-360479.
English language translation of DE 10242257, published Apr. 24, 2003.
English language translation of EP 1380245, published Jan. 14, 2004.
English language translation of EP 1557730, published Jul. 27, 2005.
English Language translation of JP 05-054620.
English language translation of JP 2003-061882, published Mar. 2003.
English language translation of WO 02/071175, published Sep. 12, 2002.
English language translation of WO 2004/058028, published Jul. 15, 2004.
English language translation of WO 2004/059409, published Jul. 15, 2004.
English language translation of WO 2005/055795, published Jun. 23, 2005.
English language translation of WO 2006/061133, published Jun. 15, 2006.
English language translation of WO 2006/068403, published Jun. 29, 2006.
Machine generated translation of JP U5-54620, dated Jul. 23, 1993.
Notice of Allowance from U.S. Appl. No. 10/320,729, dated Jan. 7, 2005.
Notice of Allowance from U.S. Appl. No. 10/818,073, dated May 4, 2009.
Notice of Allowance from U.S. Appl. No. 11/834,606, dated Aug. 4, 2008.
Notice of Allowance from U.S. Appl. No. 11/834,647, dated Oct. 13, 2010.
Notice of Allowance from U.S. Appl. No. 11/834,647, dated Sep. 3, 2010.
Notice of Allowance from U.S. Appl. No. 11/834,647, dated May 20, 2010.
Notice of Allowance from U.S. Appl. No. 11/834,647, dated Feb. 1, 2010.
Notice of Allowance from U.S. Appl. No. 11/834,656, dated Aug. 13, 2009.
Notice of Allowance in U.S. Appl. No. 11/834,647, dated Jan. 5, 2012.
Office Action from U.S. Appl. No. 11/671,305 dated Aug. 22, 2007.
Office Action from U.S. Appl. No. 12/824,785, dated Feb. 24, 2012.
Office Action from U.S. Appl. No. 12/971,281, dated Mar. 16, 2012.
Office Action from U.S. Appl. No. 10/818,073, dated Jan. 8, 2008.
Office Action from U.S. Appl. No. 11/166,986, dated Oct. 25, 2008.
Office Action from U.S. Appl. No. 11/166,986, dated May 12, 2009.
Office Action from U.S. Appl. No. 11/166,986, dated Sep. 4, 2009.
Office Action from U.S. Appl. No. 11/541,422, dated Jul. 22, 2010.
Office Action from U.S. Appl. No. 11/633,869, dated Sep. 16, 2010.
Office Action from U.S. Appl. No. 11/682,642, dated Jul. 13, 2010.
Office Action from U.S. Appl. No. 11/834,573, dated Nov. 23, 2009.
Office Action from U.S. Appl. No. 11/834,573, dated Mar. 23, 2009.
Office Action from U.S. Appl. No. 11/834,647, dated May 16, 2008.
Office Action from U.S. Appl. No. 11/834,647, dated Oct. 31, 2008.
Office Action from U.S. Appl. No. 11/834,647, dated Mar. 6, 2009.
Office Action from U.S. Appl. No. 11/834,647, dated Sep. 9, 2009.
Office Action from U.S. Appl. No. 11/834,656, dated Apr. 16, 2008.
Office Action from U.S. Appl. No. 12/201,554, dated Jun. 16, 2009.
Office Action from U.S. Appl. No. 12/201,554, dated Jan. 14, 2010.
Office Action from U.S. Appl. No. 12/211,938, dated Sep. 27, 2010.
Office Action from U.S. Appl. No. 12/610,792, dated Feb. 16, 2011.
Office Action from U.S. Appl. No. 12/824,785, dated Jun. 10, 2011.
Office Action from U.S. Appl. No. 12/824,785, dated Oct. 21, 2010.
Office Action from U.S. Appl. No. 12/824,804, dated Apr. 14, 2011.
Office Action from U.S. Appl. No. 12/824,804, dated Aug. 2, 2010.
Office Action from U.S. Appl. No. 12/971,281, dated Jun. 24, 2011.
Office Action in JP Application No. 2009-133437, dated Jun. 6, 2011 (with English Translation).
Office Action in JP Application No. 2010-133227, dated Nov. 18, 2011 (with English Translation).
Office Action in JP Application No. 2010-133228, dated Jan. 5, 2012 (with English Translation).
Office Action in JP Application No. 2010-133229, dated Nov. 18, 2011 (with English Translation).
Office Action in JP Application No. 2012-204434, dated May 28, 2013 (with English Translation).
Office Action in JP Application No. 2012-85697, dated May 23, 2013 (with English Translation).
Office Action in U.S. Appl. No. 11/6445682,642, dated Oct. 28, 2009.
Office Action in U.S. Appl. No. 12/824,832, dated Jul. 29, 2011.
Office Action in U.S. Appl. No. 12/824,832, dated Nov. 10, 2010.
Office Action in U.S. Appl. No. 12/824,804, dated Jan. 4, 2012.
U.S. Appl. No. 60/605,066, filed on Aug. 27, 2004.
U.S. Appl. No. 60/605,181, filed on Aug. 27, 2004.
Written Opinion of the International Searching Authority in PCT/US2004/001504, dated Aug. 20, 2012, 9 pages.
Electrolux "Welcome to the Electrolux trilobite" www.electroluxusa.com/node57.asp?currentURL=node142.asp%3F. 2 pages. Mar. 18, 2005.
Hitachi 'Feature', htt12://kadenfan.hitachi.co.j12/robot/feature/feature.html, 1 page, Nov. 19, 2008.
"Miwako Doi ""Using the symbiosis of human and robots from approaching Research and Development Center,"" Toshiba Corporation, 16 pages, available at http://warp.ndl.go.jp/info:ndljp/pid/258151/www.soumu.go.jp/johotsusin/policyreports/chousa/netrobot/pdf/030214 1 33 a.pdf, Feb. 26, 2003".
Radio Frequency Identification: Tracking ISS Consumables, Author Unknown, 41 pages (NPL0127).
Popco.net Make your digital life http://www.popco.net/zboard/view.php?id=tr_review&no=40 accessed Nov. 1, 2011.
Robotic Vacuum Cleaner—Blue, website: http://www.sharperimage.com/us/en/catalog/productview.jhtml?sku=S 1727BLU, accessed Mar. 18, 2005, 3 pgs.
U.S. Office Action dated Aug. 27, 2004 for U.S. Appl. No. 10/320,729.
U.S. Office Action dated May 7, 2008 for U.S. Appl. No. 10/818,073.
U.S. Office Action dated Jan. 7, 2009 for U.S. Appl. No. 10/818,073.

(56) References Cited

OTHER PUBLICATIONS

U.S. Office Action dated Feb. 28, 2008 for U.S. Appl. No. 11/834,606.
U.S. Office Action dated Jul. 28, 2008 for U.S. Appl. No. 11/834,656.
U.S. Office Action dated Jan. 26, 2009 for U.S. Appl. No. 11/834,656.
Examination Report dated Aug. 2, 2010 from corresponding U.S. Appl. No. 11/751,413.
Examination Report dated Dec. 2, 2010 from corresponding U.S. Appl. No. 11/751,267.
Examination Report dated Apr. 13, 2010 from corresponding U.S. Appl. No. 11/751,267.
Examination Report dated May 27, 2010 from corresponding U.S. Appl. No. 11/751,470.
Examination Report dated Jun. 9, 2010 from corresponding U.S. Appl. No. 11/835,355.
Examination Report dated Sep. 14, 2009 from corresponding U.S. Appl. No. 11/835,355.
Examination Report dated Oct. 26, 2009 from corresponding U.S. Appl. No. 11/835,361.
Examination Report dated Jul. 28, 2010 from corresponding U.S. Appl. No. 12/610,792.
U.S. Appl. No. 11/834,606, filed Aug. 6, 2007.
U.S. Appl. No. 11/834,656, filed Aug. 10, 2007.
International Search Report and Written Opinion dated Dec. 2, 2010 for PCT/US2010/045502.
International Search Report and Written Opinion dated Feb. 18, 2009 for PCT/US2008/063174.
Examination Report dated Aug. 17, 2010 from corresponding EP Application No. 07783998.3.
Japanese Office Action from corresponding application JP 2003-403161, dated Dec. 2, 2008, along with an English language translation thereof.
Japanese Office Action from corresponding application JP 2003-403161, dated Jun. 23, 2009, along with an English language translation thereof.
Japanese Office Action from corresponding application JP 2003-403161, dated Feb. 2010, along with an English language translation thereof.
Japanese Office Action from corresponding application JP 2003-403161, dated Nov. 5, 2010, along with an English language translation thereof.
Japanese Office Action from corresponding application JP 2010-284344, dated Feb. 4, 2011, along with an English language translation thereof.

* cited by examiner

AUTONOMOUS FLOOR-CLEANING ROBOT

CROSS-REFERENCE TO RELATED APPLICATIONS

This application for U.S. Patent is a continuation of, and claims priority from, U.S. patent application Ser. No. 13/714,546 filed Dec. 14, 2012, entitled Autonomous Floor-Cleaning Robot, which claims priority to U.S. patent application Ser. No. 12/201,554 filed Aug. 29, 2008, entitled Autonomous Floor-Cleaning Robot, which claims priority to U.S. patent application Ser. No. 10/818,073 filed Apr. 5, 2004, entitled Autonomous Floor-Cleaning Robot, which claims priority to U.S. patent application Ser. No. 10/320,729 filed Dec. 16, 2002, entitled Autonomous Floor-Cleaning Robot and U.S. Provisional Application Ser. No. 60/345,764 filed Jan. 3, 2002, entitled Cleaning Mechanisms for Autonomous Robot, the contents of each of which are hereby incorporated by reference. The subject matter of this application is also related to commonly-owned, copending U.S. patent application Ser. No. 09/768,773, filed Jan. 24, 2001, entitled Robot Obstacle Detection System; Ser. No. 10/167,851, filed Jun. 12, 2002, entitled Method and System for Robot Localization and Confinement; and, Ser. No. 10/056,804, filed Jan. 24, 2002, entitled Method and System for Multi-Mode Coverage for an Autonomous Robot.

BACKGROUND OF THE INVENTION (1) Field of the Invention

The present invention relates to cleaning devices, and more particularly, to an autonomous floor-cleaning robot that comprises a self-adjustable cleaning head subsystem that includes a dual-stage brush assembly having counter-rotating, asymmetric brushes and an adjacent, but independent, vacuum assembly such that the cleaning capability and efficiency of the self-adjustable cleaning head subsystem is optimized while concomitantly minimizing the power requirements thereof. The autonomous floor-cleaning robot further includes a side brush assembly for directing particulates outside the envelope of the robot into the self-adjustable cleaning head subsystem.

(2) Description of Related Art

Autonomous robot cleaning devices are known in the art. For example, U.S. Pat. Nos. 5,940,927 and 5,781,960 disclose an Autonomous Surface Cleaning Apparatus and a Nozzle Arrangement for a Self-Guiding Vacuum Cleaner. One of the primary requirements for an autonomous cleaning device is a self-contained power supply—the utility of an autonomous cleaning device would be severely degraded, if not outright eliminated, if such an autonomous cleaning device utilized a power cord to tap into an external power source.

And, while there have been distinct improvements in the energizing capabilities of self-contained power supplies such as batteries, today's self-contained power supplies are still time-limited in providing power. Cleaning mechanisms for cleaning devices such as brush assemblies and vacuum assemblies typically require large power loads to provide effective cleaning capability. This is particularly true where brush assemblies and vacuum assemblies are configured as combinations, since the brush assembly and/or the vacuum assembly of such combinations typically have not been designed or configured for synergic operation.

A need exists to provide an autonomous cleaning device that has been designed and configured to optimize the cleaning capability and efficiency of its cleaning mechanisms for synergic operation while concomitantly minimizing or reducing the power requirements of such cleaning mechanisms.

SUMMARY OF THE INVENTION

One object of the present invention is to provide a cleaning device that is operable without human intervention to clean designated areas.

Another object of the present invention is to provide such an autonomous cleaning device that is designed and configured to optimize the cleaning capability and efficiency of its cleaning mechanisms for synergic operations while concomitantly minimizing the power requirements of such mechanisms.

These and other objects of the present invention are provided by one embodiment autonomous floor-cleaning robot according to the present invention that comprises a housing infrastructure including a chassis, a power subsystem; for providing the energy to power the autonomous floor-cleaning robot, a motive subsystem operative to propel the autonomous floor-cleaning robot for cleaning operations, a control module operative to control the autonomous floor-cleaning robot to effect cleaning operations, and a self-adjusting cleaning head subsystem that includes a deck mounted in pivotal combination with the chassis, a brush assembly mounted in combination with the deck and powered by the motive subsystem to sweep up particulates during cleaning operations, a vacuum assembly disposed in combination with the deck and powered by the motive subsystem to ingest particulates during cleaning operations, and a deck height adjusting subassembly mounted in combination with the motive subsystem for the brush assembly, the deck, and the chassis that is automatically operative in response to a change in torque in said brush assembly to pivot the deck with respect to said chassis and thereby adjust the height of the brushes from the floor. The autonomous floor-cleaning robot also includes a side brush assembly mounted in combination with the chassis and powered by the motive subsystem to entrain particulates outside the periphery of the housing infrastructure and to direct such particulates towards the self-adjusting cleaning head subsystem.

BRIEF DESCRIPTION OF THE DRAWINGS

A more complete understanding of the present invention and the attendant features and advantages thereof may be had by reference to the following detailed description of the invention when considered in conjunction with the accompanying drawings wherein.

DETAILED DESCRIPTION OFF THE INVENTION

Figure 1:
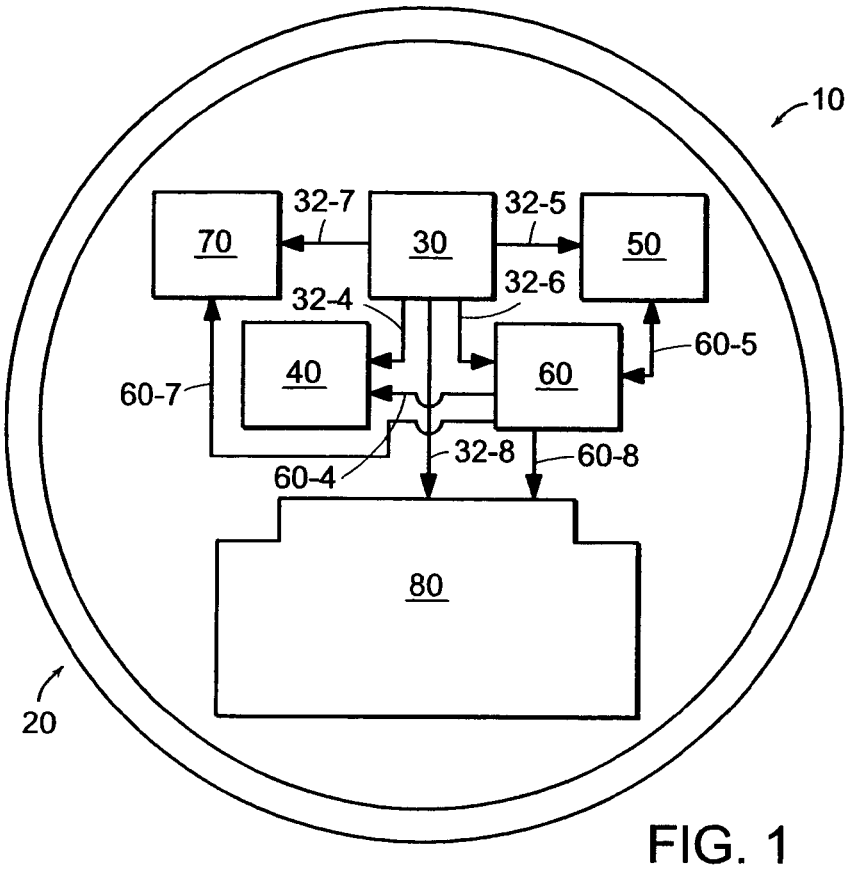
FIG. 1 is a schematic representation of an autonomous floor-cleaning robot according to the present invention.
Figure 2:
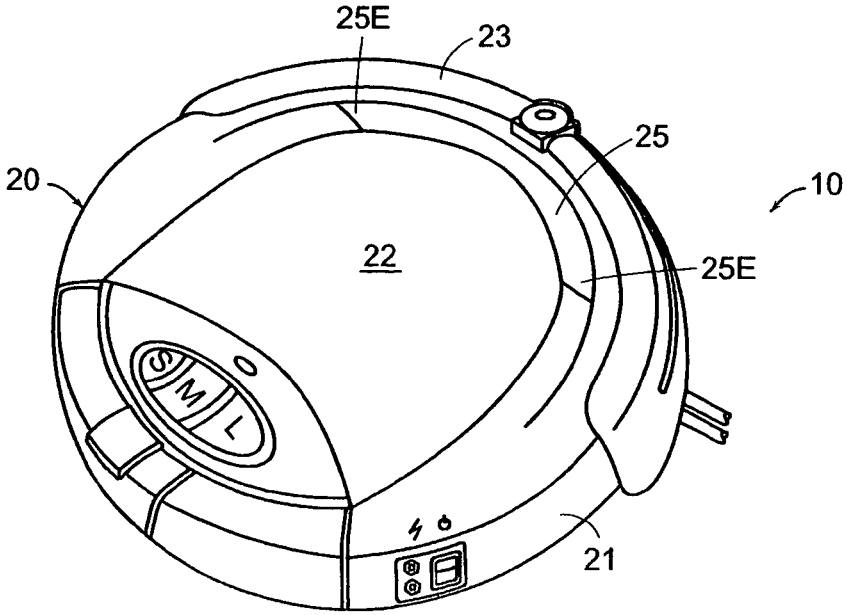
FIG. 2 is a perspective view of one embodiment of an autonomous floor-cleaning robot according to the present invention.
Figure 2A:
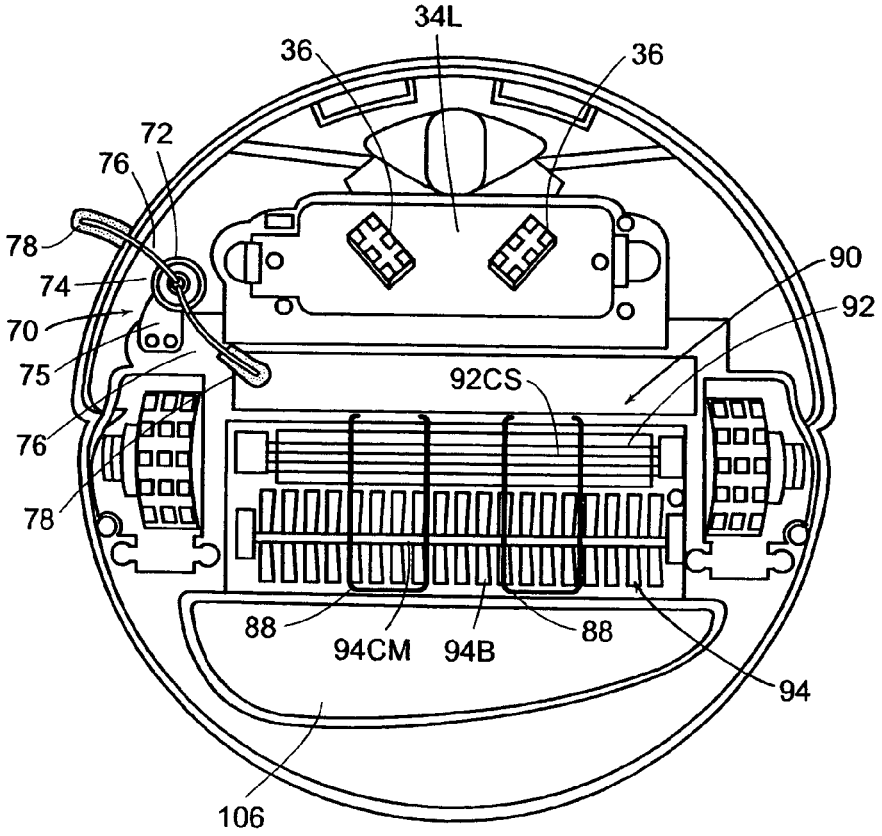
FIG. 2A is a bottom plan view of the autonomous floor-cleaning robot of FIG. 2.

Referring now to the drawings where like reference numerals identify corresponding or similar elements throughout the several views, FIG. 1 is a schematic representation of an autonomous floor-cleaning robot 10 according to the present invention. The robot 10 comprises a housing infrastructure 20, a power subsystem 30, a motive subsystem 40, a sensor subsystem 50, a control module 60, a side brush assembly 70, and a self-adjusting cleaning head subsystem 80. The power subsystem 30, the motive subsystem 40, the sensor subsystem 50, the control module 60, the side brush assembly 70, and the self-adjusting cleaning head subsystem 80 are integrated in combination with the housing infrastructure 20 of the robot 10 as described in further detail in the following paragraphs.

In the following description of the autonomous floor-cleaning robot 10, use of the terminology "forward/fore" refers to the primary direction of motion of the autonomous floor-cleaning robot 10, and the terminology fore-aft axis (see reference characters "FA" in FIGS. 3A, 3B) defines the forward direction of motion (indicated by arrowhead of the fore-aft axis FA), which is coincident with the fore-aft diameter of the robot 10.

Referring to FIGS. 2, 2A, and 3A-3C, the housing infrastructure 20 of the robot 10 comprises a chassis 21, a cover 22, a displaceable bumper 23, a nose wheel subassembly 24, and a carrying handle 25. The chassis 21 is preferably molded from a material such as plastic as a unitary element that includes a plurality of preformed wells, recesses, and structural members for, inter alia, mounting or integrating elements of the power subsystem 30, the motive subsystem 40, the sensor subsystem 50, the side brush assembly 70, and the self-adjusting cleaning head subsystem 80 in combination with the chassis 21. The cover 22 is preferably molded from a material such as plastic as a unitary element that is complementary in configuration with the chassis 21 and provides protection of and access to elements/components mounted to the chassis 21 and/or comprising the self-adjusting cleaning head subsystem 80. The chassis 21 and the cover 22 are detachably integrated in combination by any suitable means, e.g., screws, and in combination, the chassis 21 and cover 22 form a structural envelope of minimal height having a generally cylindrical configuration that is generally symmetrical along the fore-aft axis FA.

The displaceable bumper 23, which has a generally arcuate configuration, is mounted in movable combination at the forward portion of the chassis 21 to extend outwardly therefrom, i.e., the normal operating position. The mounting configuration of the displaceable bumper is such that the bumper 23 is displaced towards the chassis 21 (from the normal operating position) whenever the bumper 23 encounters a stationary object or obstacle of predetermined mass, i.e., the displaced position, and returns to the normal operating position when contact with the stationary object or obstacle is terminated (due to operation of the control module 60 which, in response to any such displacement of the bumper 23, implements a "bounce" mode that causes the robot 10 to evade the stationary object or obstacle and continue its cleaning routine, e.g., initiate a random—or weighted-random—turn to resume forward movement in a different direction). The mounting configuration of the displaceable bumper 23 comprises a pair of rotatable support members 23RSM, which are operative to facilitate the movement of the bumper 23 with respect to the chassis 21.

The pair of rotatable support members 23RSM are symmetrically mounted about the fore-aft axis FA of the autonomous floor-cleaning robot 10 proximal the center of the displaceable bumper 23 in a V-configuration. One end of each support member 23RSM is rotatably mounted to the chassis 21 by conventional means, e.g., pins/dowel and sleeve arrangement, and the other end of each support member 23RSM is likewise rotatably mounted to the displaceable bumper 23 by similar conventional means. A biasing spring (not shown) is disposed in combination with each rotatable support member 23RSM and is operative to provide the biasing force necessary to return the displaceable bumper 23 (through rotational movement of the support members 23RSM) to the normal operating position whenever contact with a stationary object or obstacle is terminated.

The embodiment described herein includes a pair of bumper arms 23BA that are symmetrically mounted in parallel about the fore-aft diameter FA of the autonomous floor-cleaning robot 10 distal the center of the displaceable bumper 23. These bumper arms 23BA do not per se provide structural support for the displaceable bumper 23, but rather are a part of the sensor subsystem 50 that is operative to determine the location of a stationary object or obstacle encountered via the bumper 23. One end of each bumper arm 23BA is rigidly secured to the displaceable bumper 23 and the other end of each bumper arm 23BA is mounted in combination with the chassis 21 in a manner, e.g., a slot arrangement such that, during an encounter with a stationary object or obstacle, one or both bumper arms 23BA are linearly displaceable with respect to the chassis 21 to activate an associated sensor, e.g., IR break beam sensor, mechanical switch, capacitive sensor, which provides a corresponding signal to the control module 60 to implement the "bounce" mode. Further details regarding the operation of this aspect of the sensor subsystem 50, as well as alternative embodiments of sensors having utility in detecting contact with or proximity to stationary objects or obstacles can be found in commonly-owned, co-pending U.S. patent application Ser. No. 10/056,804, filed 24 Jan. 2002, entitled Method and System for Multi-Mode Coverage for an Autonomous Robot.

The nose-wheel subassembly 24 comprises a wheel 24W rotatably mounted in combination with a clevis member 24CM that includes a mounting shaft. The clevis mounting shaft 24CM is disposed in a well in the chassis 21 at the forward end thereof on the fore-aft diameter of the autonomous floor-cleaning robot 10. A biasing spring 24BS (hidden behind a leg of the clevis member 24CM in FIG. 3C) is disposed in combination with the clevis mounting shaft 24CM and operative to bias the nose-wheel subassembly 24 to an 'extended' position whenever the nose-wheel subassembly 24 loses contact with the surface to be cleaned. During cleaning operations, the weight of the autonomous floor-cleaning robot 10 is sufficient to overcome the force exerted by the biasing spring 24BS to bias the nose-wheel subassembly 24 to a partially retracted or operating position wherein the wheel rotates freely over the surface to be cleaned. Opposed triangular or conical wings 24TW extend outwardly from the ends of the clevis member to prevent the side of the wheel from catching on low obstacle during turning movements of the autonomous floor-cleaning robot 10. The wings 24TW act as ramps in sliding over bumps as the robot turns.

Ends 25E of the carrying handle 25 are secured in pivotal combination with the cover 22 at the forward end thereof, centered about the fore-aft axis FA of the autonomous floor-cleaning robot 10. With the autonomous floor-cleaning robot 10 resting on or moving over a surface to be cleaned, the carrying handle 25 lies approximately flush with the surface of the cover 22 (the weight of the carrying handle 25, in conjunction with arrangement of the handle-cover pivot configuration, is sufficient to automatically return the carrying handle 25 to this flush position due to gravitational effects). When the autonomous floor-cleaning robot 10 is picked up by means of the carrying handle 25, the aft end of the autonomous floor-cleaning robot 10 lies below the forward end of the autonomous floor-cleaning robot 10 so that particulate debris is not dislodged from the self-adjusting cleaning head subsystem 80.

The power subsystem 30 of the described embodiment provides the energy to power individual elements/components of the motive subsystem 40, the sensor subsystem 50, the side brush assembly 70, and the self-adjusting cleaning head subsystem 80 and the circuits and components of the control module 60 via associated circuitry 32-4, 32-5, 32-7, 32-8, and 32-6, respectively (see FIG. 1) during cleaning operations. The power subsystem 30 for the described embodiment of the autonomous floor-cleaning robot 10 comprises a rechargeable battery pack 34 such as a NiMH battery pack. The rechargeable battery pack 34 is mounted in a well formed in the chassis 21 (sized specifically for mounting/retention of the battery pack 34) and retained therein by any conventional means, e.g., spring latches (not shown). The battery well is covered by a lid 34L secured to the chassis 21 by conventional means such as screws. Affixed to the lid 34L are friction pads 36 that facilitate stopping of the autonomous floor-cleaning robot 10 during automatic shutdown. The friction pads 36 aid in stopping the robot upon the robot's attempting to drive over a cliff. The rechargeable battery pack 34 is configured to provide sufficient power to run the autonomous floor-cleaning robot 10 for a period of sixty (60) to ninety (90) minutes on a full charge while meeting the power requirements of the elements/components comprising motive subsystem 40, the sensor subsystem 50, the side brush assembly 70, the self-adjusting cleaning head subsystem 80, and the circuits and components of the control module 60.

The motive subsystem 40 comprises the independent means that: (1) propel the autonomous floor-cleaning robot 10 for cleaning operations; (2) operate the side brush assembly 70; and (3) operate the self-adjusting cleaning head subsystem 80 during such cleaning operations. Such independent means includes right and left main wheel subassemblies 42A, 42B, each subassembly 42A, 42B having its own independently-operated motor 42$A_M$, 42$B_M$, respectively, an independent electric motor 44 for the side brush assembly 70, and two independent electric motors 46, 48 for the self-adjusting brush subsystem 80, one motor 46 for the vacuum assembly and one motor 48 for the dual-stage brush assembly.

The right and left main wheel subassemblies 42A, 42B are independently mounted in wells of the chassis 21 formed at opposed ends of the transverse diameter of the chassis 21 (the transverse diameter is perpendicular to the fore-aft axis FA of the robot 10). Mounting at this location provides the autonomous floor-cleaning robot 10 with an enhanced turning capability, since the main wheel subassemblies 42A, 42B motor can be independently operated to effect a wide range of turning maneuvers, e.g., sharp turns, gradual turns, turns in place.

Each main wheel subassembly 42A, 42B comprises a wheel 42$A_W$, 42$B_W$ rotatably mounted in combination with a clevis member 42$A_{CM}$, 42$B_{CM}$. Each clevis member 42$A_{CM}$, 42$B_{CM}$ is pivotally mounted to the chassis 21 aft of the wheel axis of rotation (see FIG. 3C which illustrates the wheel axis of rotation 42$A_{AR}$; the wheel axis of rotation for wheel subassembly 42B, which is not shown, is identical), i.e., independently suspended. The aft pivot axis 42$A_M$, 42$B_M$ (see FIG. 3A) of the main wheel subassemblies 42A, 42B facilitates the mobility of the autonomous floor-cleaning robot 10, i.e., pivotal movement of the subassemblies 42A, 42B through a predetermined arc. The motor 42$A_M$, 42$B_M$ associated with each main wheel subassembly 42A, 42B is mounted to the aft end of the clevis member 42$A_{CM}$, 42$B_{CM}$. One end of a tension spring 42$B_{TS}$ (the tension spring for the right wheel subassembly 42A is not illustrated, but is identical to the tension spring 42BTS of the left wheel subassembly 42A) is attached to the aft portion of the clevis member 42$B_{CM}$ and the other end of the tension spring 42$B_{TS}$ is attached to the chassis 21 forward of the respective wheel 42$A_W$, 42 $B_W$.

Each tension spring is operative to rotatably bias the respective main wheel subassembly 42A, 42B (via pivotal movement of the corresponding clevis member 42$A_{CM}$, 42$B_{CM}$ through the predetermined arc) to an 'extended' position when the autonomous floor-cleaning robot 10 is removed from the floor (in this 'extended' position the wheel axis of rotation lies below the bottom plane of the chassis 21). With the autonomous floor-cleaning robot 10 resting on or moving over a surface to be cleaned, the weight of autonomous floor-cleaning robot 10 gravitationally biases each main wheel subassembly 42A, 42B into a retracted or operating position wherein axis of rotation of the wheels are approximately coplanar with bottom plane of the chassis 21. The motors 42$A_M$, 42$B_M$ of the main wheel subassemblies 42A, 42B are operative to drive the main wheels: (1) at the same speed in the same direction of rotation to propel the autonomous floor-cleaning robot 10 in a straight line, either forward or aft; (2) at different speeds (including the situation wherein one wheel is operated at zero speed) to effect turning patterns for the autonomous floor-cleaning robot 10; or (3) at the same speed in opposite directions of rotation to cause the robot 10 to turn in place, i.e., "spin on a dime".

The wheels 42$A_W$, 42$B_W$ of the main wheel subassemblies 42A, 42B preferably have a "knobby" tread configuration 42$A_{KT}$, 42$B_{KT}$. This knobby tread configuration 42$A_{KT}$, 42$B_{KT}$ provides the autonomous floor-cleaning robot 10 with enhanced traction, particularly when traversing smooth surfaces and traversing between contiguous surfaces of different textures, e.g., bare floor to carpet or vice versa. This knobby tread configuration 42$A_{KT}$, 42$B_{KT}$ also prevents tufted fabric of carpets/rugs from being entrapped in the wheels 42A$_W$, 42B and entrained between the wheels and the chassis 21 during movement of the autonomous floor-cleaning robot 10. One skilled in the art will appreciate, however, that other tread patterns/configurations are within the scope of the present invention.

The sensor subsystem 50 comprises a variety of different sensing units that may be broadly characterized as either: (1) control sensing units 52; or (2) emergency sensing units 54. As the names imply, control sensing units 52 are operative to regulate the normal operation of the autonomous floor-cleaning robot 10 and emergency sensing units 54 are operative to detect situations that could adversely affect the operation of the autonomous floor-cleaning robot 10 (e.g., stairs descending from the surface being cleaned) and provide signals in response to such detections so that the autonomous floor-cleaning robot 10 can implement an appropriate response via the control module 60. The control sensing units 52 and emergency sensing units 54 of the autonomous floor-cleaning robot 10 are summarily described in the following paragraphs; a more complete description can be found in commonly-owned, co-pending U.S. patent application Ser. No. 09/768,773, filed 24 Jan. 2001, entitled Robot Obstacle Detection System, Ser. No. 10/167,851, 12 Jun. 2002, entitled Method and System for Robot Localization and Confinement, and Ser. No. 10/056,804, filed 24 Jan. 2002, entitled Method and System for Multi-Mode Coverage for an Autonomous Robot.

The control sensing units 52 include obstacle detection sensors 52OD mounted in conjunction with the linearly-displaceable bumper arms 23BA of the displaceable bumper 23, a wall-sensing assembly 52WS mounted in the right-hand portion of the displaceable bumper 23, a virtual wall sensing assembly 52VWS mounted atop the displaceable bumper 23 along the fore-aft diameter of the autonomous floor-cleaning robot 10, and an IR sensor/encoder combination 52WE mounted in combination with each wheel subassembly 42A, 42B.

Each obstacle detection sensor 52OD includes an emitter and detector combination positioned in conjunction with one of the linearly displaceable bumper arms 23BA so that the sensor 52OD is operative in response to a displacement of the bumper arm 23BA to transmit a detection signal to the control module 60. The wall sensing assembly 52WS includes an emitter and detector combination that is operative to detect the proximity of a wall or other similar structure and transmit a detection signal to the control module 60. Each IR sensor/encoder combination 52WE is operative to measure the rotation of the associated wheel subassembly 42A, 42B and transmit a signal corresponding thereto to the control module 60.

The virtual wall sensing assembly 52VWS includes detectors that are operative to detect a force field and a collimated beam emitted by a stand-alone emitter (the virtual wall unit—not illustrated) and transmit respective signals to the control module 60. The autonomous floor cleaning robot 10 is programmed not to pass through the collimated beam so that the virtual wall unit can be used to prevent the robot 10 from entering prohibited areas, e.g., access to a descending staircase, room not to be cleaned. The robot 10 is further programmed to avoid the force field emitted by the virtual wall unit, thereby preventing the robot 10 from overrunning the virtual wall unit during floor cleaning operations.

The emergency sensing units 54 include 'cliff detector' assemblies 54CD mounted in the displaceable bumper 23, wheeldrop assemblies 54WD mounted in conjunction with the left and right main wheel subassemblies 42A, 42B and the nose-wheel assembly 24, and current stall sensing units 54CS for the motor 42A$_M$, 42B$_M$ of each main wheel subassembly 42A, 42B and one for the motors 44, 48 (these two motors are powered via a common circuit in the described embodiment). For the described embodiment of the autonomous floor-cleaning robot 10, four (4) cliff detector assemblies 54CD are mounted in the displaceable bumper 23. Each cliff detector assembly 54CD includes an emitter and detector combination that is operative to detect a predetermined drop in the path of the robot 10, e.g., descending stairs, and transmit a signal to the control module 60. The wheeldrop assemblies 54WD are operative to detect when the corresponding left and right main wheel subassemblies 32A, 32B and/or the nose-wheel assembly 24 enter the extended position, e.g., a contact switch, and to transmit a corresponding signal to the control module 60. The current stall sensing units 54CS are operative to detect a change in the current in the respective motor, which indicates a stalled condition of the motor's corresponding components, and transmit a corresponding signal to the control module 60.

The control module 60 comprises the control circuitry (see, e.g., control lines 60-4, 60-5, 60-7, and 60-8 in FIG. 1) and microcontroller for the autonomous floor-cleaning robot 10 that controls the movement of the robot 10 during floor cleaning operations and in response to signals generated by the sensor subsystem 50. The control module 60 of the autonomous floor-cleaning robot 10 according to the present invention is preprogrammed (hardwired, software, firmware, or combinations thereof) to implement three basic operational modes, i.e., movement patterns, that can be categorized as: (1) a "spot-coverage" mode; (2) a "wall/obstacle following" mode; and (3) a "bounce" mode. In addition, the control module 60 is preprogrammed to initiate actions based upon signals received from sensor subsystem 50, where such actions include, but are not limited to, implementing movement patterns (2) and (3), an emergency stop of the robot 10, or issuing an audible alert. Further details regarding the operation of the robot 10 via the control module 60 are described in detail in commonly-owned, co-pending U.S. patent application Ser. No. 09/768,773, filed 24 Jan. 2001, entitled Robot Obstacle Detection System, Ser. No. 10/167,851, filed 12 Jun. 2002, entitled Method and System for Robot Localization and Confinement, and Ser. No. 10/056,804, filed 24 Jan. 2002, entitled Method and System for Multi-Mode Coverage for an Autonomous Robot.

The side brush assembly 70 is operative to entrain macroscopic and microscopic particulates outside the periphery of the housing infrastructure 20 of the autonomous floor-cleaning robot 10 and to direct such particulates towards the self-adjusting cleaning head subsystem 80. This provides the robot 10 with the capability of cleaning surfaces adjacent to baseboards (during the wall-following mode).

The side brush assembly 70 is mounted in a recess formed in the lower surface of the right forward quadrant of the chassis 21 (forward of the right main wheel subassembly 42A just behind the right hand end of the displaceable bumper 23). The side brush assembly 70 comprises a shaft 72 having one end rotatably connected to the electric motor 44 for torque transfer, a hub 74 connected to the other end of the shaft 72, a cover plate 75 surrounding the hub 74, a brush means 76 affixed to the hub 74, and a set of bristles 78.

The cover plate 75 is configured and secured to the chassis 21 to encompass the hub 74 in a manner that prevents the brush means 76 from becoming stuck under the chassis 21 during floor cleaning operations.

Figure 3A:
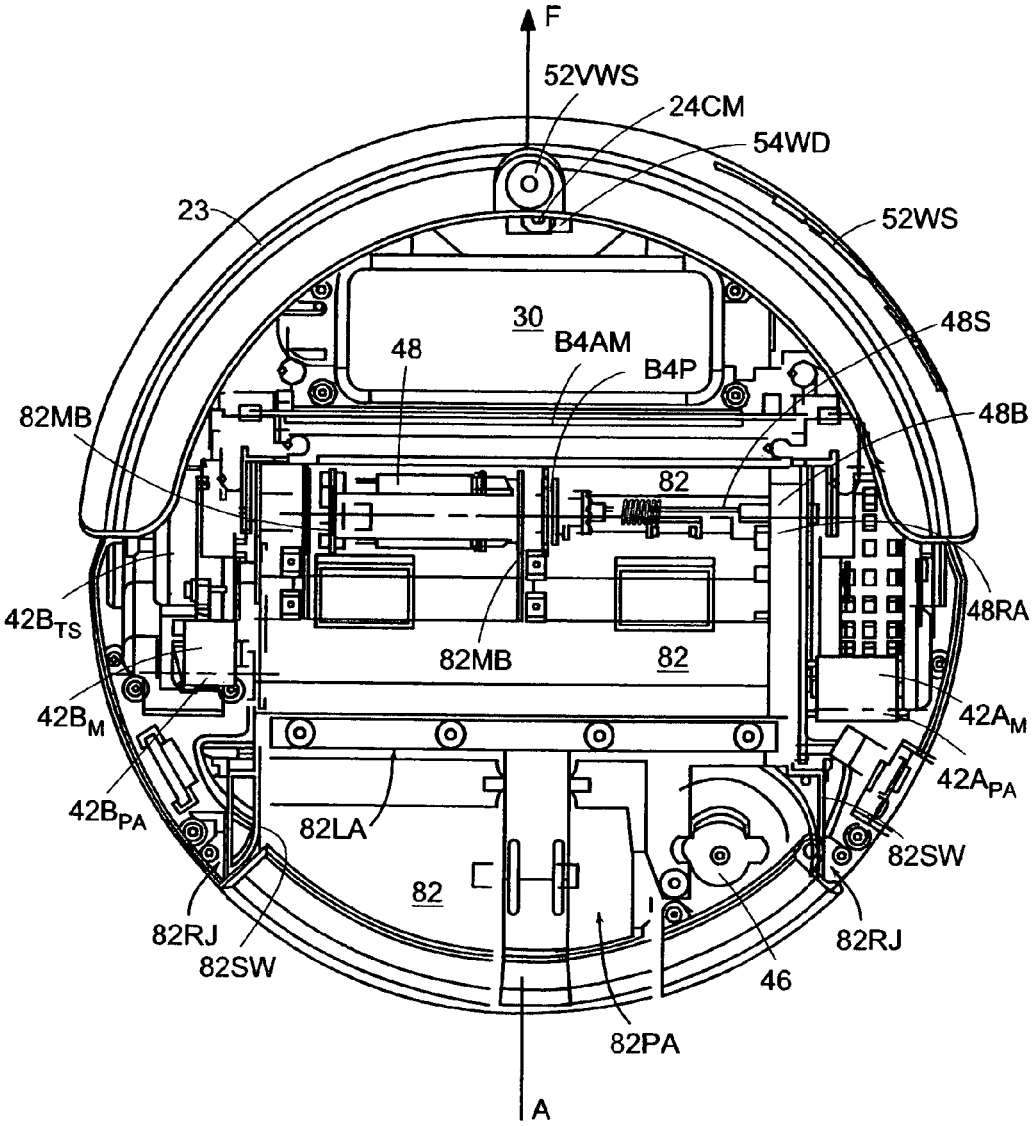
FIG. 3A is a top, partially-sectioned plan view, with cover removed, of another embodiment of an autonomous floor-cleaning robot according to the present invention.
Figure 3B:
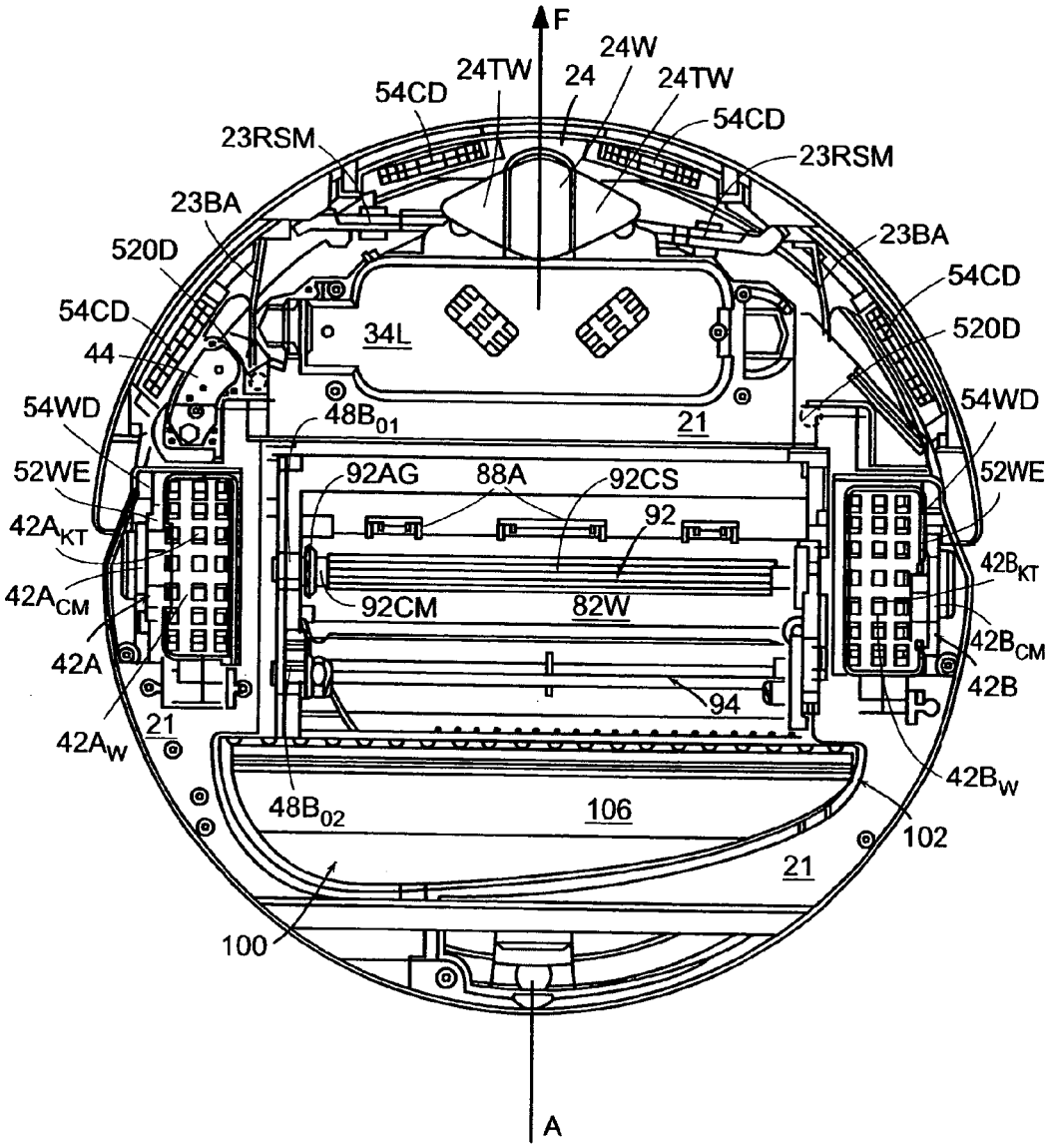
FIG. 3B is a bottom, partially-section plan view of the autonomous floor-cleaning robot embodiment of FIG. 3A.
Figure 3C:
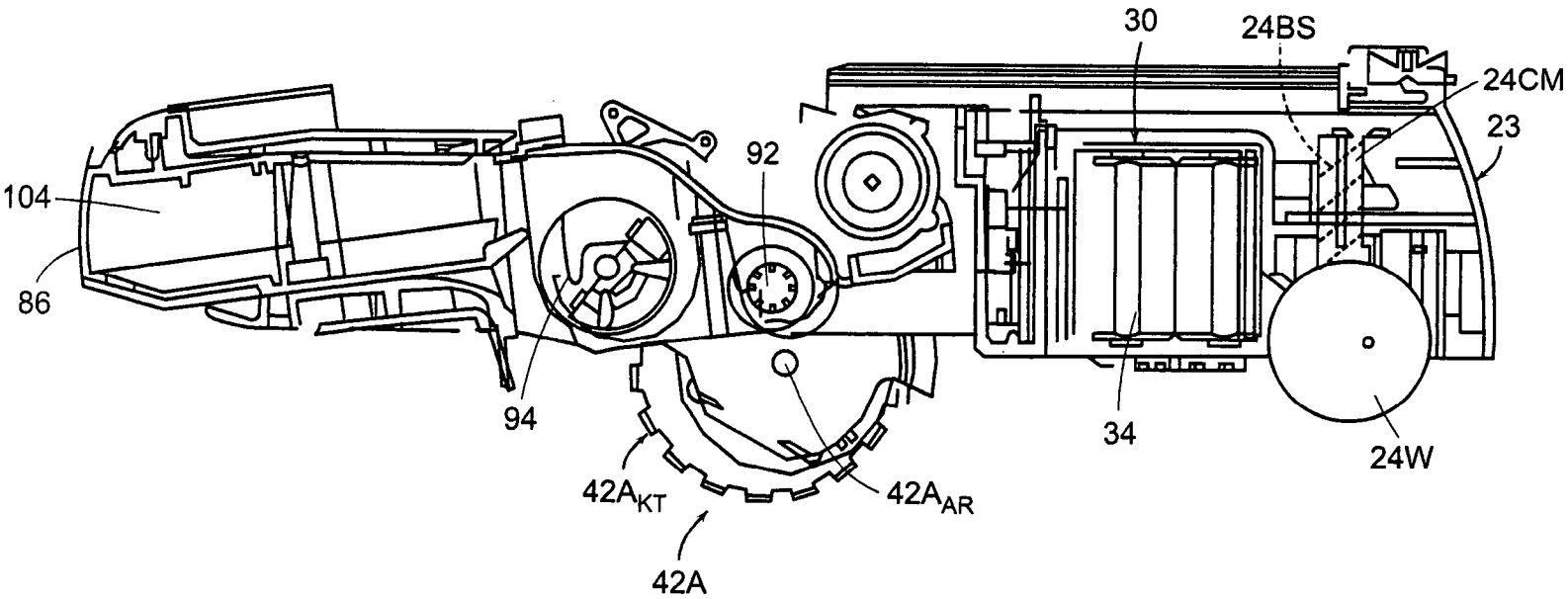
FIG. 3C is a side, partially sectioned plan view of the autonomous floor-cleaning robot embodiment of FIG. 3A.

For the embodiment of FIGS. 3A-3C, the brush means 76 comprises opposed brush arms that extend outwardly from the hub 74. These brush arms 76 are formed from a compliant plastic or rubber material in an "L"/hockey stick configuration of constant width. The configuration and composition of the brush arms 76, in combination, allows the brush arms 76 to resiliently deform if an obstacle or obstruction is temporarily encountered during cleaning operations. Concomitantly, the use of opposed brush arms 76 of constant width is a trade-off (versus using a full or partial circular brush configuration) that ensures that the operation of the brush means 76 of the side brush assembly 70 does not adversely impact (i.e., by occlusion) the operation of the adjacent cliff detector subassembly 54CD (the left-most cliff detector subassembly 54CD in FIG. 3B) in the displaceable bumper 23. The brush arms 76 have sufficient length to extend beyond the outer periphery of the autonomous floor-cleaning robot 10, in particular the displaceable bumper 23 thereof. Such a length allows the autonomous floor-cleaning robot 10 to clean surfaces adjacent to baseboards (during the wall-following mode) without scrapping of the wall/baseboard by the chassis 21 and/or displaceable bumper 23 of the robot 10.

The set of bristles 78 is set in the outermost free end of each brush arm 76 (similar to a toothbrush configuration) to provide the sweeping capability of the side brush assembly 70. The bristles 78 have a length sufficient to engage the surface being cleaned with the main wheel subassemblies 42A, 42B and the nose-wheel subassembly 24 in the operating position.

The self-adjusting cleaning head subsystem 80 provides the cleaning mechanisms for the autonomous floor-cleaning robot 10 according to the present invention. The cleaning mechanisms for the preferred embodiment of the self-adjusting cleaning head subsystem 80 include a brush assembly 90 and a vacuum assembly 100.

For the described embodiment of FIGS. 3A-3C, the brush assembly 90 is a dual-stage brush mechanism, and this dual-stage brush assembly 90 and the vacuum assembly 100 are independent cleaning mechanisms, both structurally and functionally, that have been adapted and designed for use in the robot 10 to minimize the over-all power requirements of the robot 10 while simultaneously providing an effective cleaning capability. In addition to the cleaning mechanisms described in the preceding paragraph, the self-adjusting cleaning subsystem 80 includes a deck structure 82 pivotally coupled to the chassis 21, an automatic deck adjusting subassembly 84, a removable dust cartridge 86, and one or more bails 88 shielding the dual-stage brush assembly 90.

The deck 82 is preferably fabricated as a unitary structure from a material such as plastic and includes opposed, spaced-apart sidewalls 82SW formed at the aft end of the deck 82 (one of the sidewalls 82SW comprising a U-shaped structure that houses the motor 46, a brush-assembly well 82W, a lateral aperture 82LA formed in the intermediate portion of the lower deck surface, which defines the opening between the dual-stage brush assembly 90 and the removable dust cartridge 86, and mounting brackets 82MB formed in the forward portion of the upper deck surface for the motor 48.

The sidewalls 82SW are positioned and configured for mounting the deck 82 in pivotal combination with the chassis 21 by a conventional means, e.g., a revolute joint (see reference characters 82RJ in FIG. 3A). The pivotal axis of the deck 82-chassis 21 combination is perpendicular to the fore—aft axis FA of the autonomous floor-cleaning robot 10 at the aft end of the robot 10 (see reference character $\mathbf{82}_{PA}$ which identifies the pivotal axis in FIG. 3A).

The mounting brackets 82MB are positioned and configured for mounting the constant-torque motor 48 at the forward lip of the deck 82. The rotational axis of the mounted motor 48 is perpendicular to the fore-aft diameter of the autonomous floor-cleaning robot 10 (see reference character 48RA which identifies the rotational axis of the motor 48 in FIG. 3A). Extending from the mounted motor 48 is an shaft 48S for transferring the constant torque to the input side of a stationary, conventional dual-output gearbox 48B (the housing of the dual-output gearbox 48B is fabricated as part of the deck 82).

Figure 4A:
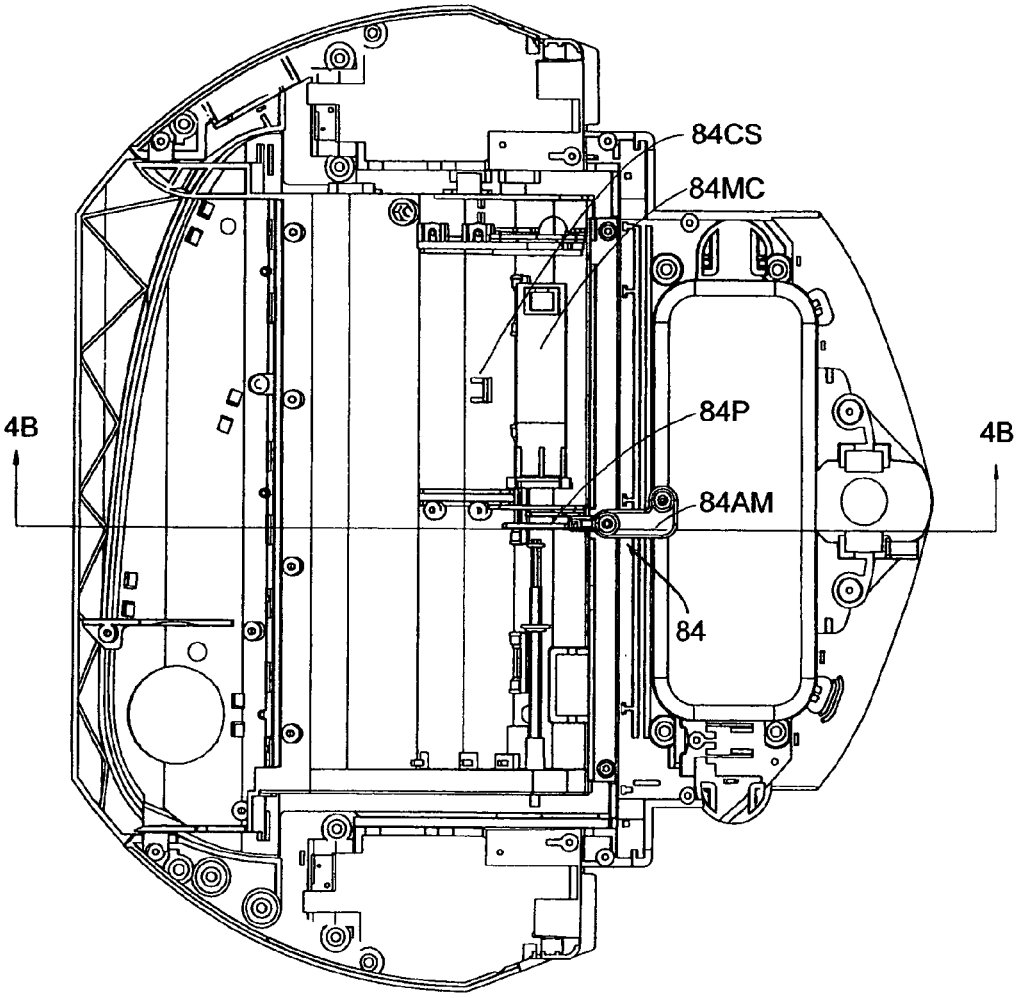
FIG. 4A is a top plan view of the deck and chassis of the autonomous floor-cleaning robot embodiment of FIG. 3A.
Figure 4B:
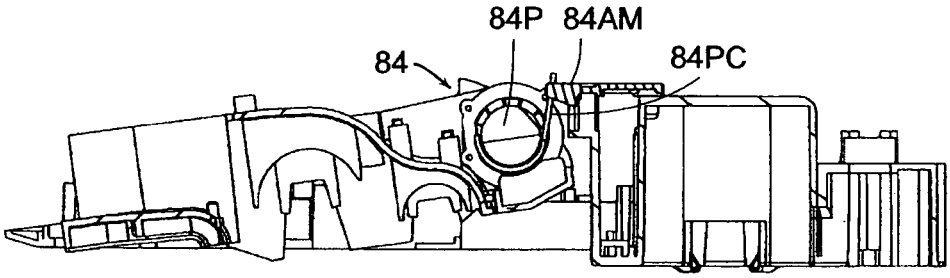
FIG. 4B is a cross-sectional view of FIG. 4A taken along line B-B thereof.
Figure 4C:
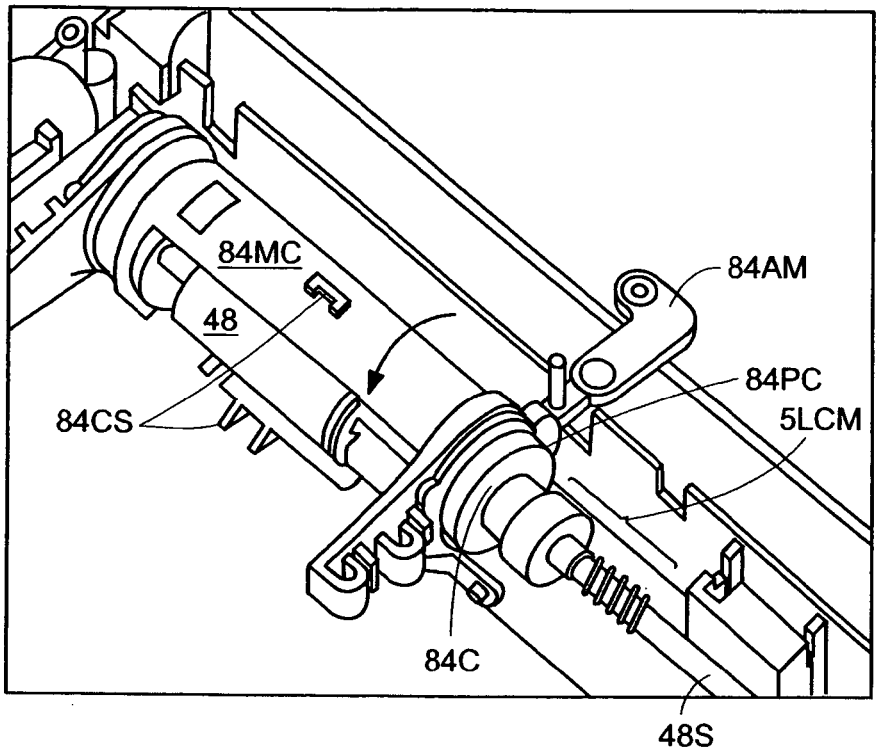
FIG. 4C is a perspective view of the deck-adjusting subassembly of autonomous floor-cleaning robot embodiment of FIG. 3A.

The desk adjusting subassembly 84, which is illustrated in further detail in FIGS. 4A-4C, is mounted in combination with the motor 48, the deck 82 and the chassis 21 and operative, in combination with the electric motor 48, to provide the physical mechanism and motive force, respectively, to pivot the deck 82 with respect to the chassis 21 about pivotal axis $\mathbf{82}_{PA}$ whenever the dual-stage brush assembly 90 encounters a situation that results in a predetermined reduction in the rotational speed of the dual-stage brush assembly 90. This situation, which most commonly occurs as the autonomous floor-cleaning robot 10 transitions between a smooth surface such as a floor and a carpeted surface, is characterized as the 'adjustment mode' in the remainder of this description.

The deck adjusting subassembly 84 for the described embodiment of FIG. 3A includes a motor cage 84MC, a pulley 84P, a pulley cord 84C, an anchor member 84AM, and complementary cage stops 84CS. The motor 48 is non-rotatably secured within the motor cage 84MC and the motor cage 84MC is mounted in rotatable combination between the mounting brackets 82MB. The pulley 84P is fixedly secured to the motor cage 84MC on the opposite side of the interior mounting bracket 82MB in such a manner that the shaft 48S of the motor 48 passes freely through the center of the pulley 84P. The anchor member 84AM is fixedly secured to the top surface of the chassis 21 in alignment with the pulley 84P.

One end of the pulley cord 84C is secured to the anchor member 84AM and the other end is secured to the pulley 84P in such a manner, that with the deck 82 in the 'down' or non-pivoted position, the pulley cord 84C is tensioned. One of the cage stops 84CS is affixed to the motor cage 84MC; the complementary cage stop 84CS is affixed to the deck 82. The complementary cage stops 84CS are in abutting engagement when the deck 82 is in the 'down' position during normal cleaning operations due to the weight of the self-adjusting cleaning head subsystem 80.

During normal cleaning operations, the torque generated by the motor 48 is transferred to the dual-stage brush subassembly 90 by means of the shaft 48S through the dual-output gearbox 48B. The motor cage assembly is prevented from rotating by the counter-acting torque generated by the pulley cord 84C on the pulley 84P. When the resistance encountered by the rotating brushes changes, the deck height will be adjusted to compensate for it. If for example, the brush torque increases as the machine rolls from a smooth floor onto a carpet, the torque output of the motor 48 will increase. In response to this, the output torque of the motor 48 will increase. This increased torque overcomes the counter-acting torque exerted by the pulley cord 84C on the pulley 84P. This causes the pulley 84P to rotate, effectively pulling itself up the pulley cord 84C. This in turn, pivots the deck about the pivot axis, raising the brushes, reducing the friction between the brushes and the floor, and reducing the torque required by the dual-stage brush subassembly 90. This continues until the torque between the motor 48 and the counter-acting torque generated by the pulley cord 84C on the pulley 84P are once again in equilibrium and a new deck height is established.

In other words, during the adjustment mode, the foregoing torque transfer mechanism is interrupted since the shaft 48S is essentially stationary. This condition causes the motor 48 to effectively rotate about the shaft 48S. Since the motor 48 is non-rotatably secured to the motor cage 84MC, the motor cage 84MC, and concomitantly, the pulley 84P, rotate with respect to the mounting brackets 82MB. The rotational motion imparted to the pulley 84P causes the pulley 84P to 'climb up' the pulley cord 84PC towards the anchor member 84AM. Since the motor cage 84MC is effectively mounted to the forward lip of the deck 82 by means of the mounting brackets 82MB, this movement of the pulley 84P causes the deck 82 to pivot about its pivot axis 82PA to an "up" position (see FIG. 4C). This pivoting motion causes the forward portion of the deck 82 to move away from surface over which the autonomous floor-cleaning robot is traversing.

Such pivotal movement, in turn, effectively moves the dual-stage brush assembly 90 away from the surface it was in contact with, thereby permitting the dual-stage brush assembly 90 to speed up and resume a steady-state rotational speed (consistent with the constant torque transferred from the motor 48). At this juncture (when the dual-stage brush assembly 90 reaches its steady-state rotational speed), the weight of the forward edge of the deck 82 (primarily the motor 48), gravitationally biases the deck 82 to pivot back to the 'down' or normal state, i.e., planar with the bottom surface of the chassis 21, wherein the complementary cage stops 84CS are in abutting engagement.

While the deck adjusting subassembly 84 described in the preceding paragraphs is the preferred pivoting mechanism for the autonomous floor-cleaning robot 10 according to the present invention, one skilled in the art will appreciate that other mechanisms can be employed to utilize the torque developed by the motor 48 to induce a pivotal movement of the deck 82 in the adjustment mode. For example, the deck adjusting subassembly could comprise a spring-loaded clutch mechanism such as that shown in FIG. 4C (identified by reference characters SLCM) to pivot the deck 82 to an "up" position during the adjustment mode, or a centrifugal clutch mechanism or a torque-limiting clutch mechanism. In other embodiments, motor torque can be used to adjust the height of the cleaning head by replacing the pulley with a cam and a constant force spring or by replacing the pulley with a rack and pinion, using either a spring or the weight of the cleaning head to generate the counter-acting torque.

The removable dust cartridge 86 provides temporary storage for macroscopic and microscopic particulates swept up by operation of the dual-stage brush assembly 90 and microscopic particulates drawn in by the operation of the vacuum assembly 100. The removable dust cartridge 86 is configured as a dual chambered structure, having a first storage chamber 86SC1 for the macroscopic and microscopic particulates swept up by the dual-stage brush assembly 90 and a second storage chamber 86SC2 for the microscopic particulates drawn in by the vacuum assembly 100. The removable dust cartridge 86 is further configured to be inserted in combination with the deck 82 so that a segment of the removable dust cartridge 86 defines part of the rear external sidewall structure of the autonomous floor-cleaning robot 10.

Figure 5A:
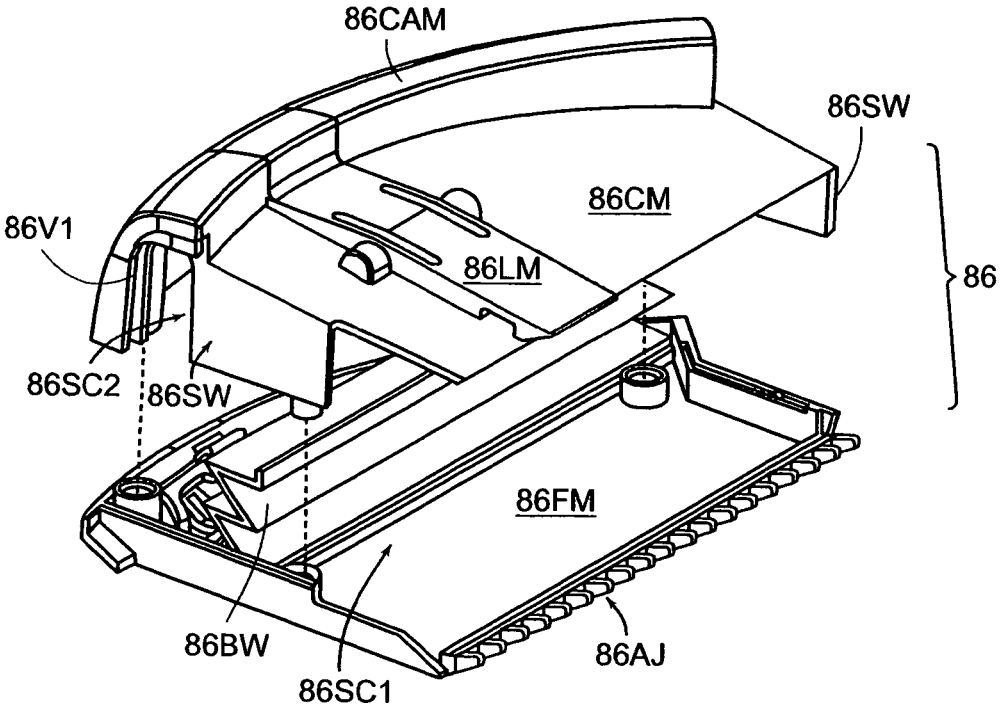
FIG. 5A is a first exploded perspective view of a dust cartridge for the autonomous floor-cleaning robot embodiment of FIG. 3A.
Figure 5B:
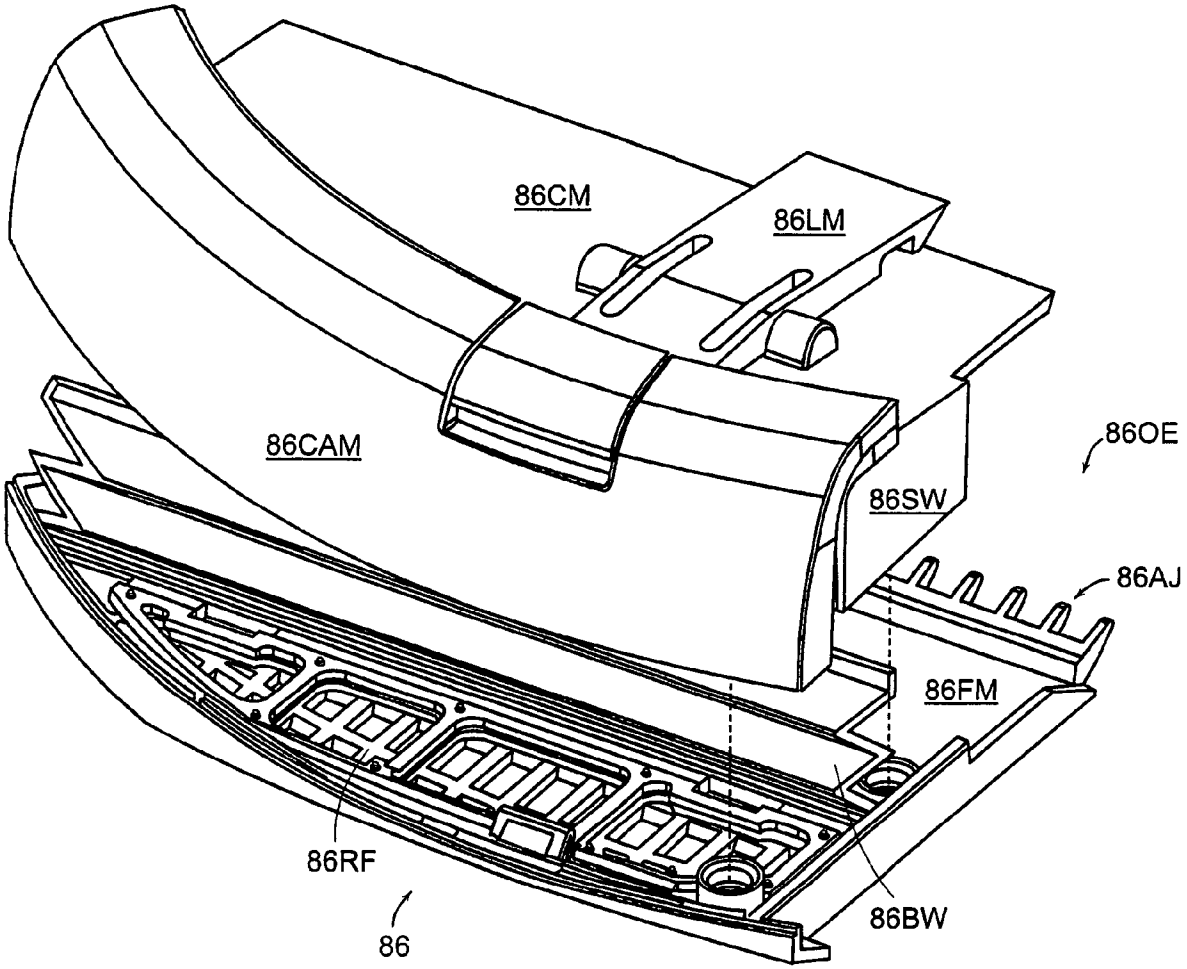
FIG. 5B is a second exploded perspective view of the dust cartridge of FIG. 5A.

As illustrated in FIGS. 5A-5B, the removable dust cartridge 86 comprises a floor member 86FM and a ceiling member 86CM joined together by opposed sidewall members 86SW. The floor member 86FM and the ceiling member 86CM extend beyond the sidewall members 86SW to define an open end 860E, and the free end of the floor member 86FM is slightly angled and includes a plurality of baffled projections 86AJ to remove debris entrained in the brush mechanisms of the dual-stage brush assembly 90, and to facilitate insertion of the removable dust cartridge 86 in combination with the deck 82 as well as retention of particulates swept into the removable dust cartridge 86. A backwall member 86BW is mounted between the floor member 86FM and the ceiling member 86CM distal the open end 860E in abutting engagement with the sidewall members 86SW. The backwall member 86BW has an baffled configuration for the purpose of deflecting particulates angularly therefrom to prevent particulates swept up by the dual-stage brush assembly 90 from ricocheting back into the brush assembly 90. The floor member 86FM, the ceiling member 86CM, the sidewall members 86SW, and the backwall member 86BW in combination define the first storage chamber 86SC1.

The removable dust cartridge 86 further comprises a curved arcuate member 86CAM that defines the rear external sidewall structure of the autonomous floor-cleaning robot 10. The curved arcuate member 86CAM engages the ceiling member 86CM, the floor member 86F and the sidewall members 86SW. There is a gap formed between the curved arcuate member 86CAM and one sidewall member 86SW that defines a vacuum inlet 86VI for the removable dust cartridge 86. A replaceable filter 86RF is configured for snap fit insertion in combination with the floor member 86FM. The replaceable filter 86RF, the curved arcuate member 86CAM, and the backwall member 86BW in combination define the second storage chamber 86SC1.

The removable dust cartridge 86 is configured to be inserted between the opposed spaced-apart sidewalls 82SW of the deck 82 so that the open end of the removable dust cartridge 86 aligns with the lateral aperture 82LA formed in the deck 82. Mounted to the outer surface of the ceiling member 86CM is a latch member 86LM, which is operative to engage a complementary shoulder formed in the upper surface of the deck 82 to latch the removable dust cartridge 86 in integrated combination with the deck 82.

The bail 88 comprises one or more narrow gauge wire structures that overlay the dual-stage brush assembly 90. For the described embodiment, the bail 88 comprises a continuous narrow gauge wire structure formed in a castellated configuration, i.e., alternating open-sided rectangles. Alternatively, the bail 88 may comprise a plurality of single, open-sided rectangles formed from narrow gauge wire. The bail 88 is designed and configured for press fit insertion into complementary retaining grooves 88A, 88B, respectively, formed in the deck 82 immediately adjacent both sides of the dual-stage brush assembly 90. The bail 88 is operative to shield the dual-stage brush assembly 90 from larger external objects such as carpet tassels, tufted fabric, rug edges, during cleaning operations, i.e., the bail 88 deflects such objects away from the dual-stage brush assembly 90, thereby preventing such objects from becoming entangled in the brush mechanisms.

Figure 6:
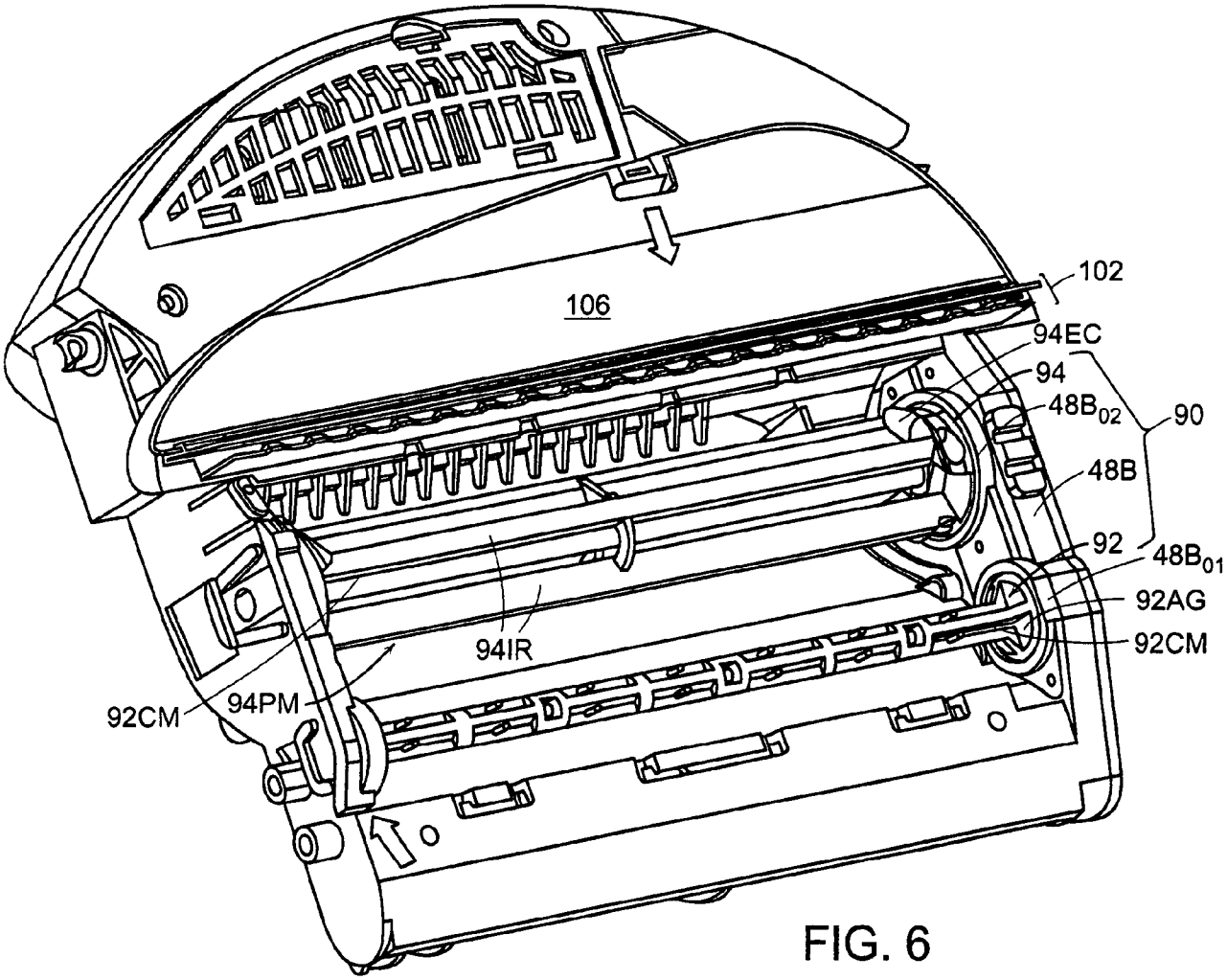
FIG. 6 is a perspective view of a dual-stage brush assembly including a flapper brush and a main brush for the autonomous floor-cleaning robot embodiment of FIG. 3A.

The dual-stage brush assembly 90 for the described embodiment of FIG. 3A comprises a flapper brush 92 and a main brush 94 that are generally illustrated in FIG. 6. Structurally, the flapper brush 92 and the main brush 94 are asymmetric with respect to one another, with the main brush 94 having an O.D. greater than the O.D. of the flapper brush 92. The flapper brush 92 and the main brush 94 are mounted in the deck 82 recess, as described below in further detail, to have minimal spacing between the sweeping peripheries defined by their respective rotating elements. Functionally, the flapper brush 92 and the main brush 94 counter-rotate with respect to one another, with the flapper brush 92 rotating in a first direction that causes macroscopic particulates to be directed into the removable dust cartridge 86 and the main brush 94 rotating in a second direction, which is opposite to the forward movement of the autonomous floor-cleaning robot 10, that causes macroscopic and microscopic particulates to be directed into the removable dust cartridge 86. In addition, this rotational motion of the main brush 94 has the secondary effect of directing macroscopic and microscopic particulates towards the pick-up zone of the vacuum assembly 100 such that particulates that are not swept up by the dual-stage brush assembly 90 can be subsequently drawn up (ingested) by the vacuum assembly 100 due to movement of the autonomous floor-cleaning robot 10.

The flapper brush 92 comprises a central member 92CM having first and second ends. The first and second ends are designed and configured to mount the flapper brush 92 in rotatable combination with the deck 82 and a first output port 48$B_{O1}$ of the dual output gearbox 48B, respectively, such that rotation of the flapper brush 92 is provided by the torque transferred from the electric motor 48 (the gearbox 48B is configured so that the rotational speed of the flapper brush 92 is relative to the speed of the autonomous floor-cleaning robot 10—the described embodiment of the robot 10 has a top speed of approximately 0.9 ft/sec). In other embodiments, the flapper brush 92 rotates substantially faster than traverse speed either in relation or not in relation to the transverse speed. Axle guards 92AG having a beveled configuration are integrally formed adjacent the first and second ends of the central member 92CM for the purpose of forcing hair and other similar matter away from the flapper brush 92 to prevent such matter from becoming entangled with the ends of the central member 92CM and stalling the dual-stage brush assembly 90.

The brushing element of the flapper brush 92 comprises a plurality of segmented cleaning strips 92CS formed from a compliant plastic material secured to and extending along the central member 92CM between the internal ends of the axle guards 92AG (for the illustrated embodiment, a sleeve, configured to fit over and be secured to the central member 92CM, has integral segmented strips extending outwardly therefrom). It was determined that arranging these segmented cleaning strips 92CS in a herringbone or chevron pattern provided the optimal cleaning utility (capability and noise level) for the dual-stage brush subassembly 90 of the autonomous floor-cleaning robot 10 according to the present invention. Arranging the segmented cleaning strips 92CS in the herringbone/chevron pattern caused macroscopic particulate matter captured by the strips 92CS to be circulated to the center of the flapper brush 92 due to the rotation thereof. It was determined that cleaning strips arranged in a linear/straight pattern produced a irritating flapping noise as the brush was rotated. Cleaning strips arranged in a spiral pattern circulated captured macroscopic particulates towards the ends of brush, which resulted in particulates escaping the sweeping action provided by the rotating brush.

For the described embodiment, six (6) segmented cleaning strips 92CS were equidistantly spaced circumferentially about the central member 92CM in the herringbone/chevron pattern. One skilled in the art will appreciate that more or less segmented cleaning strips 92CS can be employed in the flapper brush 90 without departing from the scope of the present invention. Each of the cleaning strips 92S is segmented at prescribed intervals, such segmentation intervals depending upon the configuration (spacing) between the wire(s) forming the bail 88. The embodiment of the bail 88 described above resulted in each cleaning strip 92CS of the described embodiment of the flapper brush 92 having five (5) segments.

The main brush 94 comprises a central member 94CM (for the described embodiment the central member 94CM is a round metal member having a spiral configuration) having first and second straight ends (i.e., aligned along the centerline of the spiral). Integrated in combination with the central member 94CM is a segmented protective member 94PM. Each segment of the protective member 94PM includes opposed, spaced-apart, semi-circular end caps 94EC having integral ribs 941R extending therebetween. For the described embodiment, each pair of semi-circular end caps EC has two integral ribs extending therebetween. The protective member 94PM is assembled by joining complementary semi-circular end caps 94EC by any conventional means, e.g., screws, such that assembled complementary end caps 94EC have a circular configuration.

The protective member 94PM is integrated in combination with the central member 94CM so that the central member 94CM is disposed along the centerline of the protective member 94PM, and with the first end of the central member 94CM terminating in one circular end cap 94EC and the second end of the central member 94CM extending through the other circular end cap 94EC. The second end of the central member 94CM is mounted in rotatable combination with the deck 82 and the circular end cap 94EC associated with the first end of the central member 94CM is designed and configured for mounting in rotatable combination with the second output port 48$B_{O2}$ of the gearbox 48B such that the rotation of the main brush 94 is provided by torque transferred from the electric motor 48 via the gearbox 48B.

Bristles 94B are set in combination with the central member 94CM to extend between the integral ribs 941R of the protective member 94PM and beyond the O.D. established by the circular end caps 94EC. The integral ribs 941R are configured and operative to impede the ingestion of matter such as rug tassels and tufted fabric by the main brush 94.

The bristles 94B of the main brush 94 can be fabricated from any of the materials conventionally used to form bristles for surface cleaning operations. The bristles 94B of the main brush 94 provide an enhanced sweeping capability by being specially configured to provide a "flicking" action with respect to particulates encountered during cleaning operations conducted by the autonomous floor-cleaning robot 10 according to the present invention. For the described embodiment, each bristle 94B has a diameter of approximately 0.010 inches, a length of approximately 0.90 inches, and a free end having a rounded configuration. It has been determined that this configuration provides the optimal flicking action. While bristles having diameters exceeding approximately 0.014 inches would have a longer wear life, such bristles are too stiff to provide a suitable flicking action in the context of the dual-stage brush assembly 90 of the present invention. Bristle diameters that are much less than 0.010 inches are subject to premature wear out of the free ends of such bristles, which would cause a degradation in the sweeping capability of the main brush. In a preferred embodiment, the main brush is set slightly lower than the flapper brush to ensure that the flapper does not contact hard surface floors.

The vacuum assembly 100 is independently powered by means of the electric motor 46. Operation of the vacuum assembly 100 independently of the self-adjustable brush assembly 90 allows a higher vacuum force to be generated and maintained using a battery-power source than would be possible if the vacuum assembly were operated in dependence with the brush system. In other embodiments, the main brush motor can drive the vacuum. Independent operation is used herein in the context that the inlet for the vacuum assembly 100 is an independent structural unit having dimensions that are not dependent upon the "sweep area" defined by the dual-stage brush assembly 90.

Figure 7A:
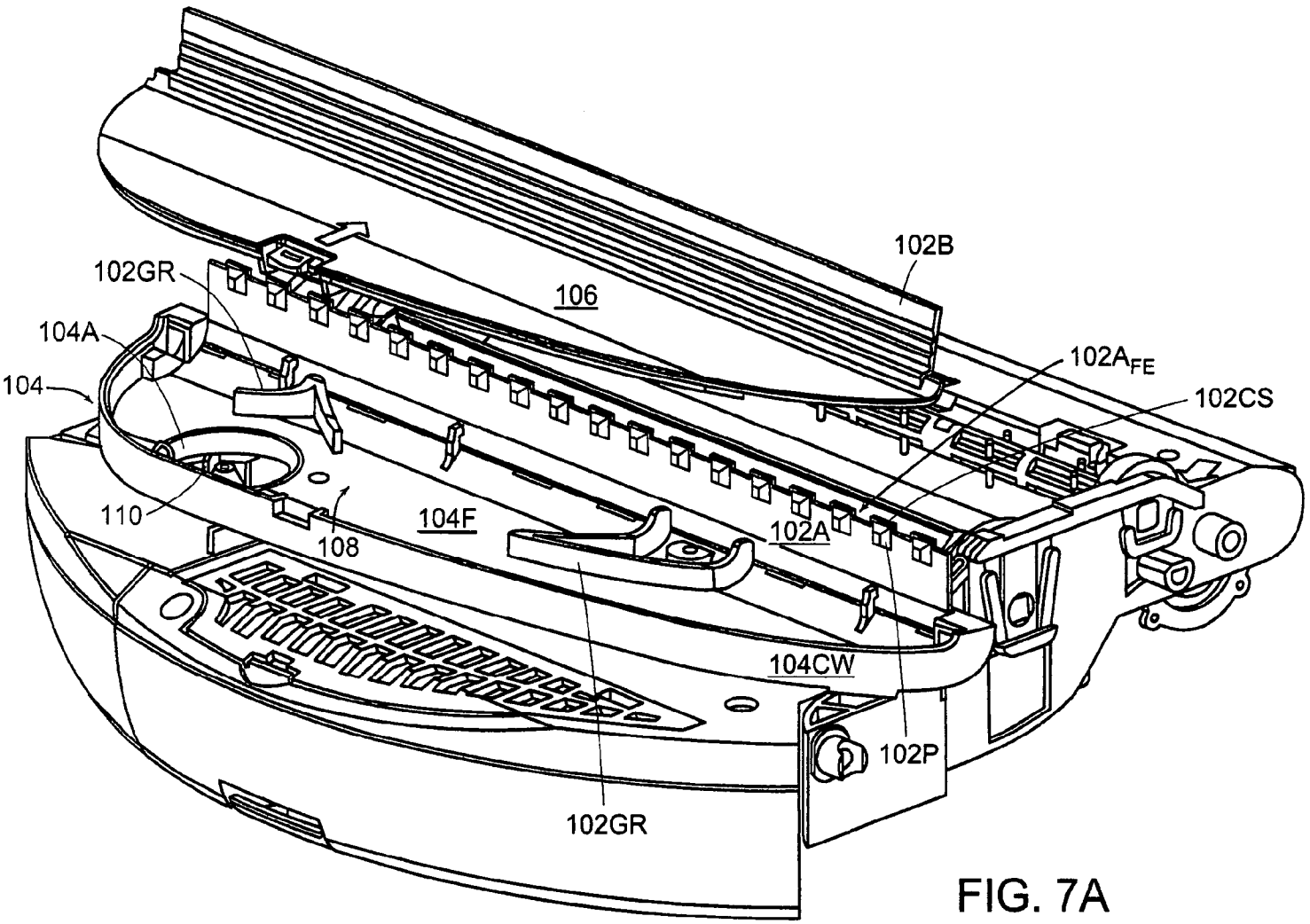
FIG. 7A is a perspective view illustrating the blades and vacuum compartment for the autonomous floor cleaning robot embodiment of FIG. 3A.
Figure 7B:
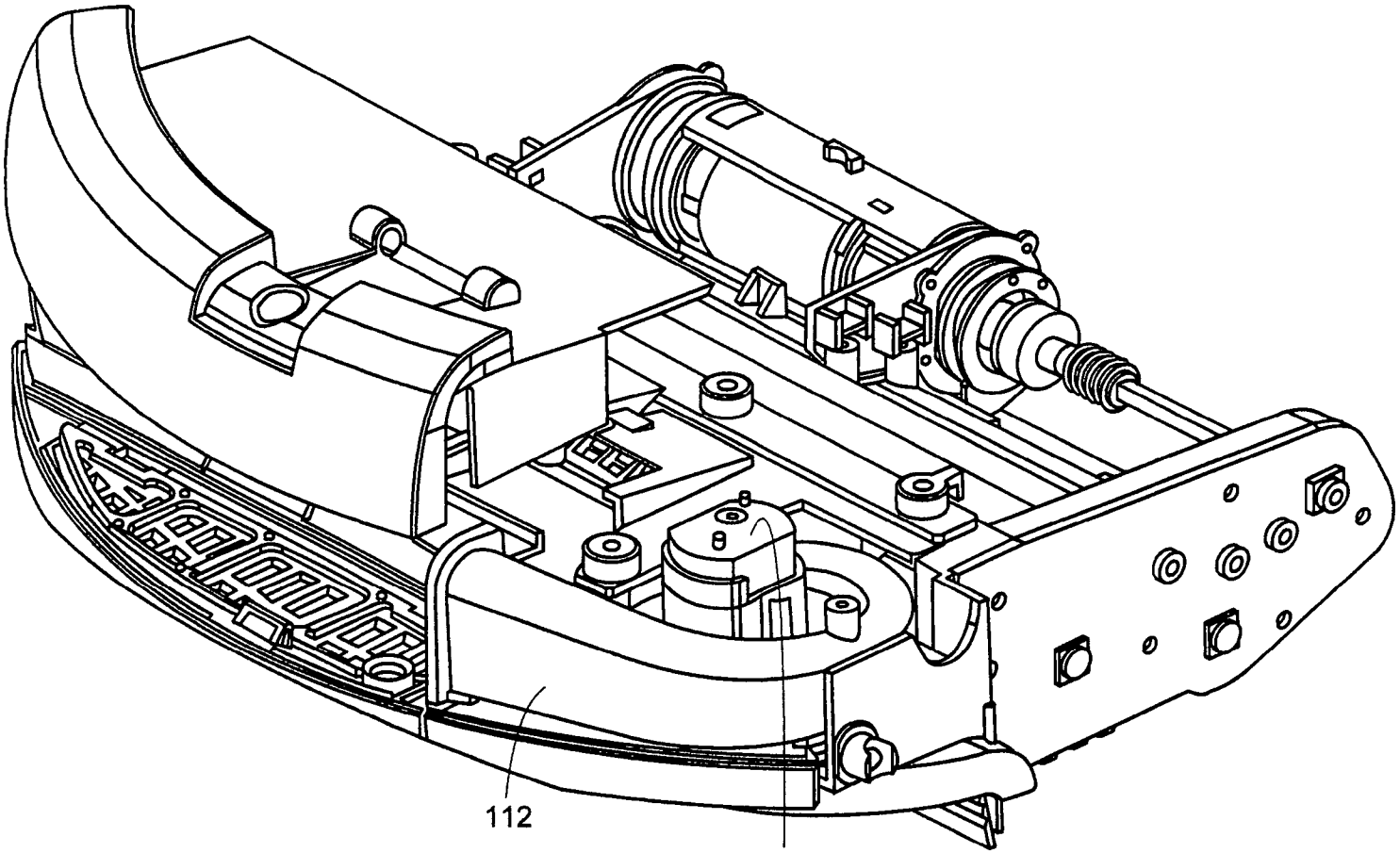
FIG. 7B is a partial perspective exploded view of the autonomous floor-cleaning robot embodiment of FIG. 7A.

The vacuum assembly 100, which is located immediately aft of the dual-stage brush assembly 90, i.e., a trailing edge vacuum, is orientated so that the vacuum inlet is immediately adjacent the main brush 94 of the dual-stage brush assembly 90 and forward facing, thereby enhancing the ingesting or vacuuming effectiveness of the vacuum assembly 100. With reference to FIGS. 7A, 7B, the vacuum assembly 100 comprises a vacuum inlet 102, a vacuum compartment 104, a compartment cover 106, a vacuum chamber 108, an impeller 110, and vacuum channel 112. The vacuum inlet 102 comprises first and second blades 102A, 102B formed of a semi-rigid/compliant plastic or elastomeric material, which are configured and arranged to provide a vacuum inlet 102 of constant size (lateral width and gap-see discussion below), thereby ensuring that the vacuum assembly 100 provides a constant air inflow velocity, which for the described embodiment is approximately 4 m/sec.

The first blade 102A has a generally rectangular configuration, with a width (lateral) dimension such that the opposed ends of the first blade 102A extend beyond the lateral dimension of the dual-stage brush assembly 90. One lateral edge of the first blade 102A is attached to the lower surface of the deck 82 immediately adjacent to but spaced apart from, the main brush 94 (a lateral ridge formed in the deck 82 provides the separation therebetween, in addition to embodying retaining grooves for the bail 88 as described above) in an orientation that is substantially symmetrical to the fore-aft diameter of the autonomous floor-cleaning robot 10. This lateral edge also extends into the vacuum compartment 104 where it is in sealed engagement with the forward edge of the compartment 104. The first blade 102A is angled forwardly with respect to the bottom surface of the deck 82 and has length such that the free end 102$A_{FE}$ of the first blade 102A just grazes the surface to be cleaned.

The free end 102$A_{FE}$ has a castellated configuration that prevents the vacuum inlet 102 from pushing particulates during cleaning operations. Aligned with the castellated segments 102CS of the free end 102$A_{FE}$, which are spaced along the width of the first blade 102A, are protrusions 102P having a predetermined height. For the prescribed embodiment, the height of such protrusions 102P is approximately 2 mm. The predetermined height of the protrusions 102P defines the "gap" between the first and second blades 102A, 102B.

The second blade 102B has a planar, unitary configuration that is complementary to the first blade 102A in width and length. The second blade 102B, however, does not have a castellated free end; instead, the free end of the second blade 102B is a straight edge. The second blade 102B is joined in sealed combination with the forward edge of the compartment cover 106 and angled with respect thereto so as to be substantially parallel to the first blade 102A. When the compartment cover 106 is fitted in position to the vacuum compartment 104, the planar surface of the second blade 102B abuts against the plurality of protrusions 102P of the first blade 102A to form the "gap" between the first and second blades 102A, 102B.

The vacuum compartment 104, which is in fluid communication with the vacuum inlet 102, comprises a recess formed in the lower surface of the deck 82. This recess includes a compartment floor 104F and a contiguous compartment wall 104CW that delineates the perimeter of the vacuum compartment 104. An aperture 104A is formed through the floor 104, offset to one side of the floor 104F. Due to the location of this aperture 104A, offset from the geometric center of the compartment floor 104F, it is prudent to form several guide ribs 104GR that project upwardly from the compartment floor 104F. These guide ribs 104GR are operative to distribute air inflowing through the gap between the first and second blades 102A, 102B across the compartment floor 104 so that a constant air inflow is created and maintained over the entire gap, i.e., the vacuum inlet 102 has a substantially constant 'negative' pressure (with respect to atmospheric pressure).

The compartment cover 106 has a configuration that is complementary to the shape of the perimeter of the vacuum compartment 104. The cover 106 is further configured to be press fitted in sealed combination with the contiguous compartment wall 104CW wherein the vacuum compartment 104 and the vacuum cover 106 in combination define the vacuum chamber 108 of the vacuum assembly 100. The compartment cover 106 can be removed to clean any debris from the vacuum channel 112. The compartment cover 106 is preferable fabricated from a clear or smoky plastic material to allow the user to visually determine when clogging occurs.

The impeller 110 is mounted in combination with the deck 82 in such a manner that the inlet of the impeller 110 is positioned within the aperture 104A. The impeller 110 is operatively connected to the electric motor 46 so that torque is transferred from the motor 46 to the impeller 110 to cause rotation thereof at a constant speed to withdraw air from the vacuum chamber 108. The outlet of the impeller 110 is integrated in sealed combination with one end of the vacuum channel 112.

The vacuum channel 112 is a hollow structural member that is either formed as a separate structure and mounted to the deck 82 or formed as an integral part of the deck 82. The other end of the vacuum channel 110 is integrated in sealed combination with the vacuum inlet 86W of the removable dust cartridge 86. The outer surface of the vacuum channel 112 is complementary in configuration to the external shape of curved arcuate member 86CAM of the removable dust cartridge 86.

A variety of modifications and variations of the present invention are possible in light of the above teachings. For example, the preferred embodiment described above included a cleaning head subsystem 80 that was self-adjusting, i.e., the deck 82 was automatically pivotable with respect to the chassis 21 during the adjustment mode in response to a predetermined increase in brush torque of the dual-stage brush assembly 90. It will be appreciated that another embodiment of the autonomous floor-cleaning robot according to the present invention is as described hereinabove, with the exception that the cleaning head subsystem is non-adjustable, i.e., the deck is non-pivotable with respect to the chassis. This embodiment would not include the deck adjusting subassembly described above, i.e., the deck would be rigidly secured to the chassis. Alternatively, the deck could be fabricated as an integral part of the chassis—in which case the deck would be a virtual configuration, i.e., a construct to simplify the identification of components comprising the cleaning head subsystem and their integration in combination with the robot.

It is therefore to be understood that, within the scope of the appended claims, the present invention may be practiced other than as specifically described herein.

We claim:

1. A robot comprising:

a robot housing having a forward portion;

a motor drive housed in the robot housing and configured to maneuver the robot on a floor surface;

at least two independently driven drive wheels moveably attached to the robot housing and biased toward the floor surface, each of the drive wheels being independently moveable downwardly;

a plurality of cliff sensors disposed forward of the wheels and spaced from each other, each cliff sensor comprising an emitter positioned to direct emissions toward a floor surface and a detector configured to receive emitter emissions reflected off of the floor surface, each cliff sensor responsive to a cliff in the floor surface and configured to send a signal when a cliff in the floor surface is detected;

at least one side brush driven about a nonhorizontal axis and comprising at least one brush arm having a plurality of bristles, at least a portion of the at least one side brush extending beyond a peripheral edge of the robot housing, and at least a portion of the at least one brush arm periodically intersecting a path between at least one of the plurality of cliff sensors and the floor surface; and a controller in communication with the plurality of cliff sensors and the motor drive, configured to redirect movement of the robot when a cliff in the floor surface is detected.

2. The robot of claim 1, further comprising an obstacle detection sensor including an emitter and detector configured to detect the proximity of the robot to an obstacle and transmit a detection signal to the controller.

3. The robot of claim 2, wherein the obstacle detection sensor is substantially adjacent the forward portion of the robot housing.

4. The robot of claim 1, wherein the controller is configured to initiate a collision avoidance routine that navigates the robot about objects as the robot is maneuvered across the floor surface.

5. The robot of claim 1, wherein the plurality of cliff sensors are substantially equally spaced from one another along the forward portion of the robot housing.

6. The robot of claim 1, wherein the at least two drive wheels are moved to an extended position when the robot is removed from the floor surface.

7. The robot of claim 1, wherein free ends of the bristles of the at least one side brush define a locus that intersects a peripheral edge of one of the at least two independently driven drive wheels.

8. The robot of claim 1, further comprising a wheel drop sensor in communication with each drive wheel that is configured to sense when a drive wheel moves downwardly and send a signal indicating downward movement of the drive wheel.

9. The robot of claim 8, wherein the wheel drop sensor senses when the drive wheel pivots downwardly.

10. The robot of claim 8, wherein the wheel drop sensor senses when the drive wheel extends downwardly.

11. The autonomous coverage robot of claim 8, wherein the wheel drop sensor senses when the drive wheel extends in a direction away from the robot housing.

12. The robot of claim 8, wherein the controller is in communication with each of the wheel drop sensors.

13. A robot comprising:

a robot housing having a forward portion;

a motor drive housed in the robot housing;

at least two independently driven drive wheels moveably attached to the robot housing, each of the drive wheels being moveable downwardly;

a plurality of cliff sensors disposed forward of the wheels, each cliff sensor configured to send a signal when a cliff in the floor surface is detected;

at least one side brush, comprising at least one brush arm that includes a plurality of bristles, and at least a portion of the at least one brush arm periodically intersecting a path between at least one of the plurality of cliff sensors and the floor surface; and a controller in communication with the plurality of cliff sensors and the motor drive, configured to redirect movement the robot when a cliff in the floor surface is detected.

14. The autonomous coverage robot of claim 13, wherein the plurality of cliff sensors are substantially evenly positioned along the forward portion of the robot housing.

15. The autonomous coverage robot of claim 13, wherein the controller is configured to initiate a collision avoidance routine that navigates the robot about objects as the robot moves across the floor surface.

16. The autonomous coverage robot of claim 13, wherein the at least one side brush is mounted in a recess in the robot housing in front of one of the drive wheels and adjacent the peripheral edge of the robot housing.

17. The autonomous coverage robot of claim 13, further comprising a bumper extending along a portion of the robot housing, the bumper having a bumper sensor responsive to movement of the bumper relative to the robot housing.

18. The autonomous coverage robot of claim 13, further comprising an obstacle detection sensor including an emitter and detector configured to detect the proximity of the robot to an obstacle and transmit a detection signal to the controller.

19. The autonomous coverage robot of claim 13, wherein the at least two drive wheels are moved to an extended position when the robot is removed from the floor surface.

20. The autonomous coverage robot of claim 13, wherein free ends of the bristles of the at least one side brush define a locus that intersects a peripheral edge of one of the at least two independently driven drive wheels.

21. The autonomous coverage robot of claim 13, further comprising a wheel drop sensor in communication with each drive wheel that is configured to sense when a drive wheel moves downwardly and send a signal indicating downward movement of the drive wheel.

22. The autonomous coverage robot of claim 21, wherein the wheel drop sensor senses when the drive wheel pivots in a direction away from the robot housing.

23. The autonomous coverage robot of claim 21, wherein the wheel drop sensor senses when the drive wheel extends in a direction away from the robot housing.

24. The autonomous coverage robot of claim 21, wherein the controller is in communication with each of the wheel drop sensors.

* * * * *